US005975348A

United States Patent [19]

Rudewicz et al.

[11] Patent Number: 5,975,348

[45] Date of Patent: Nov. 2, 1999

[54] VENDING MACHINE WITH MECHANISED FREEZER DOOR AND FAILURE CONTROL DEVICES

[75] Inventors: Paul T. Rudewicz, Mission Viejo; Thom Thomas, Ventura; Mark A. Hopkins, Laguna Niguel; Robert K. Chan, Irvine, all of Calif.

[73] Assignee: KRh Thermal Systems, San Bruno, Calif.

[21] Appl. No.: 09/089,885

[22] Filed: Jun. 3, 1998

Related U.S. Application Data

[60] Division of application No. 08/427,953, Apr. 20, 1995, Pat. No. 5,799,822, which is a continuation-in-part of application No. 08/231,195, Apr. 21, 1994, Pat. No. 5,503,300.

[51] Int. Cl.[6] ..... A24F 27/14

[52] U.S. Cl. ..... 221/150 R; 221/247

[58] Field of Search ..... 221/150 R, 150 HC, 221/269, 268, 258, 247, 248, 249, 277, 2, 7, 3, 15, 9, 13

[56] References Cited

U.S. PATENT DOCUMENTS 4,429,778 2/1984 Levasseur ..... 194/10
4,676,074 6/1987 Morgan, Jr. et al. ..... 221/150 R
4,823,984 4/1989 Ficken ..... 221/150 HC

FOREIGN PATENT DOCUMENTS 906376 9/1962 United Kingdom .

*Primary Examiner*—Kenneth Noland
*Attorney, Agent, or Firm*—Skjerven, Morrill, MacPherson, Franklin & Friel LLP; Omkar K. Suryadevara

[57] ABSTRACT

In accordance with the present invention, a vending machine includes a number of failure control devices that monitor and control the functioning of the various components in the vending machine to ensure uniform quality of food products to be sold to a customer. One specific embodiment includes plurality of oven failure control devices, a freezer failure control device and a power failure control device. When a microcontroller in the vending machine determines the occurrence of a failure, the microcontroller displays a failure message on a customer display and discontinues vending food until the failure is corrected, for example, by an operator. In another aspect of this invention, the vending machine includes a mechanism for operating a door of a refrigeration compartment of the vending machine. The mechanism includes a motor driven rotary link coupled to a roller that moves in a slot of the door.

11 Claims, 65 Drawing Sheets

Microfiche Appendix Included
(7 Microfiche, 636 Pages)

KEY TO FIG 10F

| FIG. 10F-1 | FIG. 10F-2 |
|---|---|

KEY TO FIG 10H

| FIG. 10H-1 | FIG. 10H-2 |
|---|---|

KEY TO FIG 10J

| FIG. 10J-1 | FIG. 10J-2 |
|---|---|

| FIG. 17D-1 | FIG. 17D-2 |
|---|---|

| | |
|---|---|
| FIG. 17E-1 | FIG. 17E-2 |
| FIG. 17E-3 | FIG. 17E-4 |

| FIG. 17H-1 |
| --- |
| FIG. 17H-2 |

| FIG. 17J-1 | FIG. 17J-2 |
|---|---|

OVEN 210
MAGNETRON
303
V1
FA
F
V-1
V-2
V-3
V-4
C1
T1
(T1 COMMON)
(T1 220)
(MAG'S)
D5
1801
RLY5
VDC
D10
HEATER
MAGS
MAGNETRON
1303
V2
C2
T2
(T2 220)
D1
D2
CURRENT_SENSE_1
CURRENT_SENSE_2
MAGNETRON CURRENT MONITOR 1517
VCC
R15
R16
U2A
R13
R14
R34
U1B
R9
R10
R3
C1
R5
D8
U1A
R7
D6
R1
CR1
GND

| | |
|---|---|
| FIG. 18-1 | FIG. 18-2 |
| FIG. 18-3 | FIG. 18-4 |

| FIG. 20A | FIG. 20B |
|---|---|

VENDING MACHINE WITH MECHANISED FREEZER DOOR AND FAILURE CONTROL DEVICES

CROSS REFERENCE TO RELATED APPLICATIONS

This application is a divisional of U.S. patent application Ser. No. 08/427,953 filed Apr. 20, 1995, now U.S. Pat. No. 5,799,822 issued on Sep. 1, 1998, that in turn is a continuation-in-part application of the U.S. patent application Ser. No. 08/231,195 filed Apr. 21, 1994 now U.S. Pat. No. 5,503,300, issued Apr. 2, 1996, and titled "Vending Machine Including Refrigeration And Oven Compartments" by Jack R. Prescott et al., assigned to the same assignee as the present application and that issued on Apr. 2, 1996 as U.S. Pat. No. 5,503,300.

CROSS REFERENCE TO MICROFICHE APPENDIX

Appendix A, which is a part of the present disclosure, is a microfiche appendix consisting of 7 sheets of microfiche having a total of 636 frames. Microfiche appendix A includes source code listing of computer programs, related data, compiler options and object code in one embodiment of this invention, which is described more completely below. In one specific embodiment of this invention, an executable image of the source code in Appendix A is generated by an Archimedes 8051 C Compiler V4.23 G/DXT and an Archimedes Universal Linker V.44 D/DXT, both available from Archimedes Software, Inc., 2159 Union Street, San Francisco, Calif. 94123-9923.

A portion of the disclosure of this patent document contains material which is subject to copyright protection. The copyright owner has no objection to the facsimile reproduction by anyone of the patent document or the patent disclosure, as it appears in the Patent & Trademark Office patent files or records, but otherwise reserves all copyright rights whatsoever.

FIELD OF THE INVENTION

The present invention pertains generally to the field of vending machines and in particular to a vending machine with multiple failure control devices that control the quality of food dispensed by the vending machine.

BACKGROUND OF THE INVENTION

Vending machines for storing and distributing food and other items to customers upon payment of a specified sum of money are known. In some vending machines, hot food can be dispensed to customers. Such vending machines typically include a refrigerator for storing food, an oven for cooking food, a mechanism for transferring food between the refrigerator and oven, and a mechanism for dispensing the food from the vending machine. One previous vending machine is described in U.S. Pat. No. 5,210,387 to Smith et al., entitled "Food Handling System." Such vending machines have experienced problems, however, particularly in the storage area where the packages which contain the food items are typically stacked so high that packages at the bottom of the stack become crushed.

Moreover, if a component of a vending machine malfunctions, the vending machine can dispense food that is not of a quality expected by a consumer consistent with normal functioning of the vending machine For example, a vending machine may dispense coffee that is too hot to drink, or that is barely lukewarm, if a heat source in such a vending machine fails, with attendant consumer dissatisfaction and/or injury especially in the absence of indication of the heat source failure.

SUMMARY OF THE INVENTION

A vending machine according to the invention includes a refrigeration compartment, an oven, structure for transferring a food product from the refrigeration compartment to the oven, and structure for transferring the food product from the oven to a user of the vending machine.

In the refrigeration compartment, the food containing packages are stored in a vertical column arrangement, with each column being subdivided by retention levers into separate stacks to prevent the packages at the bottom of the column from having to bear the weight of all of the overlying packages.

The refrigeration compartment includes an inventory carousel which holds a plurality of inventory magazines, each inventory magazine holding several stacks of food packages. When a consumer makes a selection from the vending machine, the inventory carousel rotates until an inventory magazine which holds the selected food item is positioned over a food delivery door in a floor of the refrigeration compartment. The retention levers in that inventory magazine are then actuated, and the bottom food package in each stack is released. For all stacks except the lowermost stack, the food package drops to the next lower stack. The bottom food package in the lowermost stack is released so that it may be delivered from the bottom of the refrigeration compartment. In a preferred embodiment, the food package is dropped on to the food delivery door, which then opens to release the food package from the refrigeration compartment.

The rotational movement of the inventory carousel is produced by means of a Geneva mechanism and controlled by a software program, both of which are structured to limit the acceleration forces on the inventory carousel and associated mechanical parts and thereby reduce mechanical wear.

The food package includes a tray which holds the food item and a package sleeve which encloses the tray. The ends of the package sleeve are beveled to aid the retention levers in holding the food package and to prevent the food packages from binding while they are in the inventory magazine.

The food package is received by a delivery tray after the food package leaves the refrigeration compartment. In a preferred embodiment, after receipt of the food package, the delivery tray pivots 90 degrees so as to align the food package properly with a sleeve/de-sleeve mechanism. The sleeve/de-sleeve mechanism removes the tray from the package sleeve and inserts the tray into the oven, where the food item is cooked for a preselected time.

At the conclusion of the cooking cycle, the sleeve/de-sleeve mechanism replaces the hot food tray into the package sleeve, and the food package is delivered to the consumer.

The vending machine of this invention contains many unique features which improve operation of the vending machine. For example, the delivery tray is tilted upon receipt of the food package from the refrigeration compartment to prevent the food package from getting caught in the food delivery door of the refrigeration compartment. The oven includes an interlock switch which prevents the oven (advantageously a microwave oven) from being turned on while the oven door is opened.

The vending machine of this invention also includes a number of failure control devices that monitor and control the functioning of the various components in the vending machine. One specific embodiment includes a plurality of failure control devices, such as oven control devices, freezer control devices and power failure control devices. Based on signals from such failure control devices, a microcontroller in the vending machine can determine the occurrence of a component failure that affects food quality. Once the microcontroller determines that such a component failure has occurred (also referred to as "fault" or "failure condition"), the vending machine displays a failure message on a customer display and discontinues vending food until the failure condition has been corrected, for example, by an operator. Therefore failure control devices and methods of the vending machine ensure uniform quality of the food products being dispensed.

One embodiment of an oven control device includes an oven thermocouple monitor that has an oven temperature line coupled to the microcontroller. During normal operation of the vending machine, the oven thermocouple monitor uses an oven temperature probe to sense the oven temperature and drives an oven temperature signal, for example an analog signal between 0 and 5 volts on the oven temperature line.

The oven temperature signal indicates an oven temperature between a predetermined lower limit, for example 330° F. and a predetermined upper limit, for example 500° F. that define a predetermined operational range.

If the microcontroller determines that the oven temperature falls outside the predetermined operational range, then the microcontroller determines that the oven cannot be used for vending operations. The microcontroller repeatedly turns the oven heating element on and off using a non-adaptive proportional-integral-derivative control method to maintain the oven temperature close to the set point temperature The vending machine also displays a "WARMING UP" message and does not accept money if, for example, the vending machine was recently powered on and the oven temperature is still below or at the predetermined lower limit of 330° F.

Another embodiment of an oven control device includes a magnetron current monitor that has a magnetron status line coupled to the microcontroller. The magnetron current monitor drives a magnetron current sense signal, for example, an active low digital signal, on the magnetron status line to indicate that magnetrons in the microwave oven are drawing power. The microcontroller checks the magnetron current sense signal, for example, 7 seconds after driving a magnetron enable signal active on a magnetron enable line to turn on the magnetrons. If the microcontroller finds that at least one magnetron is not drawing power, the microcontroller determines that, for example, a magnetron failure has occurred, and the vending machine suspends vending until the error is corrected.

Yet another oven control device includes a heating element cutoff switch, such as an airstream bimetallic switch coupled in series with the power supply of the oven's heating element. The cutoff switch automatically opens if the heating element remains above a predetermined temperature, for example, 500° F. in one embodiment. The cutoff switch eliminates damage to the oven by the heating element, for example in case of a failure of a blower in the hot air impingement apparatus of the oven.

The oven control devices described above prevent vending of uncooked, partially cooked, overcooked or burned food by the vending machine.

One embodiment of a freezer control device includes a freezer thermistor monitor that drives freezer over-temperature signal, for example an active low digital signal, on a freezer over-temperature line coupled to the microcontroller to indicate that the temperature of a refrigeration compartment (also called "freezer") in the vending machine has exceeded a predetermined temperature. In this embodiment, the freezer control device also includes a freezer event monitor that drives a number of freezer signals, for example, active low digital signals, on respective freezer event lines coupled to the microcontroller, to indicate that the freezer was halted by, for example turning on of an automatic defrost heater or opening of the freezer door respectively. The microcontroller waits until after a predetermined cool off time, such as 75 minutes after a normal event as indicated by an active freezer event signal to check for an active freezer over-temperature signal to determine that a freezer failure occurred. The freezer control device ensures that the vending machine does not vend food that has deteriorated due to loss of refrigeration.

One embodiment of a power failure control device includes a real time clock and a current time storage element, such as a memory location in a random access memory (RAM), that are both coupled to the microcontroller, and that are both powered by a battery so that they continue to operate during a power failure condition of the vending machine. When the vending machine is powered up, for example following a power loss, the microcontroller compares a real time signal from the real time clock with a current time signal from the current time storage element to determine if the vending machine has been without power for more than a predetermined duration. If the time difference is smaller than the predetermined duration (e.g. 15 minutes), the microcontroller updates the current time storage element with the real time signal from the real time clock and otherwise determines that a freezer failure occurred and suspends vending food products from the freezer.

One embodiment of a failure control device in the vending machine includes a power supply cooling fan that cools various electronics, including transformers and a board containing relays, to eliminate failure of the electronics due to overheating. In one embodiment, the vending machine has a number of light emitting diodes (LEDs) that are lit up to indicate one or more faults signalled by the failure control devices. Such LEDs allow an operator to easily determine and perform corrective action needed to rectify a fault condition signalled by a failure control device.

In another aspect of the vending machine, a mechanism in the freezer has a dispensing freezer door formed of an insulating material and having a slot that constrains a roller. The roller is rotatably attached to one end of a link, with the other end of the link being fixedly attached to the shaft of a motor. When the motor rotates the link, the door slides to open and close an opening in the floor of the freezer. The dispensing freezer door mechanism eliminates numerous parts that are commonly present in conventional dispensing freezer door mechanisms, with the resultant savings in cost.

BRIEF DESCRIPTION OF THE DRAWINGS

FIGS. 7H–7K illustrate one embodiment of the mechanism of FIG. 7F.

DETAILED DESCRIPTION OF THE DRAWINGS

This application is related to and incorporates by reference the U.S. patent application Ser. No. 08/299,927, filed Aug. 31, 1994, and titled "Vending Machine Including Multiple Heat Sources With Programmable Cook Cycles" by Paul T. Rudewicz et al., that issued on Nov. 18, 1997 as U.S. Pat. No. 5,688,423.

This application is also related to and incorporates by reference the U.S. patent application Ser. No. 08/317,005, filed Oct. 3, 1994, entitled "Food Cooking Hot Air Dispensing Apparatus" by Mark A. Hopkins, that issued on Apr. 2, 1996 as U.S. Pat. No. 5,503,061.

Figure 1:
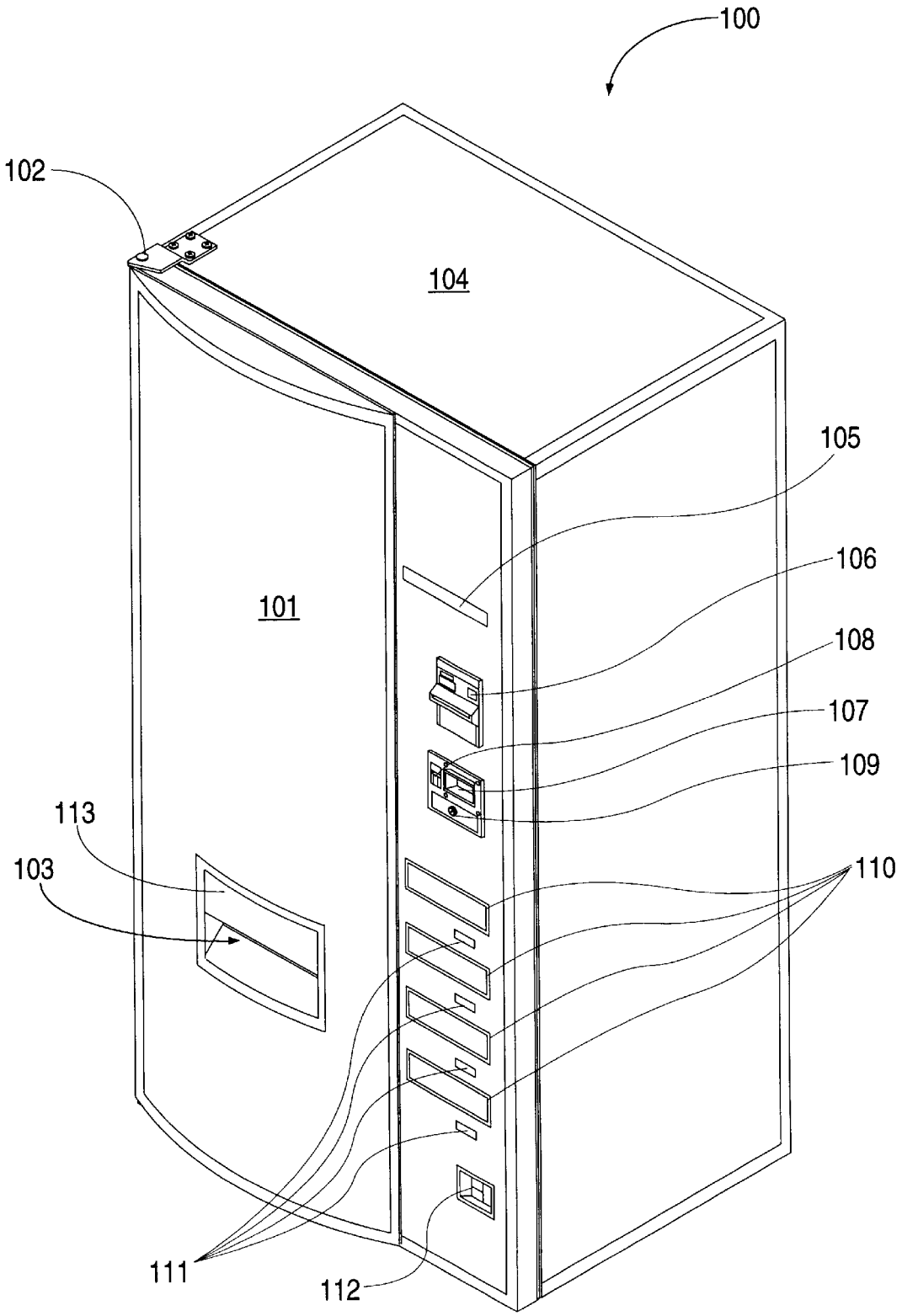
FIG. 1 is a perspective view of a vending machine according to the invention.
Figure 2:
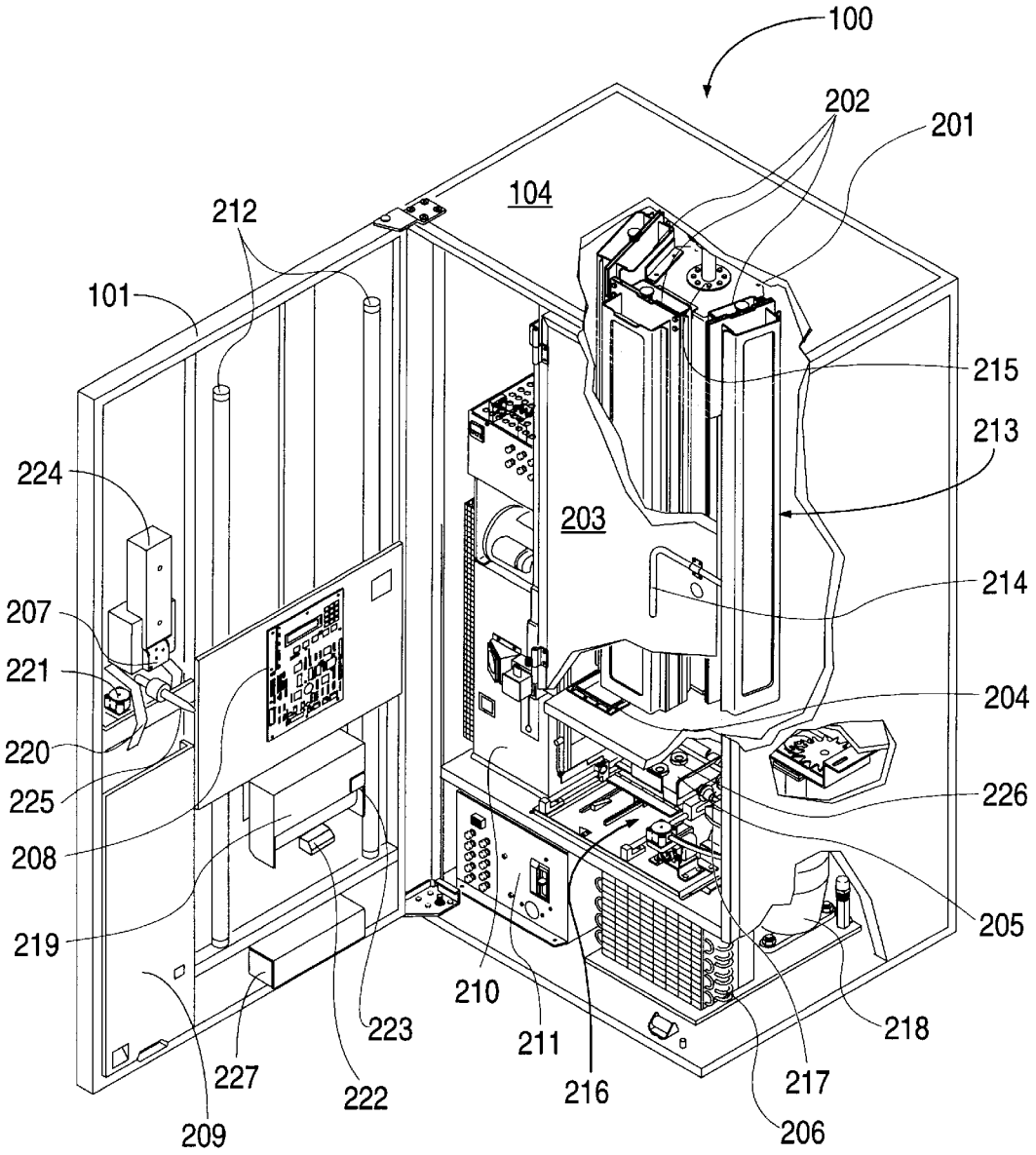
FIG. 2 is a perspective view of the vending machine of FIG. 1 with the front service door in an open position, illustrating components within the interior of the vending machine.

FIG. 1 is a perspective view of a vending machine 100 according to the invention. Vending machine 100 includes a main cabinet 104 and a front service door 101. In FIG. 1, front service door 101 is in a closed position, forming an enclosure with main cabinet 104, within which various components of vending machine 100 are housed, as explained in more detail below. Front service door 101 rotates about a hinge 102 so that front service door 101 can be positioned in an open position, as illustrated in FIG. 2.

Front service door 101 includes a convex-shaped section adjacent a flat section; however, this shape is not necessary to the invention. The convex-shaped section is lighted from behind, as explained further below, and typically includes a graphic display identifying the vending machine.

A delivery chute 103 is formed in the convex-shaped section of front service door 101 so that food products can be discharged from vending machine 100. A tamper barrier 113 helps to prevent tampering with the interior of vending machine 100 through delivery chute 103.

Various user interface features are formed in the flat section of front service door 101. A customer display 105 is a conventional fluorescent display panel for displaying various items of information to a user of vending machine 100. A bill acceptor slot 106 accepts paper money into a conventional bill acceptor mechanism 207 (FIG. 2) for purchasing food products or for making change. A coin insertion slot 107 accepts coins into a conventional coin changer for purchasing food products or for making change. A coin return actuator 108 is a conventional push-button mechanism for activating a coin return mechanism that returns the appropriate coins to a coin return slot 112. Coin return slot 112 also returns change either from purchasing a food product or from making change for paper money or larger coins. A door lock 109 enables front service door 101 to be secured so that front service door 101 cannot be opened without a key. A group of price displays 110 illustrate to the user the prices for each of the food products available from vending machine 100. A group of food selection buttons 111. each food selection button 111 corresponding to one of price displays 110, are conventional push-button mechanisms for enabling a user to select a desired food product from vending machine 100.

FIG. 2 is a perspective view of vending machine 100 with front service door 101 in an open position, illustrating components within the interior of vending machine 100. Some portions of vending machine 100 are cut away to better illustrate components of vending machine 100.

Various components are mounted on the interior of front service door 101. Two light sources 212 (other numbers of light sources can be used) emit light that is visible through front service door 101 so that the display on front service door 101 is backlit. In one embodiment, light sources 212 are fluorescent light bulbs. Bill acceptor mechanism 207 causes paper money inserted into bill acceptor slot 106 (FIG. 1) to be drawn into vending machine 100. A coin changer (only top 221 is visible in FIG. 2) supplies coins to coin return slot 112 and is located behind panel 209. A coin guide 220 guides inserted coins into the coin changer. A bill validator 224 ascertains proper insertion of paper money into bill acceptor slot 106. Locking latch 225 extends through refrigerator compartment door 203 and secures front service door 101. The ballast for the fluorescent bulbs is located behind cover 227. Swinging door 219, which is generally locked, is unlocked by solenoid 223 to allow discharge of a packaged food product through delivery chute 103. Stop 222 is used to help discharge a packaged food product from delivery tray 205, as explained in more detail below.

A control board 208 is a printed circuit board on which circuitry is formed and to which integrated circuit chips are attached. Control board 208 includes a microprocessor which is electrically connected to various sensors, motors, and other devices within vending machine 100 to control the functions of vending machine 100. Herein, when reference is made to performance of specified functions by control board 208, it is understood that the functions are controlled by the microprocessor and associated circuitry formed on control board 208.

A power supply 211 is mounted within main cabinet 104 underneath an oven 210 and supplies power for the electronics of vending machine 100. Power supply 211 supplies power at 24 volts DC, 5 volts DC, 24 volts AC rectified and unfiltered, 115 volts AC and 208 volts AC.

The interior of vending machine 100 includes, among other components discussed below, oven 210, a refrigeration compartment 213 (which is, in a preferred embodiment, a freezer), a delivery tray 205, a transfer mechanism 216 for movement (both rotational and translational) of delivery tray 205, and a sleeve/de-sleeve mechanism 217 for movement of a packaged food product to and from oven 210. Packaged food products are stored in refrigeration compartment 213, as described in more detail below. When a user selects a desired food product, the appropriate packaged food product is transferred from refrigeration compartment 213 through a food delivery door 204 to delivery tray 205, as also described in more detail below. Delivery tray 205 is positioned appropriately adjacent oven 210, the packaged food product is transferred into oven 210 by sleeve/de-sleeve mechanism 217, and the food product is cooked, each of these processes and associated structure being described more fully below. The packaged food product is then transferred from oven 210 back on to delivery tray 205 by sleeve/de-sleeve mechanism 217. Transfer mechanism 216 causes delivery tray 205 to move adjacent delivery chute 103, whereupon the packaged food product is discharged from vending machine 100.

Figure 3:
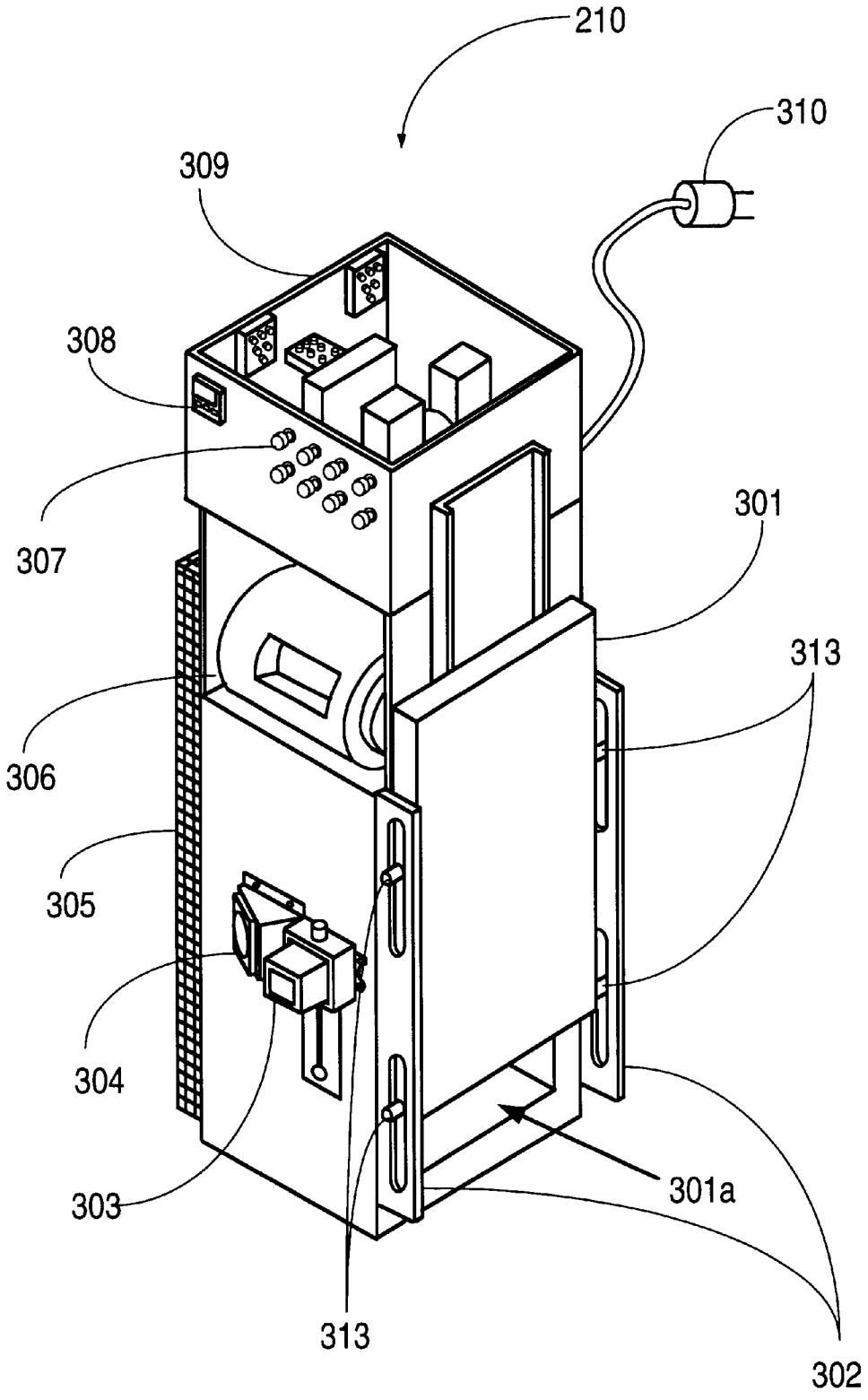
FIG. 3 is a simplified perspective view of the oven of the vending machine of FIG. 1.

FIG. 3 is a simplified perspective view of oven 210. The operation and construction of oven 210 is described in more detail in U.S. Pat. No. 5,147,994 to Smith et al., issued May 11, 1993, the pertinent disclosure of which is incorporated by reference herein. Some parts of oven 210, e.g., the interlock switch and associated actuating mechanism (see FIG. 13B), have been eliminated from FIG. 3 for clarity.

An oven door 301 is raised or lowered to expose or cover an oven aperture 301*a*. As explained in more detail below, an oven door motor, which is mounted beneath oven power supply box 309, drives an oven door bracket to move oven door 301. Oven door 301 is raised to an open position, as shown in FIG. 3, to allow a packaged food product to be inserted into and removed from oven 210 through oven aperture 301*a*. Oven door 301 is lowered to a closed position when a packaged food product is being cooked in oven 210. Pairs of guide pins 313 formed on opposite sides of oven door 301 move in corresponding slots in oven door guide rails 302 to guide the motion of oven door 301.

An oven power supply box 309 houses the power supply and control electronics for oven 210. Oven power supply box 309 is plugged into an outlet formed within main cabinet 104 by an oven power supply plug 310. An oven temperature sensor 308 is attached to oven power supply box 309 and monitors the temperature within oven 210. A plurality of safety fuses 307 are also formed on oven power supply box 309. Impingement motor 306 runs impingement blower within oven 210.

During operation of oven 210, a magnetron 303 supplies the microwaves within oven 210 with another magnetron (not visible in FIG. 3) located on the opposite side of oven 210. Associated with each magnetron is a magnetron fan 304 that cools the magnetron during operation of oven 210. A screen 305 is made of metal and contains microwaves within oven 210.

Referring again to FIG. 2, refrigeration compartment 213 is cooled by a refrigeration unit that includes a set of refrigeration coils 206 and a compressor 218 that is commercially available from Tecumseh Products Company of Tecumseh, Mich., as Model No. #AE2415-A. The refrigeration unit is mounted within vending machine 100 beneath refrigeration compartment 213. Refrigeration compartment 213 is accessed by opening a refrigeration compartment door 203. Refrigeration compartment door 203 is held closed by a latch 214. Latch 214 has an extending portion (not visible in FIG. 2) which fits into a corresponding slot formed along one edge of main cabinet 104 when latch 214 is in the position shown in FIG. 2.

Refrigeration compartment 213 houses an inventory carousel 201 which is attached to refrigeration compartment 213 as described below with respect to FIG. 6A. A multiplicity of inventory magazines 202 (three of which are shown in FIG. 2) are mounted, as described below with respect to FIG. 6A on inventory carousel 201. Each inventory magazine 202 has the capacity to hold a multiplicity of packaged food products. In the embodiment shown in FIG. 1, 30 packaged food products are housed in each inventory magazine 202. Each packaged food product includes a food product in a tray that is, in turn, contained within a package sleeve that has an opening at each of two opposing ends. The tray and package sleeve are described in more detail below with respect to FIGS. 9A and 9B.

Generally, any number of inventory magazines 202 can be mounted on inventory carousel 201 given the space constraints of refrigeration compartment 213. In the embodiment of the invention shown in FIG. 1, five inventory magazines 202 are mounted on inventory carousel 201. In this embodiment, vending machine 100 includes four food selection buttons 111. Each of three inventory magazines 202 holds packaged food products of one of the four types of food products available from vending machine 100, The fourth and fifth inventory magazines 202 hold packaged food products of the fourth type of food product available from vending machine 100, which is typically the product having the highest sales volume.

Figure 4:
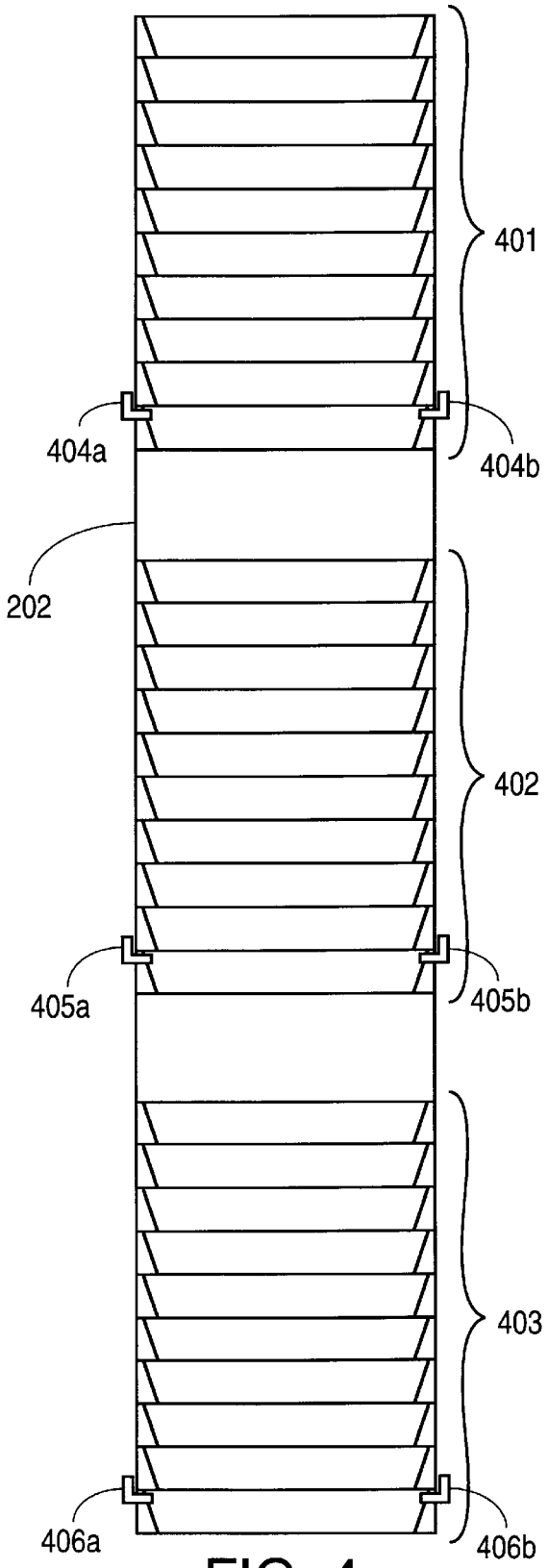
FIG. 4 is a simplified cross-sectional view of an inventory magazine according to the invention illustrating division of packaged food products in the inventory magazine into separate groups.

As explained in more detail below, the packaged food products in each inventory magazine 202 are divided into a multiplicity of separate stacks of food products, the stacks arranged vertically within each inventory magazine 202. In the embodiment of the invention shown in FIG. 1, in which each inventory magazine 202 contains 30 packaged food products, each inventory magazine 202 contains three stacks 401, 402 and 403 of 10 packaged food products, as shown schematically in FIG. 4. Each stack 401, 402 and 403 is held in place by a pair of retention levers 404*a* and 404*b*, 405*a* and 405*b*, and 406*a* and 406*b*, respectively. Subdividing the 30 packaged food products in this way prevents the bottom packaged food products in a stack from being crushed by the overlying packaged food products, since only 10 packaged food products are in any one stack, rather than 30.

Figure 5A:
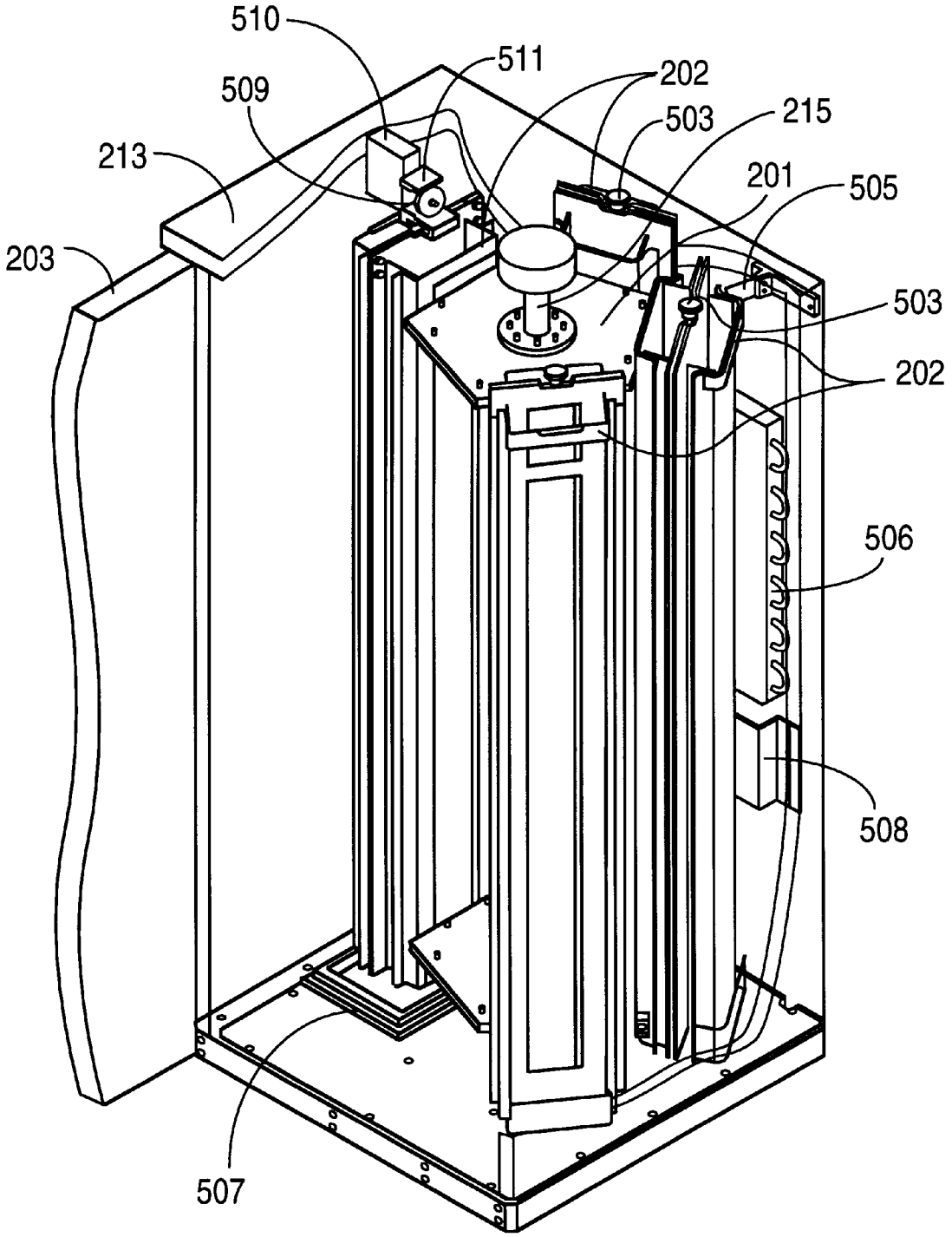
FIG. 5A is a perspective cutaway view of the refrigeration compartment of the vending machine of FIG. 1.

FIG. 5A is a perspective cutaway view of refrigeration compartment 213. A set of refrigeration coils 506 supply cooling fluid to cool refrigeration compartment 213. Refrigeration coils 506 are periodically heated to prevent ice from forming on the exterior of refrigeration coils 506. A moisture collector 508 collects water that drips from refrigeration coils 506 and routes the water through tubing (not shown) to the bottom of vending machine 100 where the water can be left to evaporate or discharged from vending machine 100.

Figure 7A:
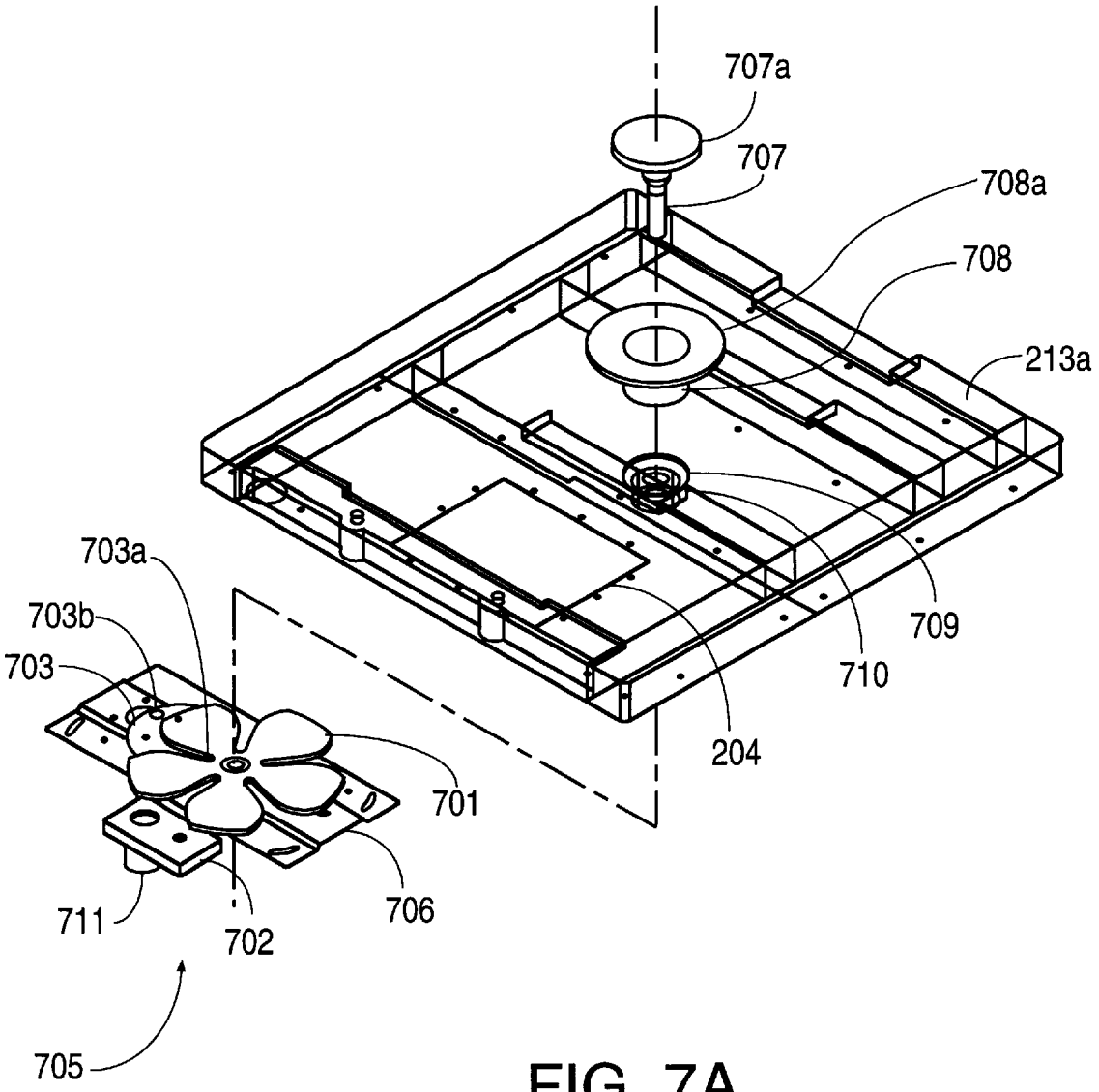
FIG. 7A is an exploded perspective view of the floor of the refrigeration compartment of FIG. 5A and a modified Geneva mechanism used to control rotation of the inventory carousel of the vending machine of FIG. 1.

Referring to FIG. 7A, inventory carousel 201 is attached to a shaft 707 which is driven by an inventory carousel motor 711 to rotate inventory carousel 201 so as to position a desired inventory magazine 202 above food delivery door 204. Referring again to FIG. 5A, a damper 505, which is a piece of sheet metal, fastened by, for instance, screws, to an interior wall of refrigeration compartment 213, helps control the rotational motion of inventory carousel 201 by applying a force to one of inventory magazines 202 opposite to the direction of rotation of inventory carousel 201.

A hole is formed in floor 213*a* of refrigeration compartment 213. A frame 507 is bolted to floor 213*a* of refrigeration compartment 213 around the hole to define an opening through which packaged food products are transferred from refrigeration compartment 213 to delivery tray 205. Unless a packaged food product is being transferred from refrigeration compartment 213, food delivery door 204 is closed and covers the opening in floor 213*a*. Food delivery door 204 is in an open position in FIG. 5A and therefore is not visible in FIG. 5A.

Figure 5C:
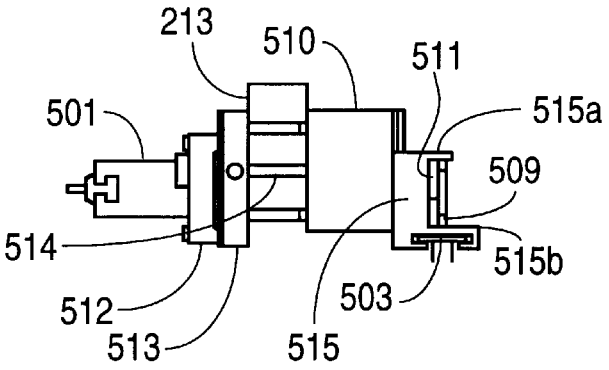
FIG. 5C is a front view of a portion of an inventory magazine of the vending machine of FIG. 1.
Figure 5B:
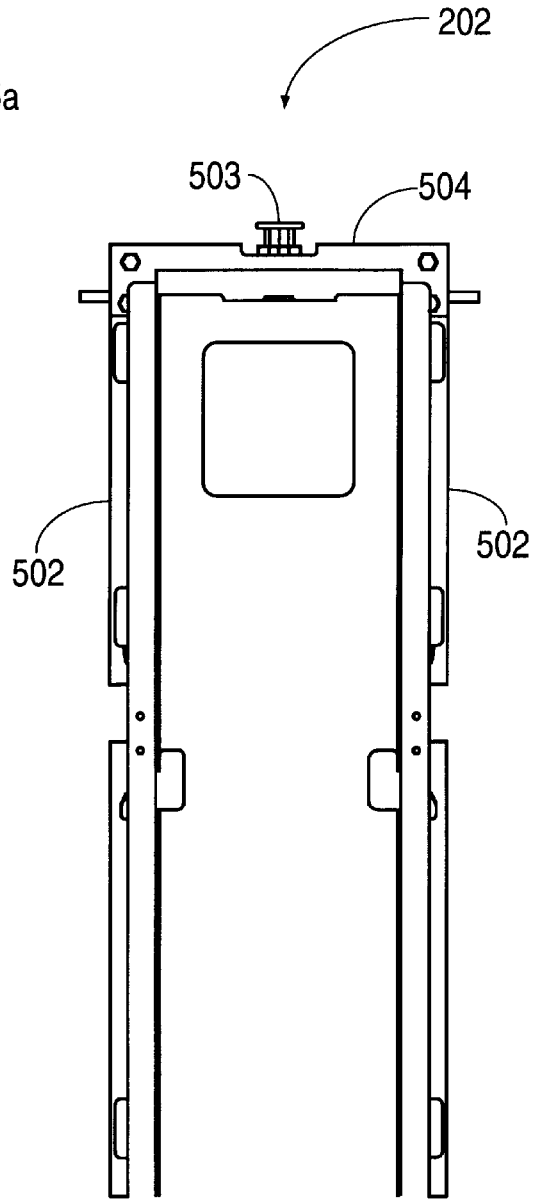
FIG. 5B is a side view of a portion of an inventory carousel of the vending machine of FIG. 1.

FIG. 5B is a side view of a portion of inventory carousel 201 illustrating a mechanism, explained in more detail below, for releasing packaged food products from one stack, e.g., stack 401, 402 or 403 (FIG. 4), to the top of another stack or out of inventory magazine 202 and through food delivery door 204 to delivery tray 205. Parts of inventory carousel 201 have been eliminated from FIG. 5B to improve the clarity of the drawing. FIG. 5C is a front view of a portion of inventory magazine 202.

To use vending machine 100, a user selects a food product by pressing one of food selection buttons 111 (FIG. 1). Each of food selection buttons selects a food product, e.g., french fries or pizza, as shown by the corresponding one of price displays 110. The depressed food selection button 111 closes a switch to notify control board 208 that a particular food product has been chosen. Control board 208 tests whether a food product is in delivery chute 103 by monitoring a conventional electrical switch mounted on the floor of delivery chute 103. If a food product is in delivery chute 103, operation of vending machine 100 is suspended until the food product is removed.

If a food product is not in delivery chute 103, then control board 208 activates the inventory carousel motor 711 (FIG. 7A) which rotates inventory carousel 201 until the appropriate inventory magazine 202 is positioned above food delivery door 204. A mechanism for indexing inventory carousel 201, described in more detail below, notifies control board 208 when the proper inventory magazine 202 is above food delivery door 204, at which time control board 208 ceases activation of the inventory carousel motor 711 and causes a braking force to be applied to inventory carousel 201.

Figure 6A:
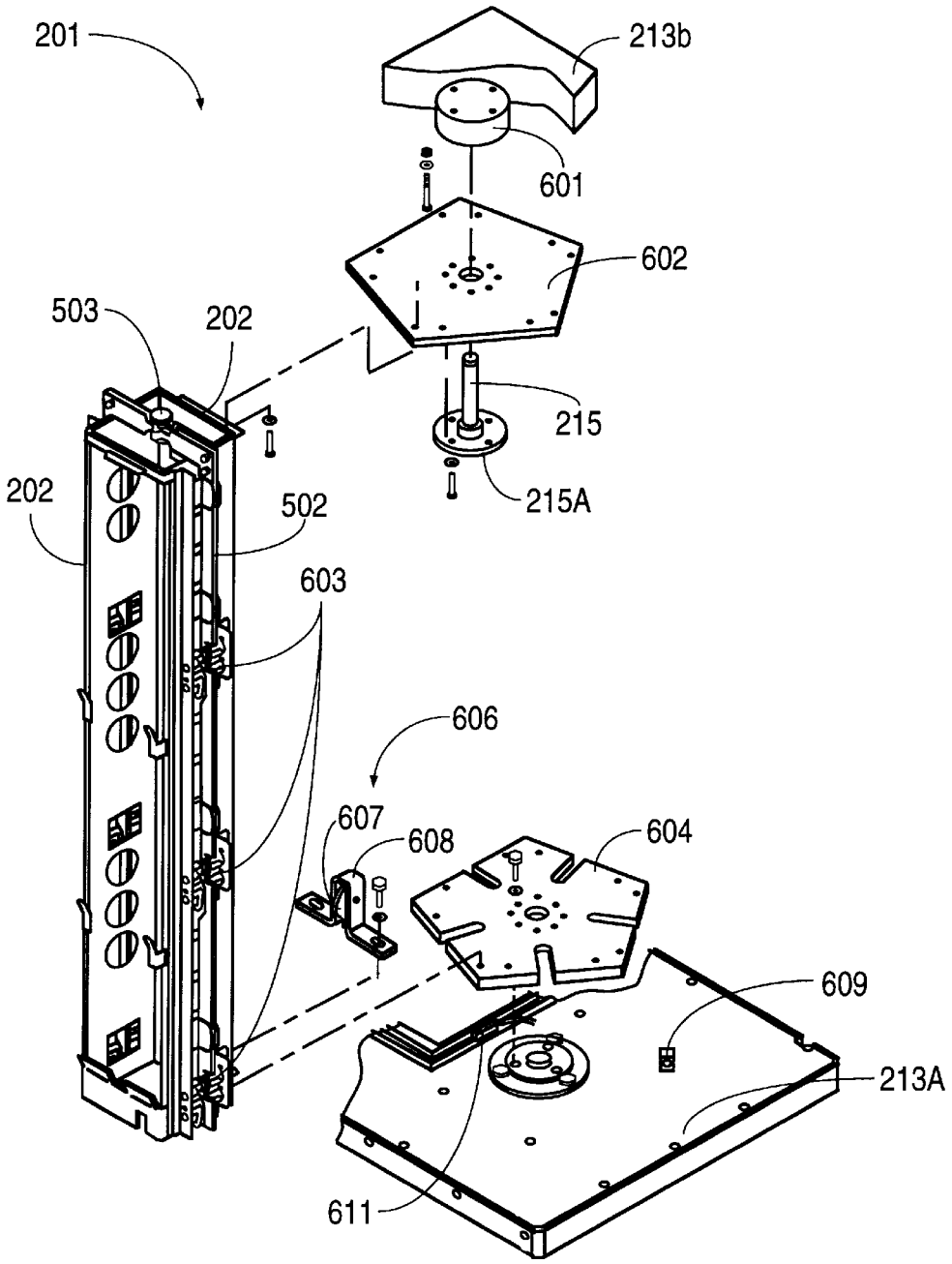
FIG. 6A is an exploded perspective view of the inventory carousel and one of the inventory magazines of the vending machine of FIG. 1.

FIG. 6A is an exploded perspective view of inventory carousel 201 with one of inventory magazines 202. A shaft bearing 601 is attached to ceiling 213*b* of refrigeration compartment 213 with, for instance, nuts and bolts. Shaft 215 extends through a hole in a top carousel plate 602 and into shaft bearing 601. Flange 215*a* is formed at the end of shaft 215 opposite the end within shaft bearing 601. Flange 215*a* is attached to top carousel plate 602 with, for instance, nuts and bolts.

Each of inventory magazines 202 includes a flange 202*a* near the top of inventory magazine 202 which is attached to top carousel plate 602 with, for instance, nuts and bolts. A flange (not visible in FIG. 6A) is also formed at the bottom of inventory magazine 202 and is attached to a bottom carousel plate 604 with, for instance, nuts and bolts. Bottom carousel plate 604 is, in turn, rotatably attached as described with respect to FIGS. 7A and 7B below, to the bottom of refrigeration compartment 213.

An empty magazine indicator 606 is attached to inventory magazine 202 near the bottom of inventory magazine 202 and indicates, as described in more detail below, when inventory magazine 202 no longer contains any packaged food products. One empty magazine indicator 606 is attached to each inventory magazine 202. A wire clamp 609 guides wires from the sensor of empty magazine indicator 606 along floor 213*a* of refrigeration compartment 213.

Figure 6B:
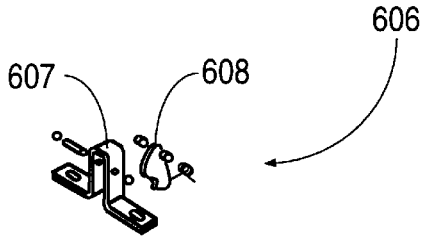
FIG. 6B is an exploded perspective view of an empty magazine sensor used with the inventory magazine of FIG. 6A.
Figure 6C:
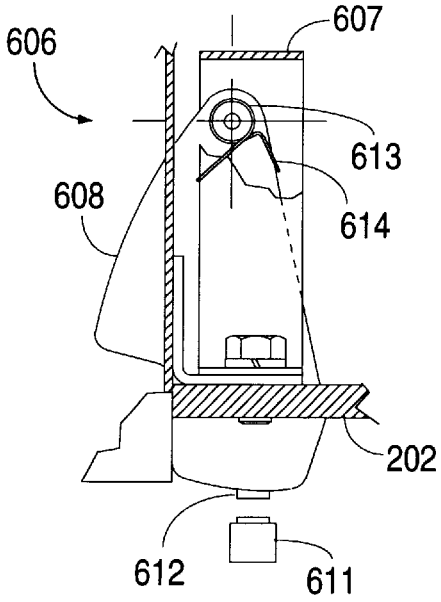
FIG. 6C is a side view of the empty magazine sensor of FIG. 6B in a first position when the inventory magazine is empty.
Figure 6D:
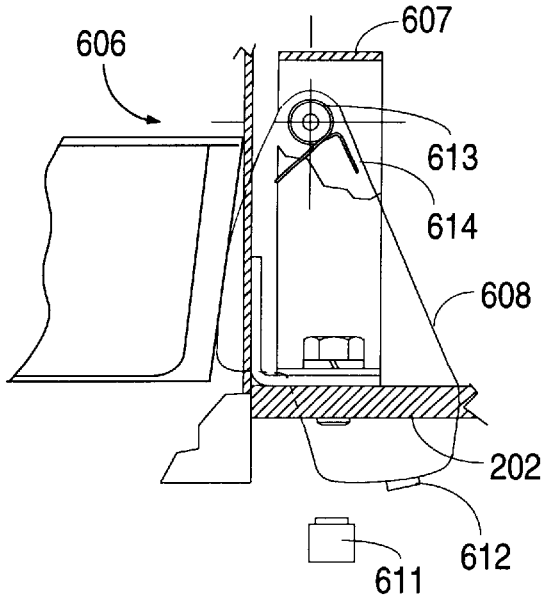
FIG. 6D is a side view of the empty magazine sensor of FIG. 6B in a second position when the inventory magazine is not empty.
Figure 6E:
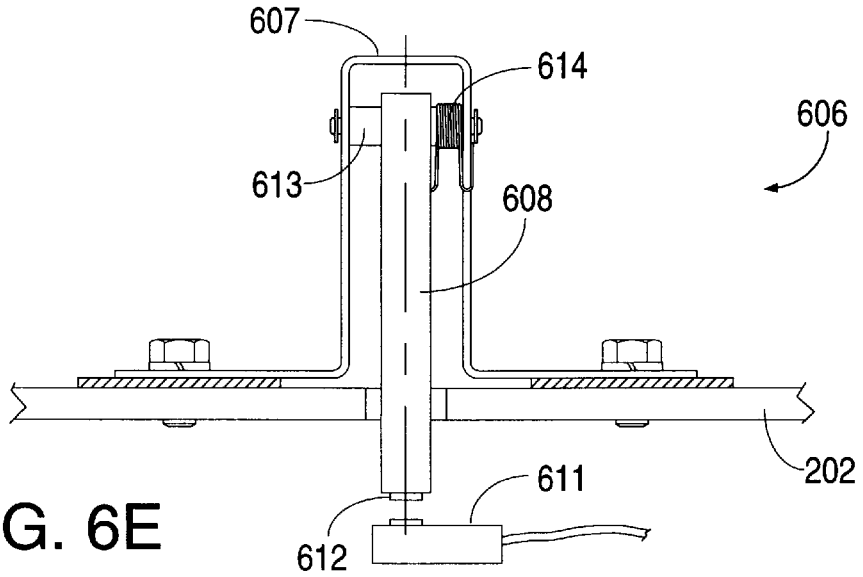
FIG. 6E is an end view of the empty magazine sensor of FIG. 6B.

FIG. 6B is an exploded perspective view of one of empty magazine sensors 606. FIG. 6C is a cutaway side view of empty magazine indicator 606 in a first position when inventory magazine 202 is empty. FIG. 6D is a cutaway side view of empty magazine indicator 606 in a second position when inventory magazine 202 is not empty. FIG. 6E is an end view of empty magazine indicator 606. Each of empty magazine sensors 606 includes a bracket 607 and a cam 608. Bracket 607 is attached to inventory magazine 202 by, for instance, nuts and bolts. Cam 608 includes a hole through which a rod 613 (FIGS. 6C and 6D) extends, rod 613 spanning the slot formed by bracket 607, so that cam 608 rotates about rod 613. Cam 608 is biased by a spring 614 to rotate forward to the position shown in FIG. 6C. A magnet 612 is mounted on the bottom of cam 608 and a Hall effect sensor 611 is mounted on floor 213*a* of refrigerator compartment 213. Hall effect sensor 611 and magnet 612 operate, as described in more detail below, to determine whether any packaged food products remain in inventory magazine 202.

FIG. 7A is an exploded perspective view of floor 213*a* of refrigeration compartment 213 and a modified Geneva mechanism 705 used to control rotation of inventory carousel 201. Modified Geneva mechanism 705 includes a cloverleaf-shaped output turret 701 and an input disk 703 on which drive pins 703*a* and 703*b* are formed. Turret 701 and input disk 703 are each rotatably attached to a mounting plate 706. An inventory carousel motor 711 is mounted on motor mounting plate 702, which is, in turn, attached to mounting plate 706, and drives input disk 703 to rotate, thereby causing inventory carousel 201 to rotate as explained below.

Figure 7B:
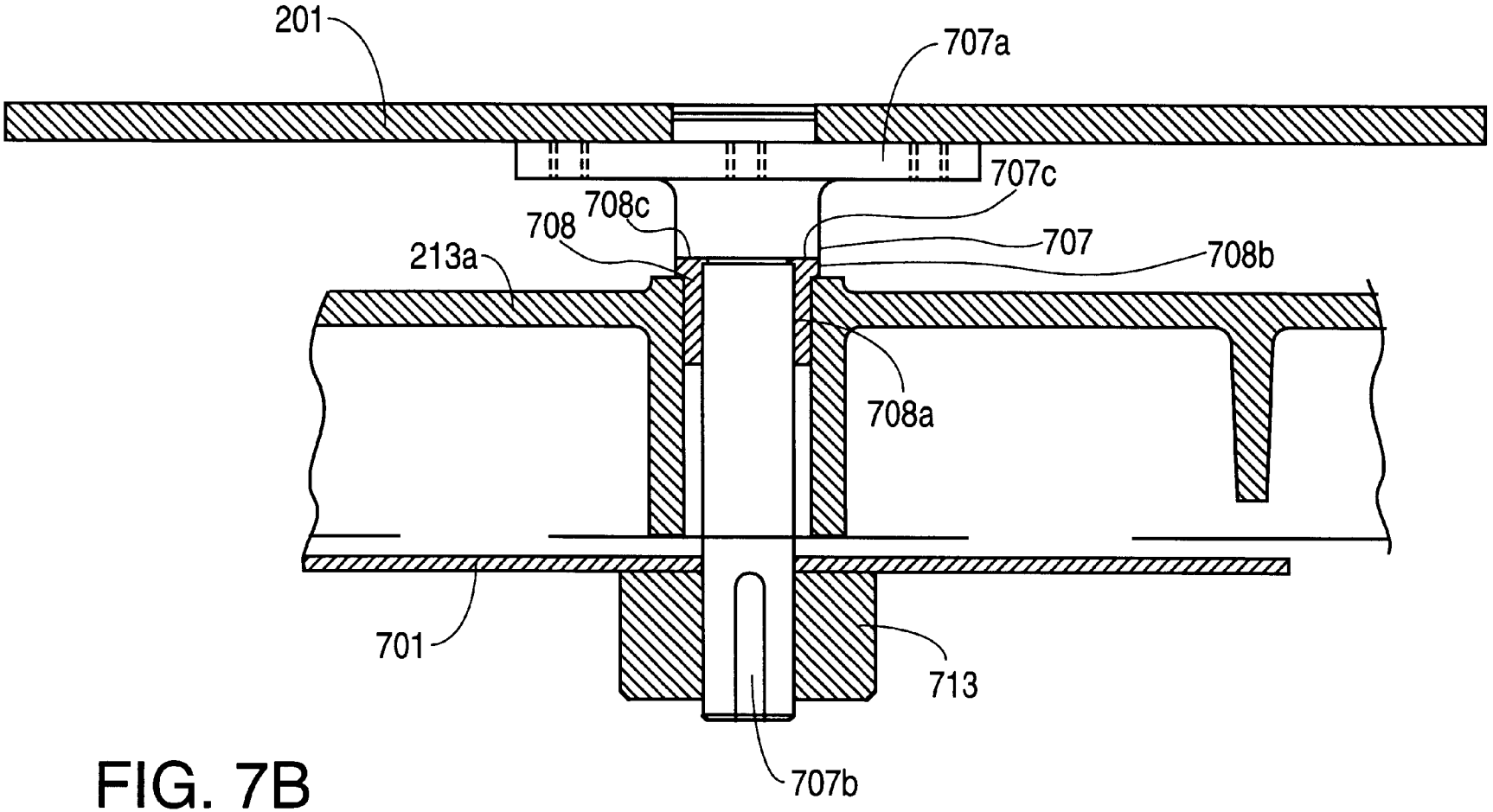
FIG. 7B is a cross-sectional view of a portion of the floor and modified Geneva mechanism of FIG. 7A.

FIG. 7B is a cross-sectional view of a portion of floor 213*a* of refrigeration compartment 213 and turret 701 of modified Geneva mechanism 705. Inventory carousel 201 is attached with nuts and bolts to a flange 707*a* of shaft 707. A shelf 707*c* of shaft 707 contacts a surface 708*c* of a Teflon bushing 708 so that shaft 707 fits through a hole 708*a* of bushing 708. A shelf 708*b* of bushing 708 is mounted on raised ribs of floor 213*a* so that, with shaft 707, bushing 708 extends through a hole in floor 213*a*. Shaft 707 includes key slot 707*b in* which a mating key (not shown) of hub 713 fits so that hub 713 is fixedly attached to shaft 707. Turret 701 is welded to hub 713. Consequently, when input disk 703 (FIG. 7A) is rotated to drive turret 701, shaft 707 is rotated, thereby rotating inventory carousel 201.

Figure 7E:
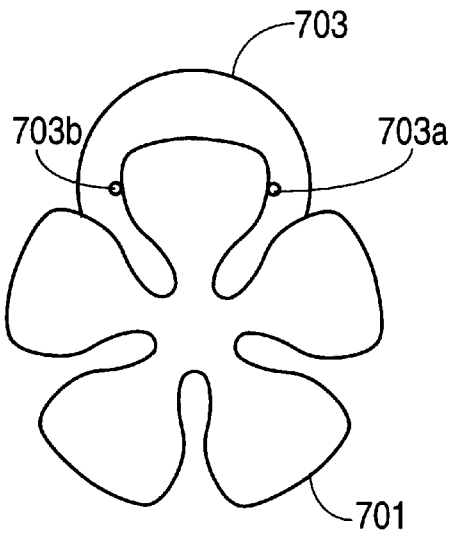
FIG. 7E is a simplified plan view of the modified Geneva mechanism of FIG. 7A illustrating the second indexed position.
Figure 7D:
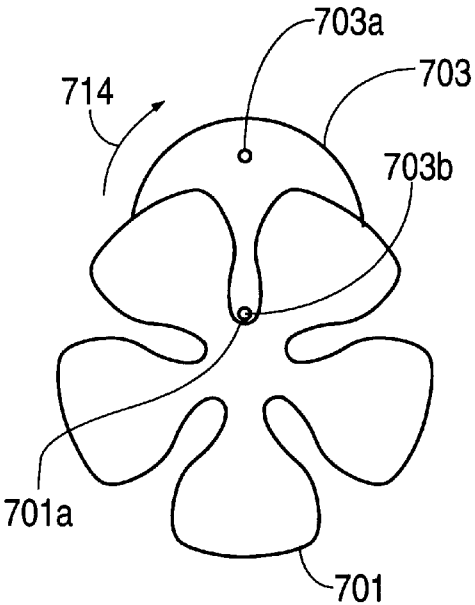
FIG. 7D is a simplified plan view of the modified Geneva mechanism of FIG. 7A illustrating a position midway between the first indexed position and a second indexed position.
Figure 7C:
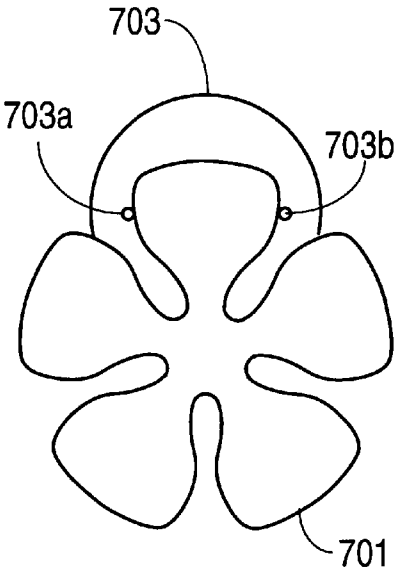
FIG. 7C is a simplified plan view of the modified Geneva mechanism of FIG. 7A illustrating a first indexed position.

FIGS. 7C through 7E are simplified plan views of modified Geneva mechanism 705 illustrating, respectively, a first index position, a position midway between the first index position and a second index position, and a second index position through which modified Geneva mechanism 705 passes during rotation of inventory carousel 201. "Index position" refers to a position of inventory carousel 201 where one of inventory magazines 202 is positioned over food delivery door 204. To rotate inventory carousel 201, inventory carousel motor 711 drives input disk 703 to rotate. At the beginning of rotation, inventory carousel 201 is positioned at a first index position (FIG. 7C). Rotation of input disk 703 in the direction of arrow 714 causes drive pin 703*b* to enter slot 701*a* of turret 701. As drive pin 703*b* enters slot 701*a*, drive pin 703*b* contacts turret 701, causing turret 701 to rotate. This, in turn, causes inventory carousel 201 to rotate (through shaft 707 and bottom carousel plate 604). Drive pins 703*a* and 703*b* are successively rotated into slots in turret 701 to continue advancing inventory carousel 202 to successive index positions, as directed by control board 208.

Although, in the embodiment of FIGS. 7A through 7E, a modified Geneva mechanism is used to drive rotation of the inventory carousel, it is to be understood that other drive mechanisms can be used such as a conventional Geneva mechanism or a barrel cam indexer. Other types of drive mechanisms that can be used with the invention are described in more detail at pp. 47–49 of the Jul. 9, 1993 issue of Machine Design, the pertinent disclosure of which is incorporated by reference herein.

Returning to FIG. 5B, after inventory carousel 201 reaches a desired position, control board 208 activates a magazine actuator motor 501 to drive the mechanism for releasing packaged food products from the stacks within one of inventory magazines 202. An inventory magazine lift mount 510 is attached to a wall of refrigeration compartment 213 by screws that are threaded through a mounting plate 513 located outside refrigeration compartment 213, through the wall of refrigeration compartment 213 and into inventory magazine lift mount 510. An inventory magazine lift 515 is movably attached to inventory magazine lift mount 510 and includes protruding arms 515*a* and 515*b*. A roller 509 and a crank 511 are mounted on a side of inventory magazine lift 515 opposite the side mounted to inventory magazine lift mount 510.

A magazine actuator motor 501 is attached to a mounting plate 512 which is, in turn, attached to mounting plate 513. Magazine actuator motor 501 rotates shaft 514, which, in turn, rotates a shaft (not shown) extending from inventory magazine lift 511. Roller 509 is eccentrically mounted via crank 511 to the shaft extending from inventory magazine lift 515 so that when the shaft is rotated, roller 509 contacts protruding arms 515*a* and 515*b* to cause inventory magazine lift 515 to move up and down.

A slot is formed in protruding arm 515*b* of inventory magazine lift 515. A lift engagement head 503 is attached to a cross bar 504 which links inventory magazine release rods 502. The lift engagement head 503 of the currently indexed inventory magazine 202 fits within the slot of protruding arm 515*b*, so that when inventory magazine lift 511 moves up and down, the inventory magazine release rods 502 are moved up and down. As seen in FIG. 6A, each inventory magazine release rod 502 includes a multiplicity of cam mechanisms 603, one cam mechanism 603 being associated with each stack of packaged food products in each inventory magazine 202. Cam mechanisms 603 control movement of the packaged food products through inventory magazine 202 in response to the up and down movement of inventory magazine release rod 502, as described in more detail below. One inventory magazine release rod 502, and associated cam mechanisms 603, is located on each side of inventory magazine 202.

Figure 8A:
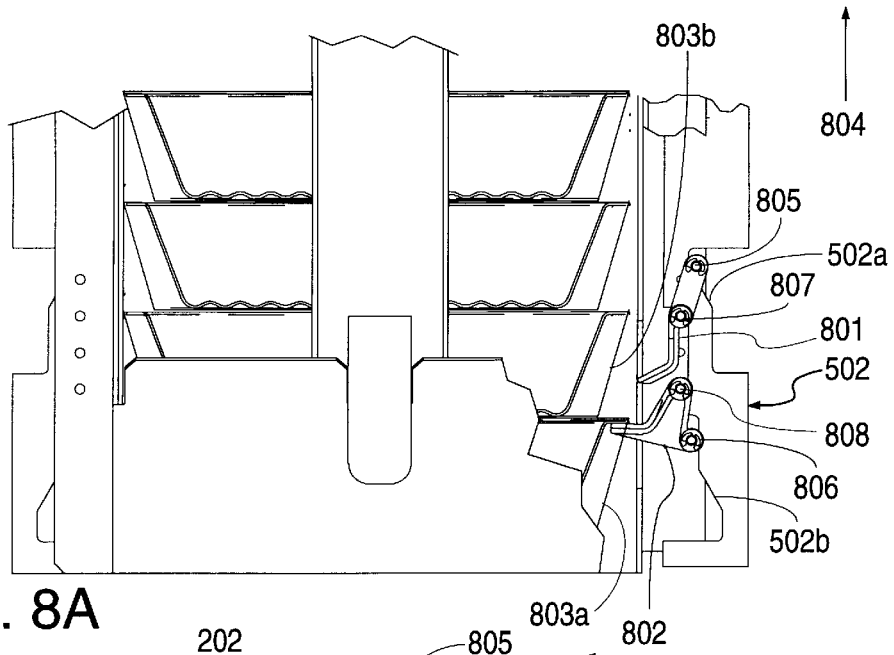
FIG. 8A is a cross-sectional view of a portion of the inventory magazine of FIG. 6A illustrating a first position of a cam mechanism for controlling the discharge of packaged food products from the inventory magazine.
Figure 8B:
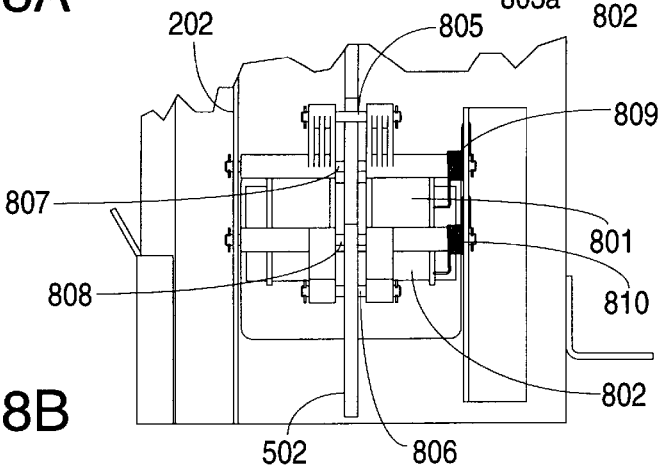
FIG. 8B is an end view of the cam mechanism of FIG. 8A.
Figure 8C:
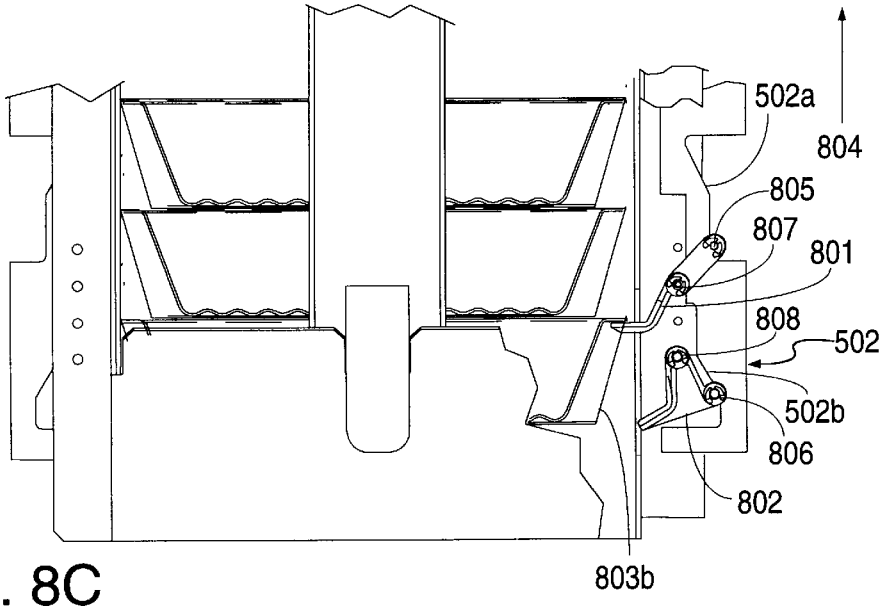
FIG. 8C is a cross-sectional view of a portion of the inventory magazine of FIG. 6A illustrating a second position of the cam mechanism for controlling the discharge of packaged food products from the inventory magazine.

FIG. 8A is a cross-sectional view of a portion of one of inventory magazines 202 illustrating a first position of one of cam mechanisms 603. FIG. 8B is an end view of one of cam mechanisms 603. FIG. 8C is a cross-sectional view of a portion of inventory magazine 202, illustrating a second position of cam mechanism 603. Retention levers 801 and 802 are mounted on pins 807 and 808, respectively, which are journaled in flanges that are part of inventory magazine 202, by extending pins 807 and 808 through sleeves formed as part of retention levers 801 and 802. Pins 805 and 806 are mounted through second sleeves formed as part of retention levers 801 and 802. A spring 809, mounted on the sleeve of lever 801 through which pin 807 extends, biases retention lever 801 in a counterclockwise direction about pin 807, as viewed in FIG. 8A. A spring 810, mounted on the sleeve of lever 802 through which pin 808 extends, biases retention lever 802 in a counterclockwise direction about pin 808, as viewed in FIG. 8A.

In the position of inventory magazine release rod 502 shown in FIG. 8A, retention lever 802 contacts a lip of a lowest packaged food product 803*a* and holds packaged food product 803*a* in place in inventory magazine 202. Retention lever 802 is held in position to hold packaged food product 803*a* by contact of pin 806 with cam surface 502*b*.

When inventory magazine release rod 502 is raised in the direction of arrow 804, pins 805 and 806 move along cam surfaces 502*a* and 502*b*, respectively, causing retention lever 801 to rotate about pin 807 in a clockwise direction and retention lever 802 to rotate about pin 808 in a counterclockwise direction. When inventory magazine release rod 502 is raised as high as possible by magazine actuator motor 501, as shown in FIG. 8C, retention lever 802 rotates to a sufficient degree to allow retention lever 802 to release packaged food product 803*a*. At the same time, retention lever 801 rotates to a sufficient degree to allow retention lever 801 to contact a lip of a packaged food product 803*b*, thereby holding packaged food product 803*b* (and the stack of packaged food products supported by packaged food product 803) in place in inventory magazine 202. Importantly, cam surfaces 502*a* and 502*b* are matched with each other so that retention lever 801 contacts packaged food product 803*b* before retention lever 802 releases packaged food product 803*a*. Additionally, the shape and size of retention levers 801 and 802 are chosen so as to retain and release packaged food products, as described above, when operated together with inventory magazine release rod 502 and associated cam surfaces 502*a* and 502*b*.

Though only one set of retention levers 801 and 802, and inventory magazine release rod 502 are described, it is to be understood that a corresponding set of retention levers and inventory magazine release rod are formed on an opposite side of the packaged food products so that the packaged food products are retained and released as described above.

Consequently, as a result of movement of inventory magazine release rod 502, a packaged food product at the bottom of each of the three stacks of packaged food products within inventory magazine 202 is dropped from the stack. For the lowest stack, this results in dropping the bottom packaged food product in the stack on to food delivery door 204. For each of the two remaining stacks in each inventory magazine 202, this results in dropping the bottom packaged food product in the stack to the top of the next lowest stack of food products. If no packaged food products remain in a stack, no packaged food product is dropped from the stack.

Figure 9A:
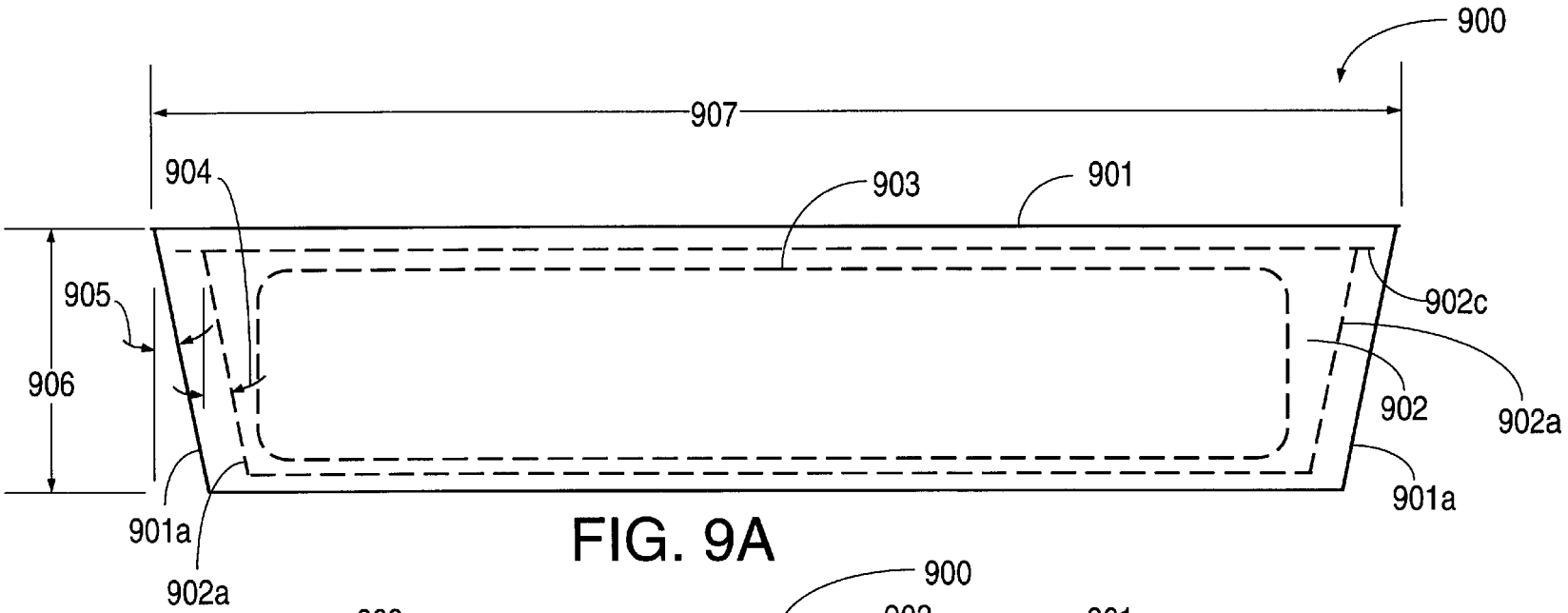
FIGS. 9A and 9B are a side view and end view, respectively, of a packaged food product including a package sleeve and tray according to the invention.
Figure 9B:
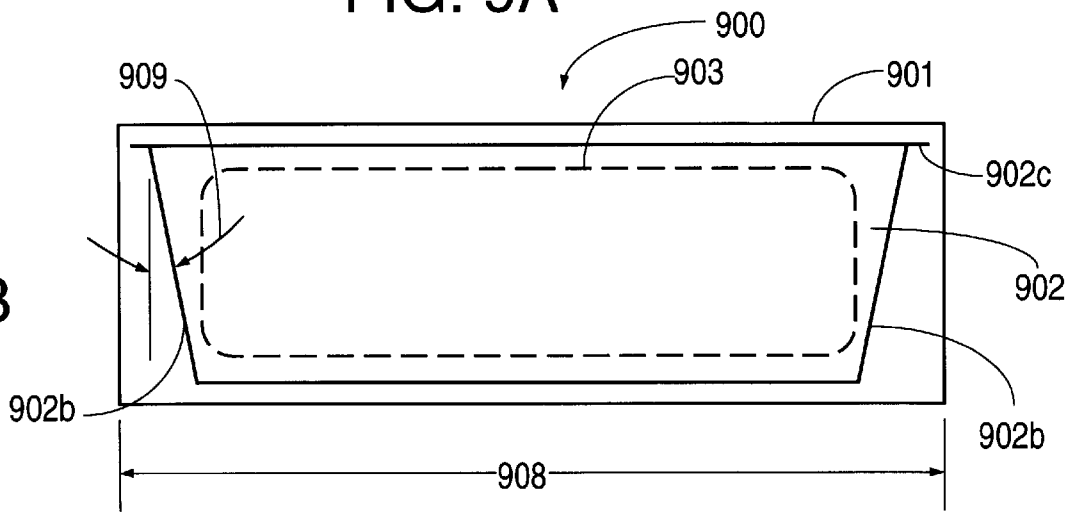

FIGS. 9A and 9B are a side view and end view, respectively, of a packaged food product 900 including a package sleeve 901 and a tray 902 according to the invention. A food item 903 lies within tray 902. Package sleeve 901 has a length 907 and width 908 that are made as large as possible while still allowing package sleeve 901 to fit within one of inventory magazines 202. Package sleeve 901 also has a height 906 that is chosen to be compatible with the height of tray 902.

Package sleeve 901 is formed with beveled sides 901*a* so that the upper surface of package sleeve 901 is longer than the bottom of package sleeve 901. An angle 905 measured between a plane perpendicular to the upper surface of package sleeve 901 and a beveled side 901*a* is, in one embodiment, approximately 16°.

Tray 902 is also formed with beveled sides 902*a* and 902*b* so that the upper surface of tray 902 is both longer and wider than the bottom surface of tray 902. An angle 904 measured between a plane perpendicular to the upper surface of tray 902 and a beveled side 902*a* is, in one embodiment, approximately 19°. An angle 909 measured between a plane perpendicular to the upper surface of tray 902 and a beveled side 902*b* is, in one embodiment, approximately 17°. Tray 902 also has a lip 902*c* formed around the upper periphery of tray 902.

The beveled sides of package sleeve 901 and tray 902 allow retention levers 801 and 802 of cam mechanisms 603 to grip the upper portion of package sleeve 901, while preventing retention levers 801 and 802 from contacting the bottom portion of package sleeve 901 or tray 902.

After packaged food product 803*a* is dropped, magazine actuator motor 501 continues to rotate roller 509 and crank 511 so that inventory magazine release rod 502 is lowered, i.e., moves in the direction opposite that of arrow 804. Cam surfaces 502*a* and 502*b* interact with pins 805 and 806 to reverse the motion of retention levers 801 and 802 described above. Again, cam surfaces 502*a* and 502*b* are matched to each other so that retention lever 802 is in place to catch packaged food product 803*b* before retention lever 801 releases packaged food product 803*b*.

A magazine actuator switch monitors rotation of magazine actuator motor 501, signalling to control board 208 to de-activate magazine actuator motor 501 when roller 509 has completed a rotation.

Eventually, all 30 packaged food products are distributed from each inventory magazine 202. When this occurs, vending machine 100 signals to a user that a particular food product is no longer available. As discussed above, and shown in FIGS. 6A through 6E, one empty magazine indicator 606 is attached at the bottom of each inventory magazine 202. So long as at least one packaged food product is present in inventory magazine 202, the packaged food product contacts cam 608 of empty magazine indicator 606, causing cam 608 to rotate about rod 613 of bracket 607 to a first position shown in FIG. 6D. In this position, Hall effect sensor 611 is not aligned with magnet 612, thereby indicating to control board 208 that inventory magazine 202 is not empty.

When no packaged food products are present in inventory magazine 202, cam 608 is biased by spring 614 to rotate forward to a second position shown in FIG. 6C. In this position, Hall effect sensor 611 is aligned with magnet 612, thereby notifying control board 208 that inventory magazine 202 is empty. When one of inventory magazines 202 is empty, control board 208 causes a display bar, e.g., a series of three dashes, to be displayed in the appropriate price display 110, rather than the price for that food product. Further, control board 208 does not process any request (as manifested by depression of the appropriate food selection button 111) for cooking of the food product that is no longer present in the inventory magazine 202.

Figure 7F:
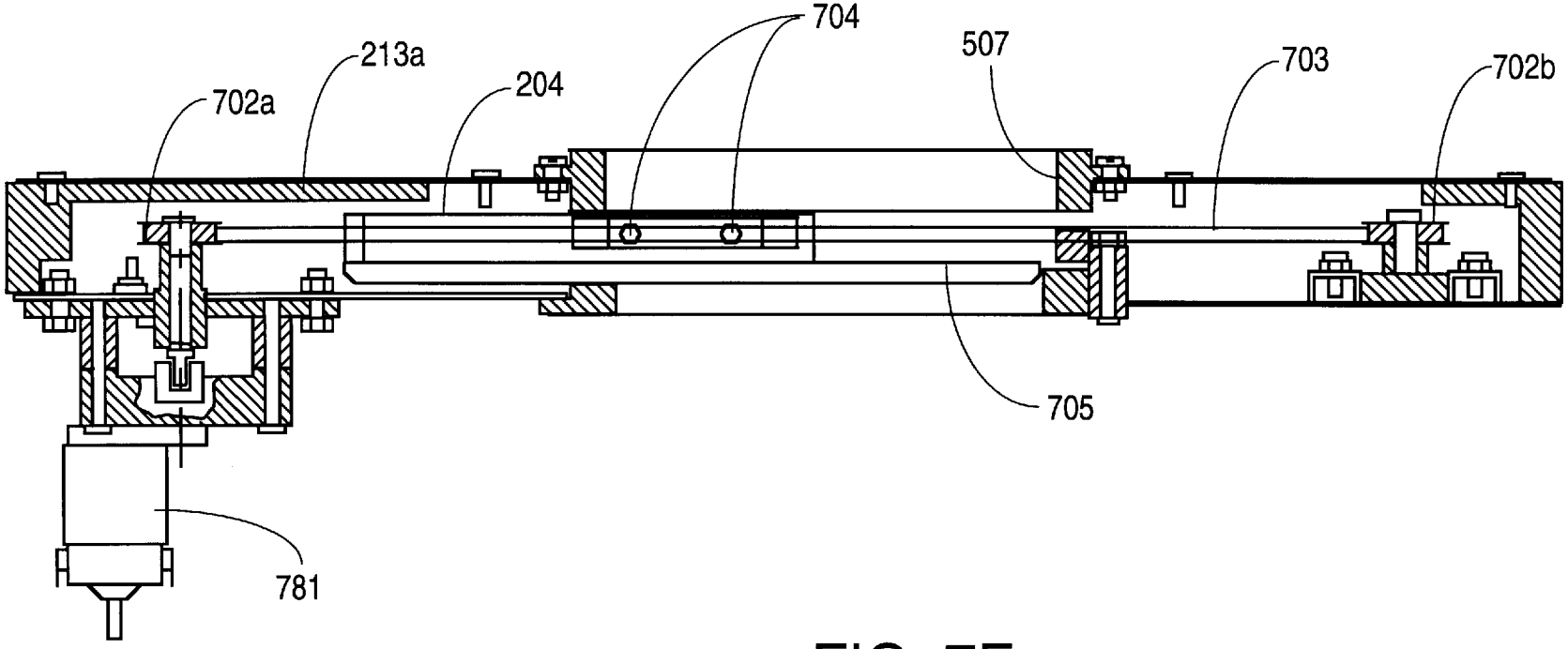
FIG. 7F is a cross-sectional view of the floor of the refrigeration compartment, illustrating a mechanism for opening and closing the food delivery door.

FIG. 7F is cross-sectional view of floor 213*a* of refrigeration compartment 213, illustrating a mechanism for opening and closing food delivery door 204. A food delivery door motor 781 drives a combination of shafts and gears to rotate a pulley 702*a*. A belt 703 is wound around pulleys 702*a* and 702*b*. Food delivery door 204 is attached with a clamp 704 to belt 703. When pulley 702*a* is rotated, belt 703 is driven to move food delivery door 204 (shown in a partially open position in FIG. 7F) with respect to the opening in floor 213*a* defined by frame 507. Belt 703 is moved between each of two extreme positions to open and close food delivery door 204 which moves laterally between floor 213*a* and guide 705.

After a packaged food product has been dropped on to food delivery door 204 (FIG. 2), control board 208 activates food delivery door motor 781 (FIG. 7F) to open food delivery door 204. A sensor mounted adjacent food delivery door 204 signals to control board 208 when food delivery door 204 is fully open, at which time control board 208 de-activates food delivery door motor 781. When food delivery door 204 is opened, the packaged food product drops on to delivery tray 205, which is in a first position.

In one embodiment of vending machine 100, the mechanism for opening and closing food delivery door 204 (FIG. 7H) uses a minimal number of moving parts, thereby reducing cost and enhancing reliability. A portion of food delivery door 204 defines a lateral slot 764 in which is mounted a nylon roller 765 (FIG. 7I). In one specific embodiment, slot 764 has a length l of approximately 4 inches that is formed in door 204 having a width W of approximately 5 inches and a length L of approximately 6 inches. In this embodiment, door 204 carries leaf springs 769 and 770 (shown in dashed lines in FIG. 7I, and more clearly in FIGS. 7J and 7K) that are mounted adjacent to longitudinal sides 771 and 772 of door 204. Leaf springs 769 and 770 assist door 204 to form a seal around frame 507 when door 204 is in the closed position.

Roller 765 rolls freely within slot 764 and is rotatably mounted at one end of a link 766. Another end of link 766 is rotatably coupled to the shaft of food delivery door motor 781. Food delivery door motor 781 can be operated by the microprocessor of control board 208 to move link 766 by an angle of 180° in this embodiment (angle of 90° in another embodiment) in the clockwise direction 768, which rotation causes roller 765 to move toward the opposite end of slot 764, thereby moving door 204 in the direction 775, which results in exposure of opening 763 in floor 213*a*. Door 204 is shown in a partially open position in FIG. 7J.

After a packaged food product has been dropped on to delivery tray 205, control board 208 activates food delivery door motor 781 to close food delivery door 204. Two Hall effect sensors are mounted in floor 213*a* adjacent food delivery door 204, and a magnet is mounted in door 204 such that the magnet is proximate one of the Hall effect sensors when door 204 is fully open or fully closed. One of the Hall effect sensors signals to control board 208 when food delivery door 204 is fully closed, at which time control board 208 de-activates food delivery door motor 781.

A software program controls the operation of inventory carousel motor 711 as it drives inventory carousel 201 to a new position, allowing a particular food item to be transferred to the oven. Each of inventory magazines 202 is identified by an index number and, when a customer orders a food item, the microprocessor within control board 208 instructs motor 711 to move inventory carousel 201 until the magazine 202 identified by the target index numbers is located above food delivery door 204.

Figure 10A:
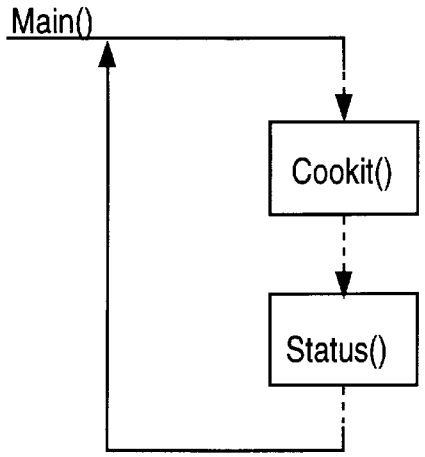
FIGS. 10A through 10L illustrate flowcharts of software that the microprocessor runs to control the inventory carousel motor.
Figure 10B:
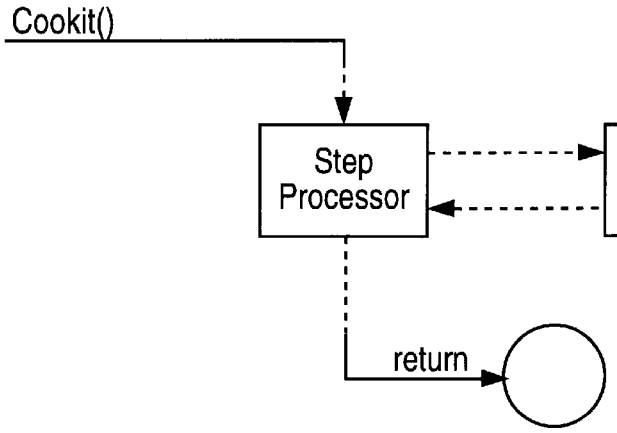

FIGS. 10A–10L illustrate flowcharts of the software that the microprocessor runs to control motor 711. The Main program is illustrated in FIG. 10A, which shows that the Main program cycles through subprograms designated Cookit and Status. Additional subprograms are in the Hain program but are not shown in FIG. 10A. FIG. 10B illustrates that the Cookit subprogram includes a program designated Step Processor. From Step Processor, the microprocessor cycles to a program designated IC_proc and returns to Step Processor. Cookit contains other programs and Step Processor cycles through other programs which are not illustrated in FIG. 10B.

Figure 10C:
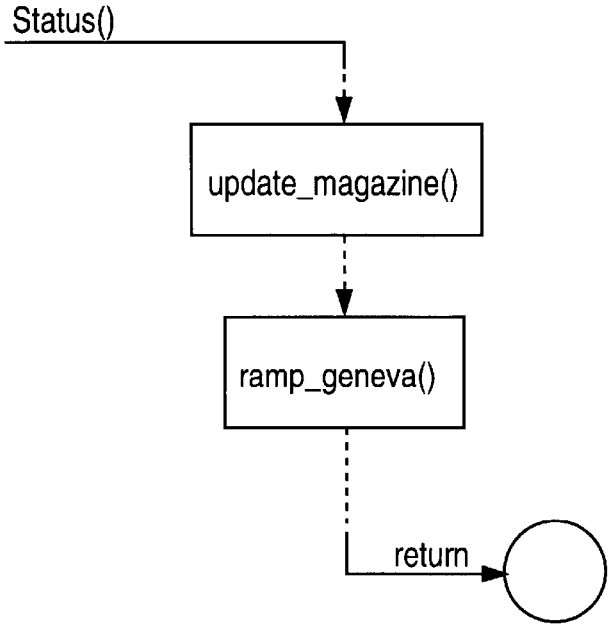

As shown in FIG. 10C, the Status subprogram includes programs entitled update_magazine and ramp_geneva, respectively, as well as other programs that are not shown.

Figures 1, 10D:
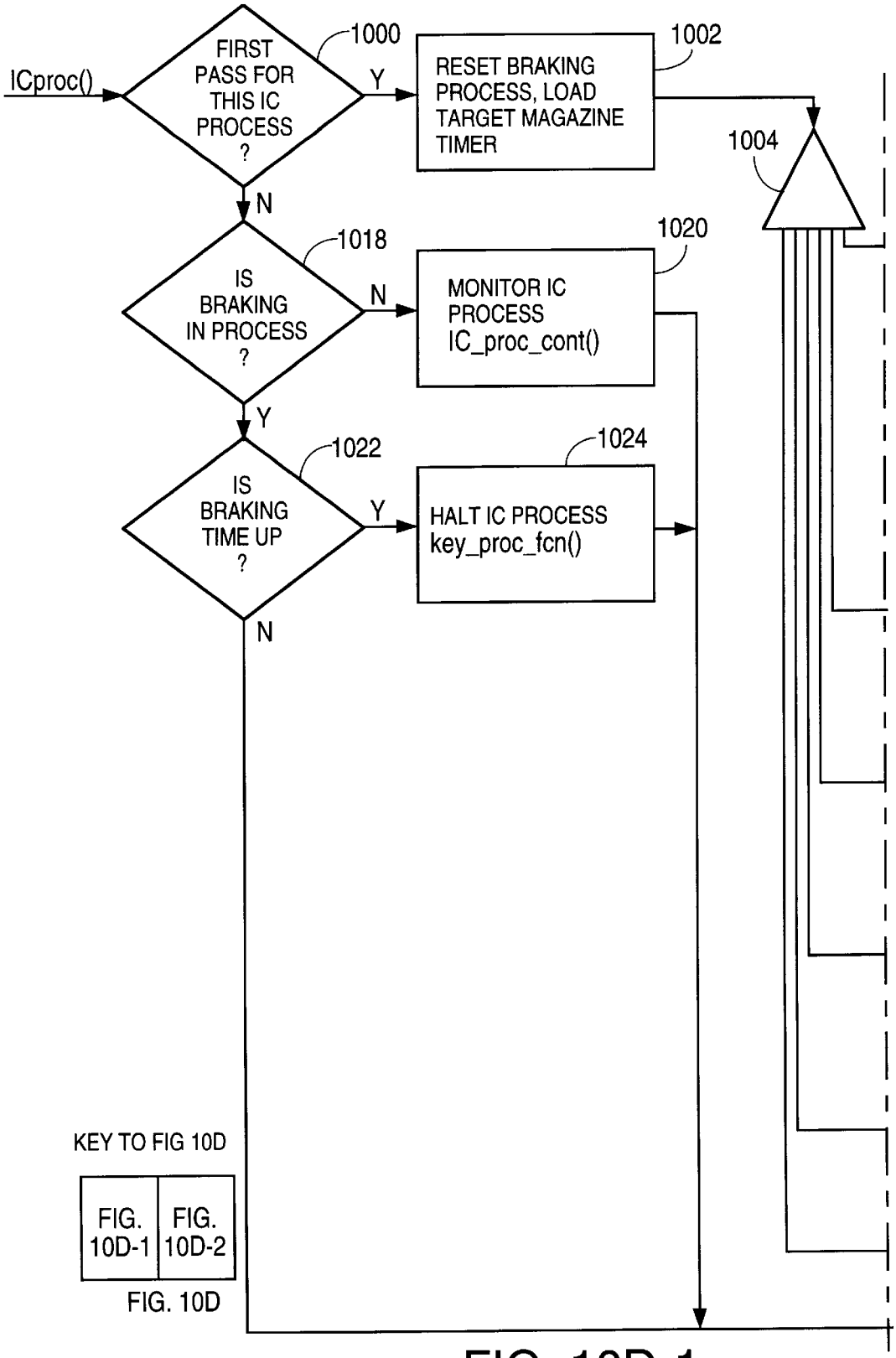
Figures 2, 10D:
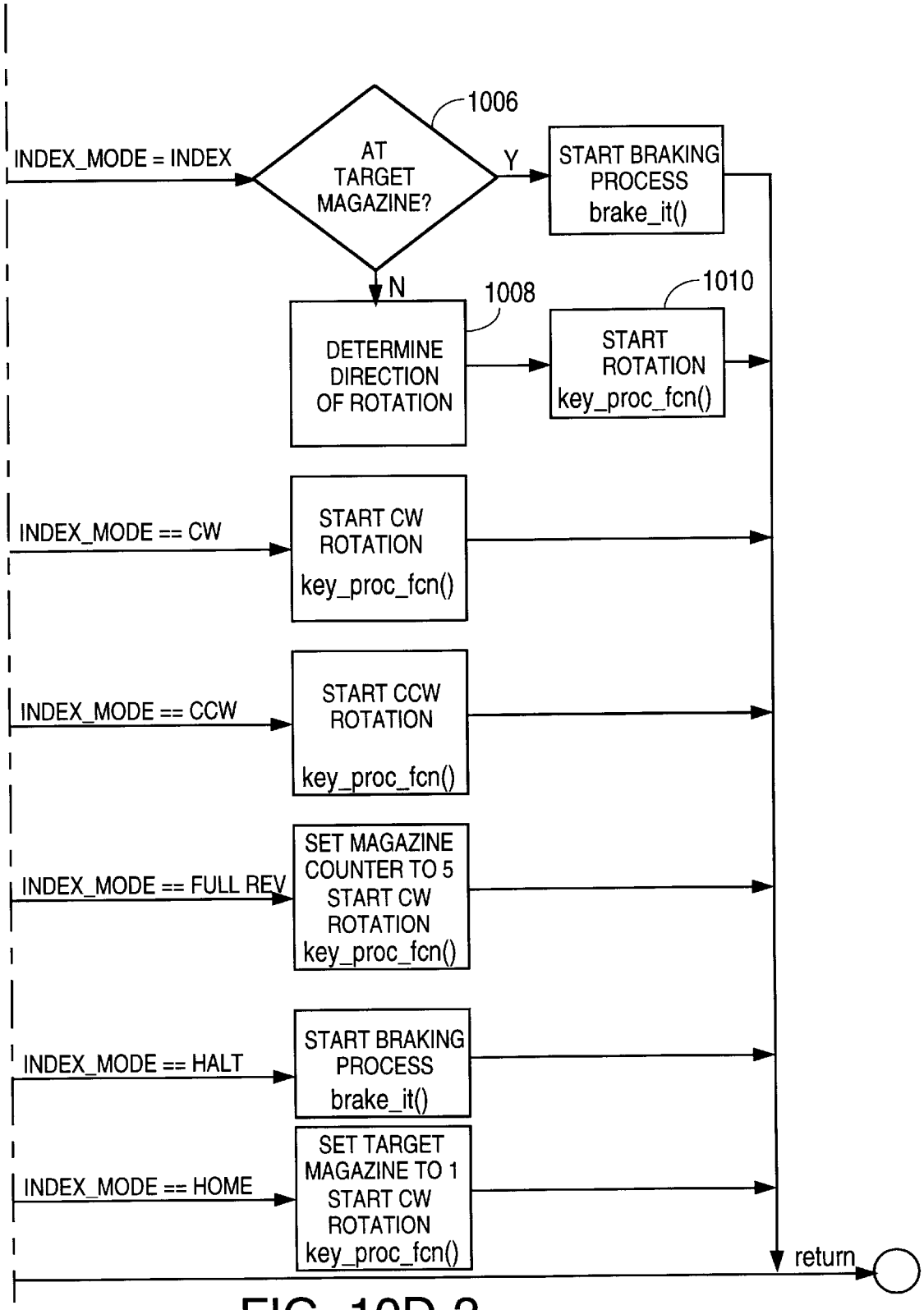

FIG. 10D (including FIGS. 10D—1 and 10D—2) illustrates a flowchart of the IC_proc program. At step 1000, a determination is made whether this is the first pass through this program since the previous instruction to move inventory carousel 201 was given. If the answer is yes, at step 1002 the braking process (described below) is reset and a "target magazine" countdown timer, the function of which is described below, is loaded. At step 1004, the program fans out into a number of "index modes". In normal operation, the index mode designated Index is selected, and at step 1006 a determination is made whether a target magazine 202 is indexed (i.e., positioned at the desired position over food delivery door 204). The indexing of a magazine 202 is identified by a switch which is thrown when a magazine 202 reaches a point just before it is positioned over delivery door 204. If a target magazine 202 is not indexed, the direction of rotation required to reach the target magazine 202 is determined in step 1008 and a program entitled key_proc_fcn is initiated to turn motor 711 on (step 1010).

Figure 7G:
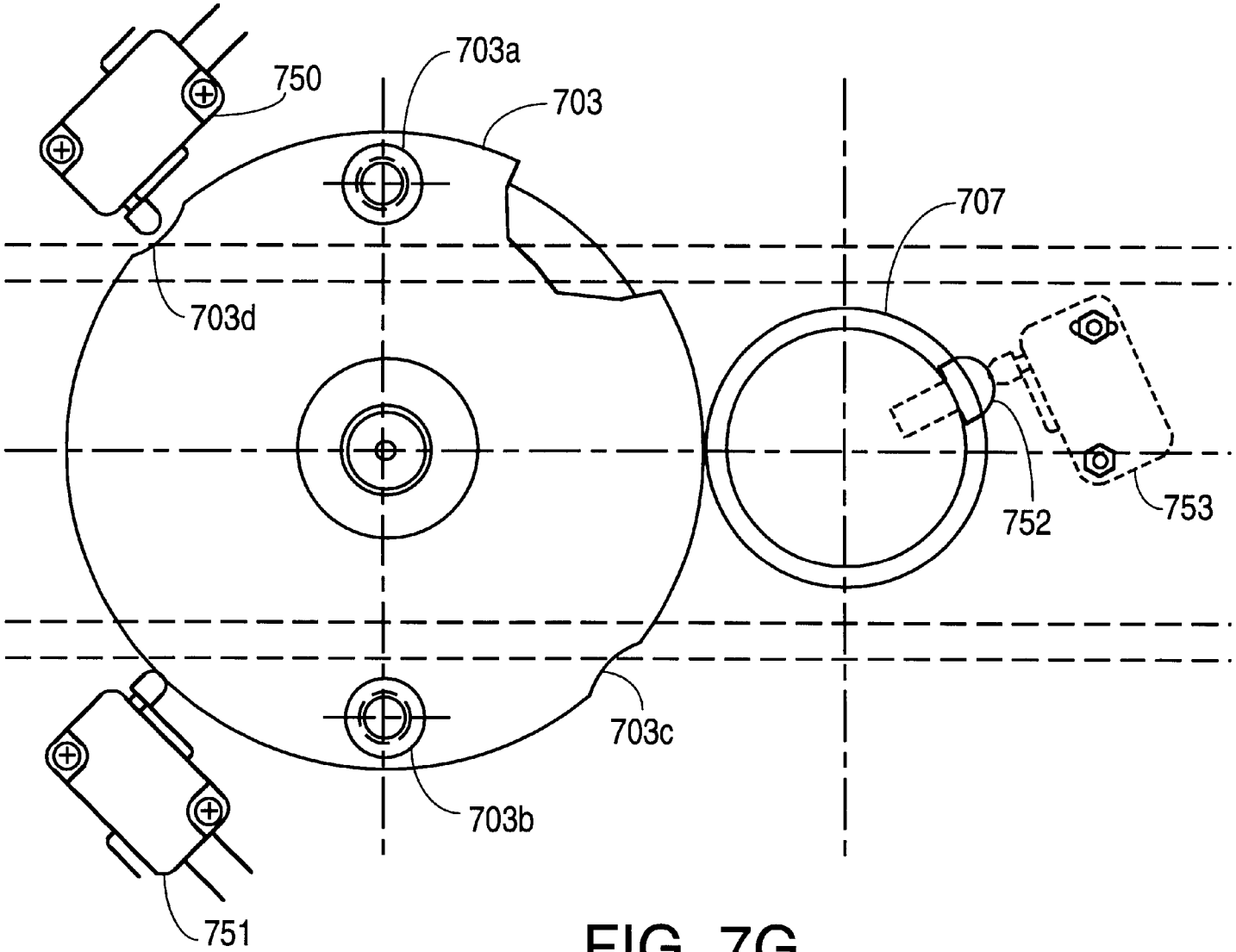
FIG. 7G is a plan view of the disk used to index the inventory magazines of the inventory carousel.

The position of inventory carousel 201 is monitored using switches which are triggered by detents on input disk 703. Since disk 703 rotates 180 degrees between index positions, two switches are used to detect index positions of carousel 201. Similarly, an additional detent and two additional switches are used to sense when carousel is at a midpoint between index positions. The function of the midpoint detection is described below. This structure is illustrated in FIG. 7G, where detents 703*c* and 703*d* are positioned 180 degrees apart on disk 703. A switch 750 detects when carousel 201 is indexed and a switch 751 detects when carousel 201 is at a midpoint between index positions.

A cam on shaft 707 is used to detect when inventory carousel 201 is at the "home" position (i.e., the magazine 202 which has the index #1 is positioned above food delivery door 204). This structure is also shown in FIG. 7G, where shaft 707 has a screw 752 mounted on it, and a switch 753 detects when carousel 201 is at the home position. The microprocessor then keeps track of the position of carousel 201 by counting the indexing of magazines 202 and sensing the direction of rotation of carousel 201. This process is referred to as "orienting" the carousel.

Figure 10E:
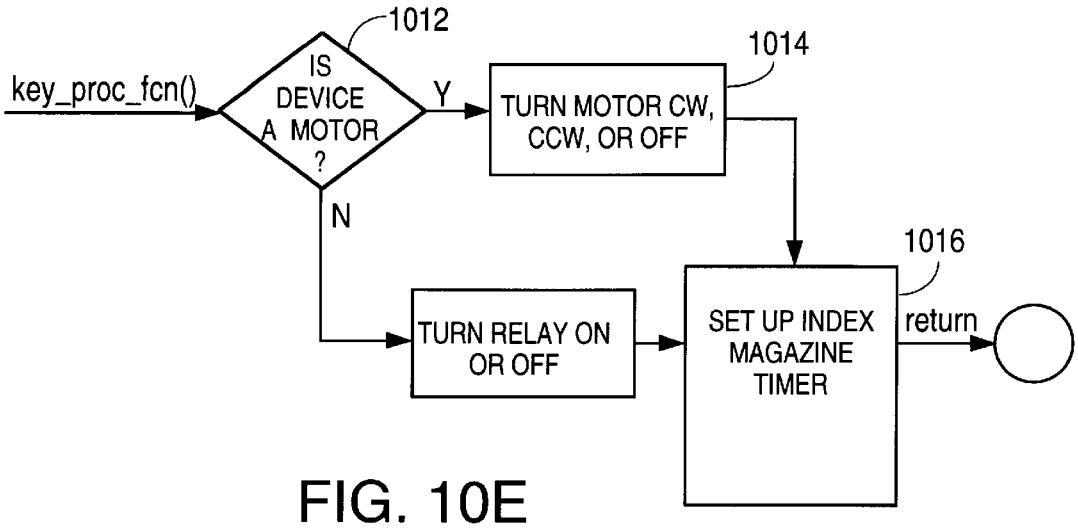

The key_proc_fcn program is illustrated in FIG. 10E. This is a universal program which is operable with various electromechanical devices such as motors and relays. As shown in FIG. 10E, key_proc_fcn first determines whether the device is a motor (step 1012) and, if so, turns the motor on clockwise or counterclockwise or off (step 1014). In this case, the motor is turned on in the direction indicated by step 1008. Then, in step 1016 an "index magazine" countdown timer is set, the function of which is described below.

After starting the motor (step 1010), the microprocessor returns from the IC_proc program. The other index modes are normally used in diagnostic procedures. The index modes entitled CW (clockwise) and CCW (counterclockwise) are used to rotate the carousel in a particular direction. For this purpose, the key proc fcn program is used to start the motor in the appropriate direction. In the index mode entitled Full Rev (full revolution), a magazine counter is set to 5, and the key proc function program is initiated to rotate the carousel until the fifth magazine has passed the delivery point. In the indexed mode entitled Home, the magazine identified by the index #1 (the "Home" magazine) is set as the target magazine and the key_proc_func program is initiated to rotate the carousel.

Figure 10K:
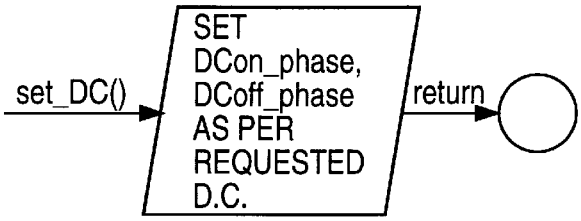
Figure 10G:
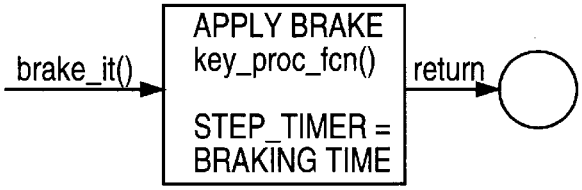
Figures 1, 10F:
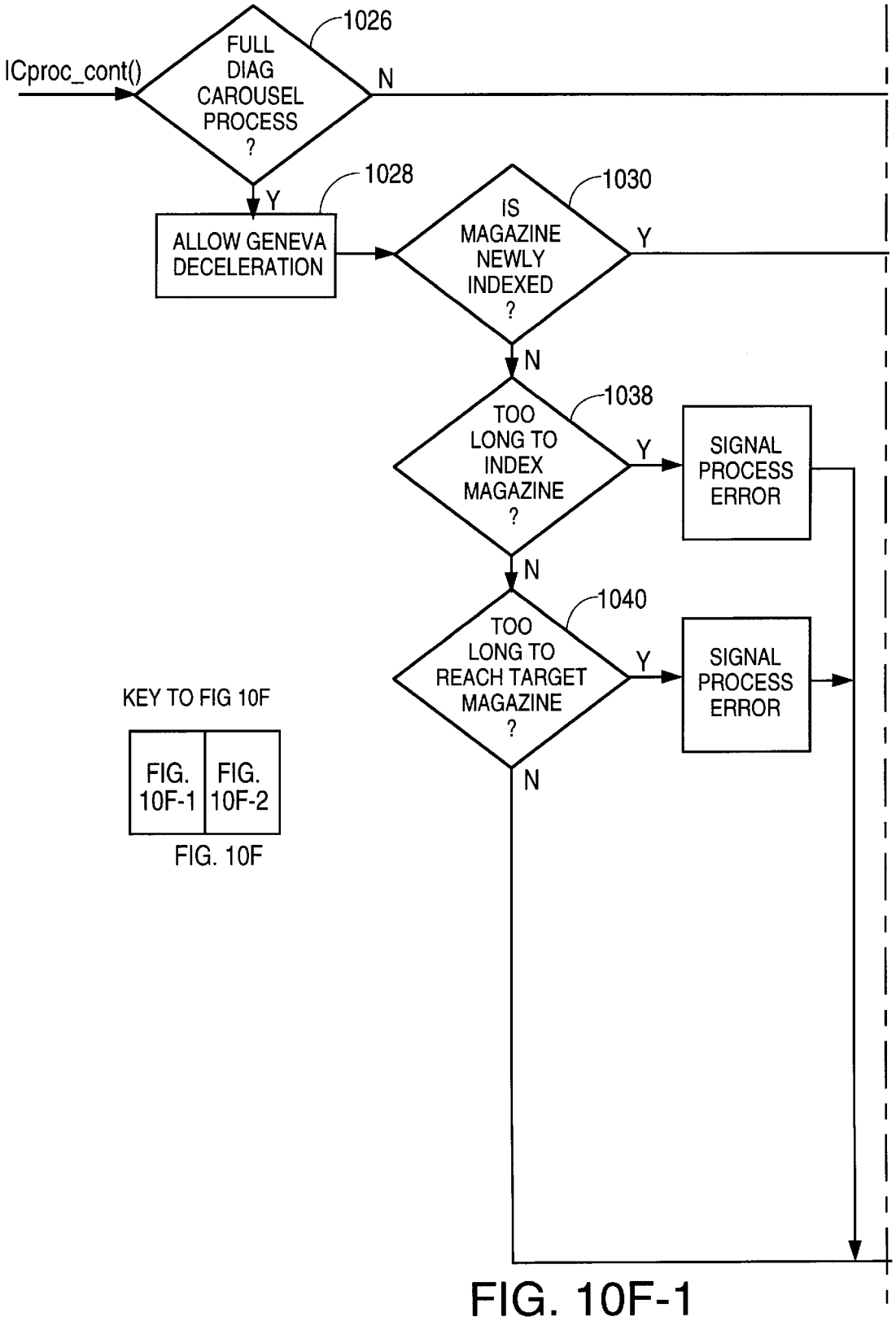
Figures 2, 10F:
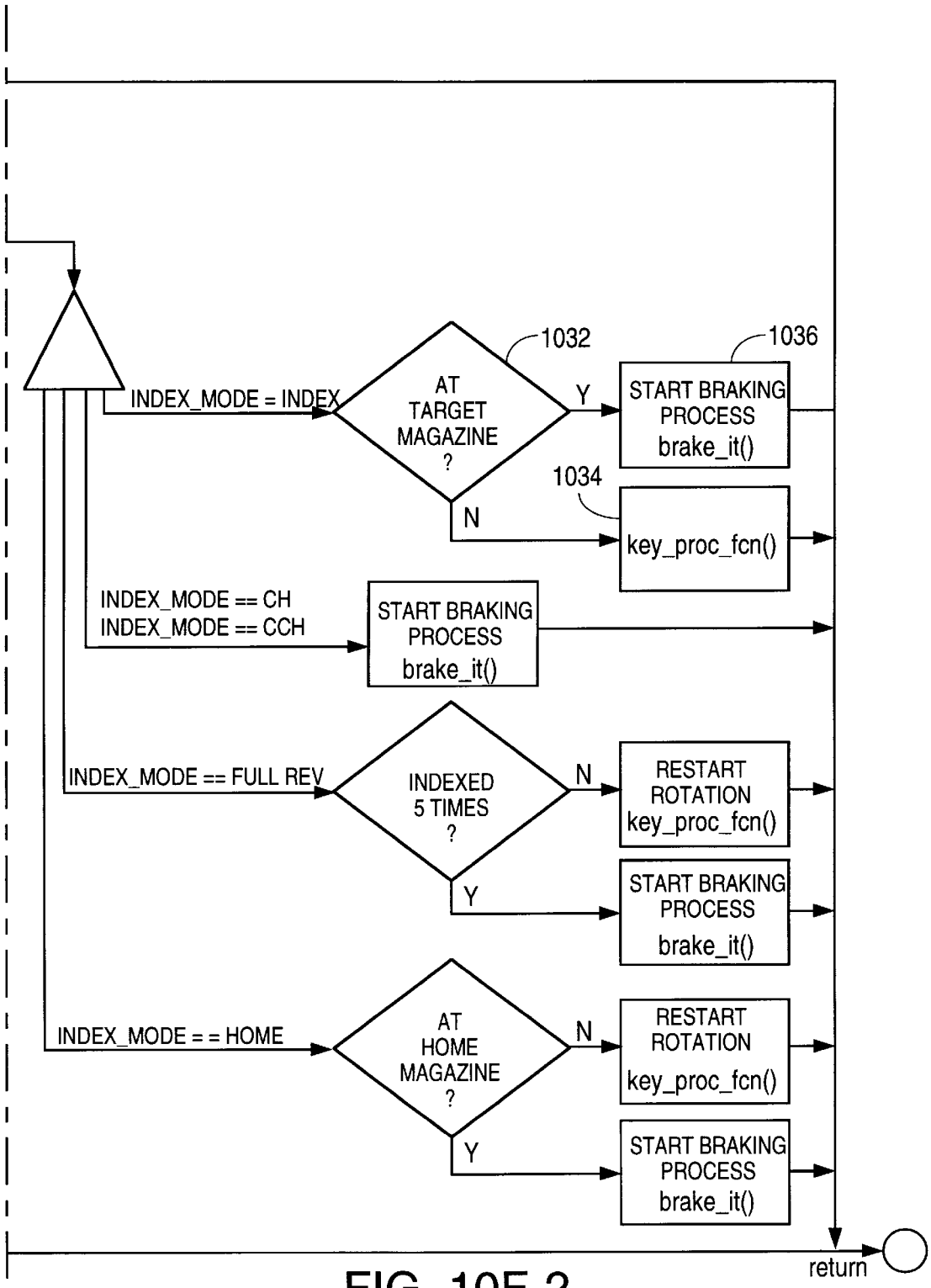

On the next pass through the IC_proc program step 1000 yields a no answer, and at step 1018 it is determined whether braking is in progress. The braking process is described below. If braking is not in progress, the microprocessor proceeds to a program entitled IC_proc_cont (step 1020). If braking is in progress, step 1022 determines whether the braking time is up, and if it is not an exit is made from the IC_proc program If the braking time is up, the key_proc_fcn program is used to turn motor 711 off (step 1024), and then an exit is made from the program The IC_proc_cont program is illustrated in FIG. 10F (including FIGS. 10F—1 and 10F—2). Initially, in step 1026 a determination is made whether inventory carousel 201 is in a "full process" or whether it is operating in a "partial process". Normally, when the carousel is being moved from position to position, it will be operating in a full process. At step 1028, a flag is set to allow the Geneva mechanism to be decelerated, a process which is described below. At step 1030 a determination is made whether a magazine 202 has been newly indexed, in other words, whether a magazine 202 has arrived at the delivery position following the previous path through this program. If so, the program proceeds to a fan out similar to that described in connection with the IC_proc program (FIG. 10D) which includes a number of index modes. As indicated above, the normal index mode is Index. At step 1032 it is determined whether the target magazine 202 is indexed. If not, the key_proc_fcn program is called (step 1034) to reload an "index magazine" countdown timer (step 1016), the function of which is described below, and if so, the brake_it program is entered (step 1036). The brake_it program is illustrated in FIG. 10G, which shows that the key_proc_fcn program is used to apply a brake to carousel 201. This is accomplished by means of a bidirectional motor driver which is used to short the coil of motor 711 and thereby apply a braking force to the rotating carousel 201. Bidirectional motor drivers are well known and available from many sources. Also, during the brake_it program, a timer is set to a constant braking time, determined by the angular momentum of the carousel to ensure that the carousel has reached a stationary condition when the timer reaches 0. In a preferred embodiment, the constant braking time is set at 0.3 sec.

Referring again to FIG. 10F, in the CW or CCW index modes, the brake_it program is started. In the Full Rev index mode, it is determined whether the carousel has passed an index 5 times, and in the Home index mode it is determined whether the carousel has reached the home position. Since each of these actions occurs after a magazine is newly indexed (step 1030), the CW and CCW index modes brake the carousel when the first magazine arrives at the delivery point, the Full Rev index mode brakes the carousel when the fifth magazine has arrived at the delivery point, and Home Index mode stops the carousel when the home magazine (Index #1) has arrived at the delivery point.

If a magazine has not been newly indexed (step 1030), the index magazine timer (reloaded at step 1034) is consulted to determine whether it has taken too long to reach an index magazine (step 1038). Then, the target magazine timer (loaded at step 1002) is consulted to determine whether it has taken too long to reach the target magazine (step 1040). In either event, an error signal is generated.

Referring again to FIGS. 10A–10C, after the microprocessor leaves the IC_proc program, it returns to the Step Processor and proceeds to the Status program. The Status program includes the update_magazine and ramp_geneva programs.

Figures 1, 10H:
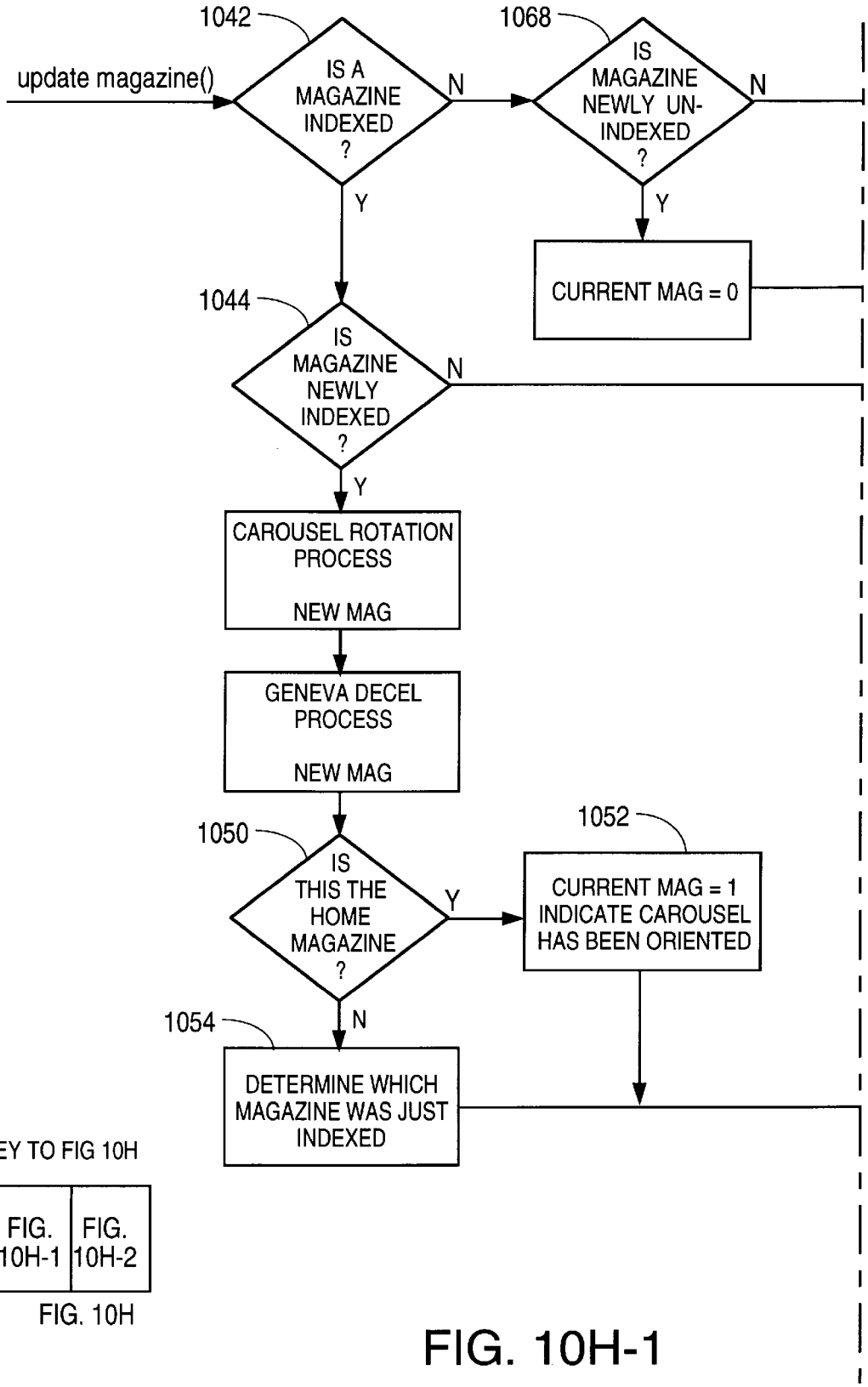
Figures 2, 10H:
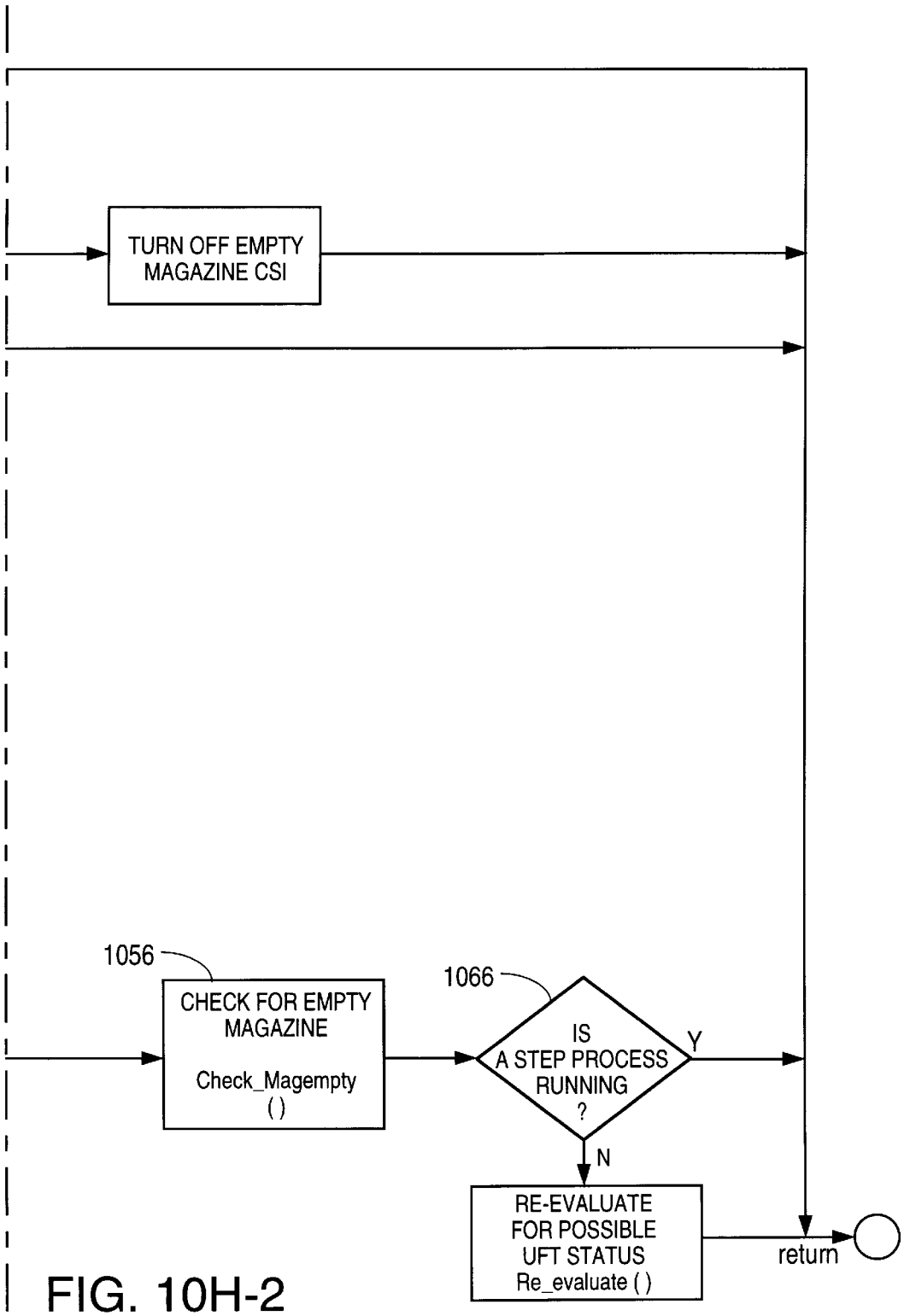
Figure 10I:
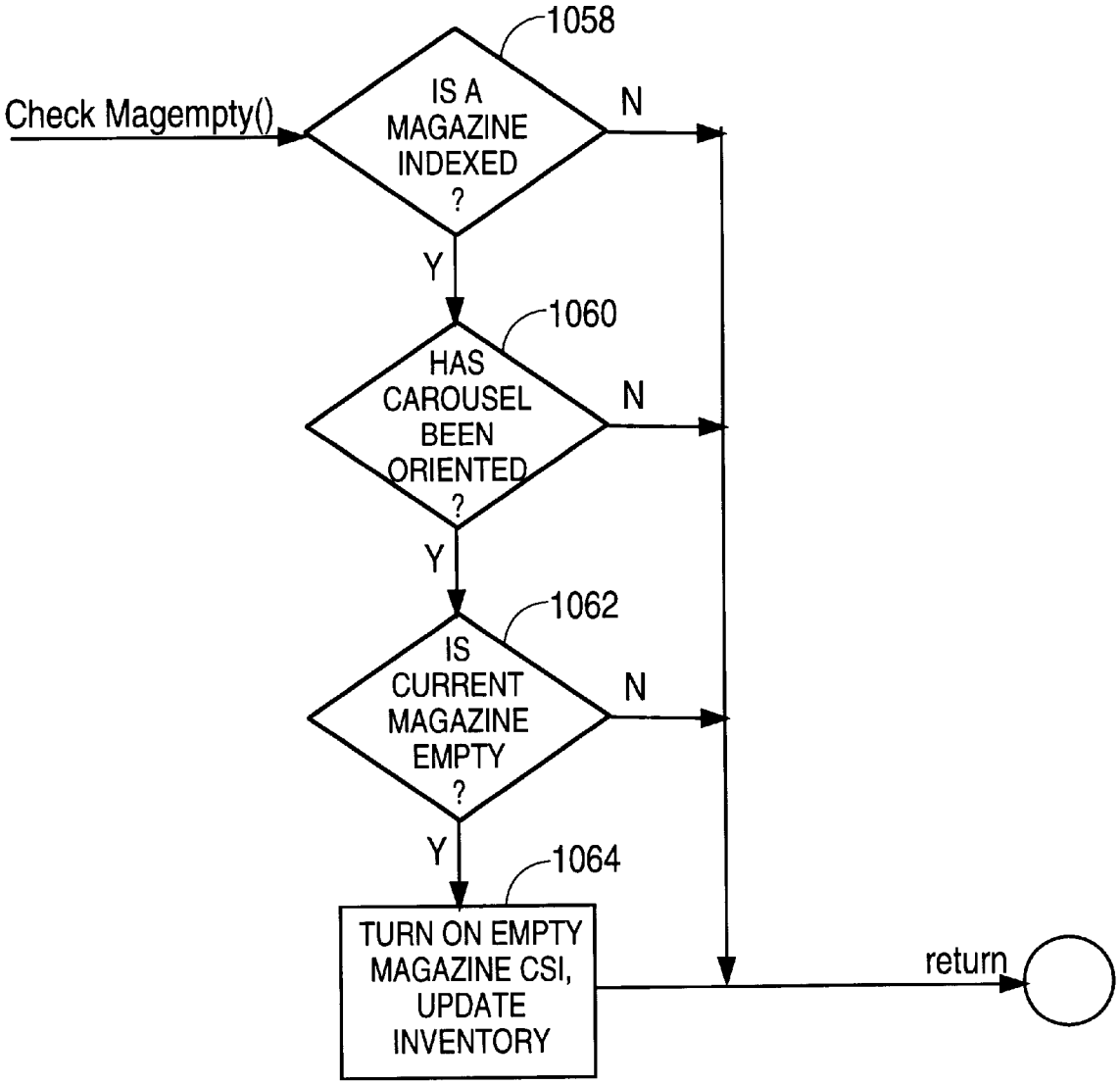
Figures 1, 10J:
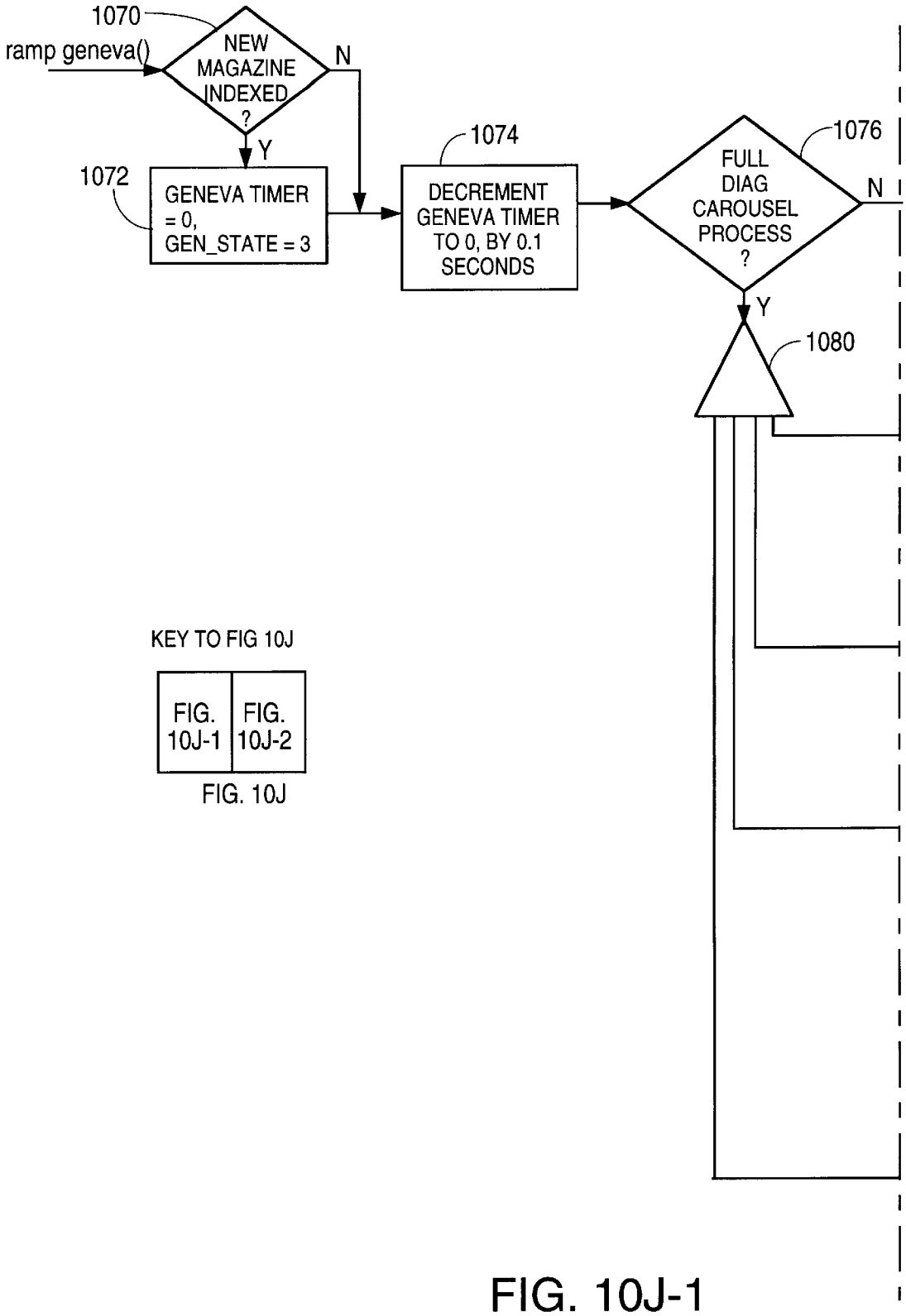
Figures 2, 10J:
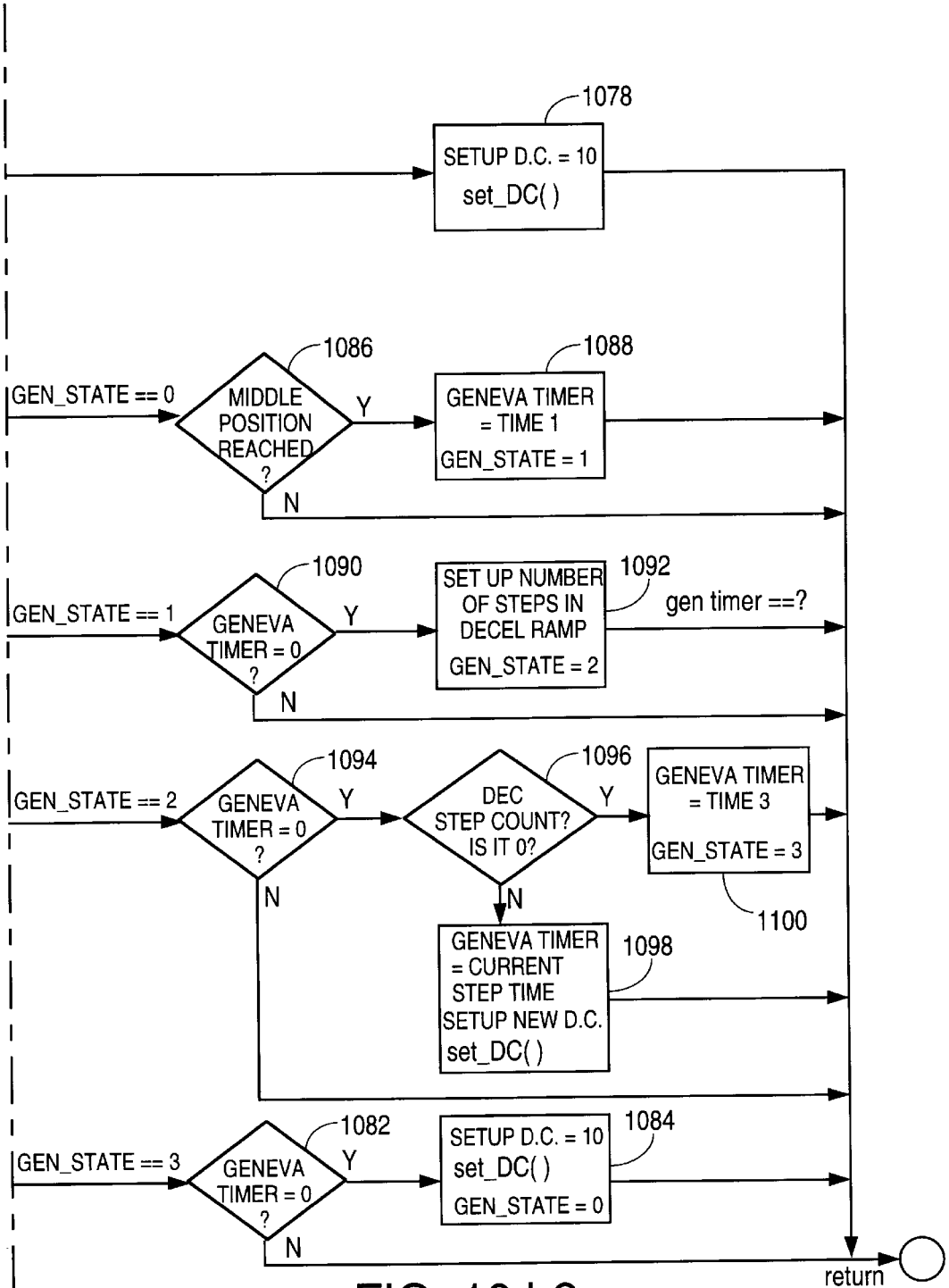
Figure 10L:
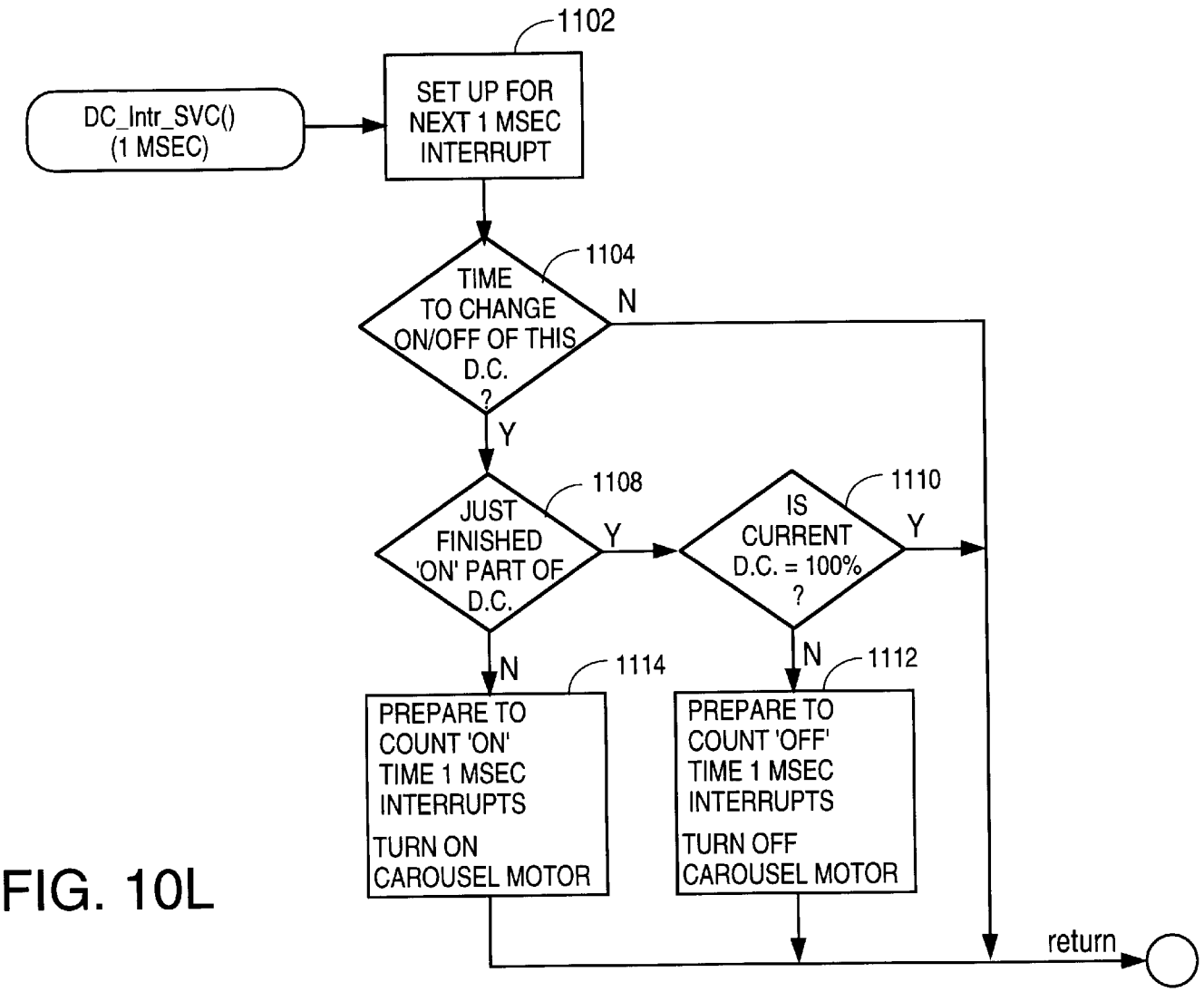

The update_magazine program is illustrated in FIG. 10H (including FIGS. 10H—1 and 10H—2). Step 1042 determines whether a magazine 202 is currently indexed, and if so step 1044 determines whether the magazine 202 is newly indexed (i.e., whether it has become indexed since the last pass through this program). As indicated above, this means in effect that a magazine 202 has just reached the delivery point. If a magazine 202 is newly indexed, a "New Magazine" flag is set in the carousel rotation process (FIG. 10F) and the geneva deceleration process (FIG. 10J). Next, it is determined whether the recently indexed magazine 202 is the home magazine (step 1050), using switch 753 shown in FIG. 7G. If so, the current magazine 202 is indexed as 1 (step 1052); if not, it is determined which magazine 202 has just been indexed (step 1054).

The program then proceeds to the Check_Magempty program (step 1056). This program is illustrated in FIG. 10I. After rechecking whether a magazine 202 is indexed and whether the carousel has been oriented (steps 1058 and 1060) the empty magazine indicator 606 is checked to determine whether the currently indexed magazine is empty (step 1062). If the current magazine is empty, an "Empty Magazine CSI" (component status indicator) light is turned on and the inventory is updated (step 1064). The "Empty Magazine CSI" light is located on the inside of the service door 101 and is used by service personnel to determine when one of magazines 202 is empty without opening the door to refrigeration compartment 213.

Referring again to FIG. 10H, after leaving Check_Magempty the microprocessor determines whether a step process is running (step 1066) and if so the program is exited. If a step process is not running, the Re_evaluate program is entered. The Re_evaluate program checks on a number of mechanical and product conditions and is able to shut the vending machine down in the event of a problem. If a step process us running (i.e., a food product is being processed), it is undesirable to shut the machine down until the process has been completed.

If step 1042 indicates that a magazine 202 is not indexed, a determination is made whether this condition is "new", i.e., whether a magazine 202 was indexed on the last pass through the program (step 1068). If no magazine 202 was indexed on the last pass, the microprocessor proceeds to the end of the program. The same occurs if a no answer is given to step 1044, meaning that the magazine 202 was indexed on the previous pass through the program.

If step 1068 indicates that the magazine 202 is newly unindexed, the current mag is set at 0, meaning that no magazine 202 is indexed, and the "Empty Magazine CSI" light is turned off. Thus the empty magazine indicator, which is turned on at step 1064 (FIG. 101), remains on only while the empty magazine is indexed.

Figure 11:
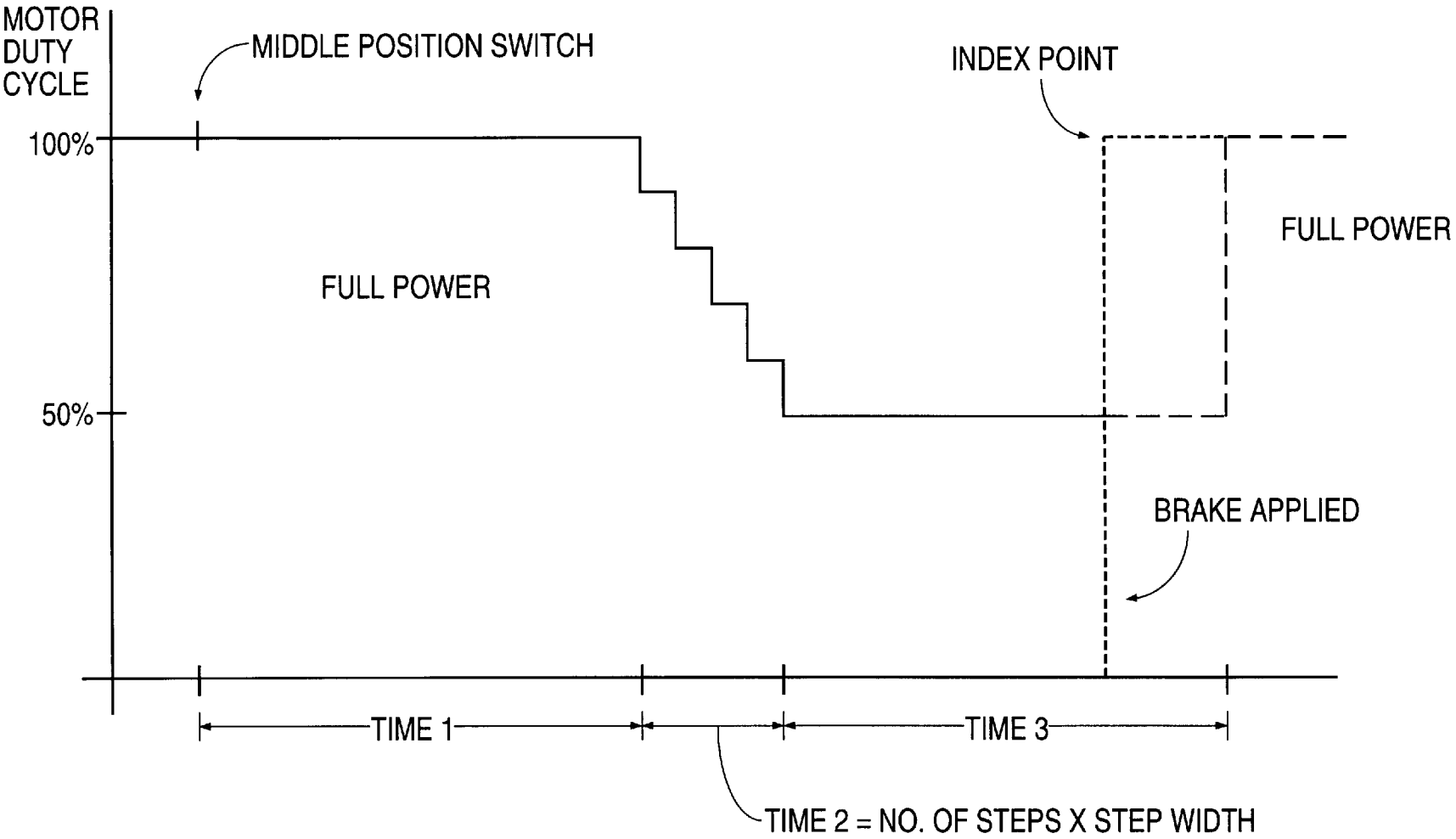
FIG. 11 illustrates the operation of the inventory carousel motor during the ramp_geneva program.

As shown in FIG. 10C, the ramp_geneva program follows the update_magazine program. FIG. 11 illustrates the operation of the motor 711 during the ramp_geneva program. As shown in FIG. 7G, switch 751 senses detents 703*c* and 703*d* on disk 703 and indicates whenever the carousel 201 arrives at a position midway between two magazines 202. When this "middle position" switch is triggered, the motor 711 continues to operate at full power for a duration equal to Time 1. At Time 1, motor 711 begins to ramp down until it reaches a specified percentage of power. This is shown in FIG. 11 as a "duty cycle" percentage, which represents the percentage of the time that a voltage is applied to motor 711. When motor 711 has reached the target duty cycle, it continues at the same reduced level for a Time 3 or until the next magazine 202 is indexed. If the next magazine 202 is the target magazine, braking is applied to carousel 201. Otherwise, motor 711 returns to full power at whichever of the foregoing events occurs first.

This "ramping down" of motor 711 reduces the acceleration forces on carousel 201 and thereby reduces wear on carousel 201 and its associated mechanical devices. With the Geneva mechanism illustrated in FIGS. 7A and 7C–7E, the carousel 201 reaches a zero angular velocity momentarily at each index point (FIGS. 7C and 7E) and a maximum angular velocity at the midpoint between index points (FIG. 7D). Between the midpoint (FIG. 7D) and the following index point (FIG. 7E) the carousel 201 decelerates rapidly and, particularly when carousel 201 is fully loaded with food packages, severe vibrations and wear may occur at the index point (FIG. 7E). To avoid this condition, it has been found advantageous to reduce the power to motor 711 during the second half of the time interval between index points, which is when carousel 201 is decelerating.

This process is performed by the ramp_geneva program, which is illustrated in FIG. 10J including FIGS. 10J—1 and 10J—2). At step 1070 it is determined whether a magazine 202 has been newly indexed. If so, a timer designated Geneva is set to zero and a Gen_State is set to 3. This occurs at step 1072. The Geneva timer is decremented by intervals of 0.1 second. Each time step 1074 is reached, a check is made to find out whether 0.1 second has passed since the last time the Geneva timer was decremented. If so, the Geneva timer is decremented (by 0.1 second); otherwise, the Geneva timer is left at is current setting.

After the program leaves step 1072, since the Geneva timer is already set at zero, nothing occurs at step 1074 during this pass through the program. At step 1076, a determination is made whether a full process is being performed. This is identical to the decision at step 1026 (FIG. 10F). As indicated above, the system is operating at "full process" in normal operation; it generally operates at partial process when a diagnostic or test function is being performed. If motor 711 is not operating at full process, the duty cycle is set at 100% in step 1078. This is performed in a program designated set_DC, which is illustrated in FIG. 10K. The set_DC program essentially applies the input voltage to motor 711 during a specified percentage of the time. This is accomplished using the EC_Intr_SVC program shown in FIG. 10L. (Note that in step 1078 and the remainder of FIG. 10J, the numeral "10" is used to indicate a 100% duty cycle.)

If the system is operating in a full process, the program passes through a fanout 1080 to one of several GEN_States. Since GEN_State 3 was set at step 1072, the program passes to GEN_State 3. Since the Geneva timer is set at zero (step 1072), the microprocessor passes through step 1082 to step 1084 where, using the set_DC program, the duty cycle of motor 711 is set at 100%. In addition, the GEN_State is set to zero.

On the next pass through the ramp_geneva program, step 1072 is bypassed (since the magazine 202 is not newly indexed), and the microprocessor proceeds through step 1076 to GEN_State 0. At step 1086 the microprocessor determines whether the middle position switch has been activated. If not, it exits the ramp_geneva program. Since the GEN_State has not been reset, the microprocessor continues to cycle through the ramp_geneva program on this path until it receives an indication that the middle position limit switch has been thrown. When this occurs, the microprocessor passes from step 1086 to step 1088. In step 1088, the Geneva timer is set to Time 1 which, as shown in FIG. 11, is the time from the middle position indication to the beginning of the ramp down. Also, in step 1088 the GEN_State is set to 1.

On the next pass through the ramp_geneva program, the Geneva timer is decremented to a time equal to Time 1 minus 0.1 seconds in step 1074, and the microprocessor proceeds to GEN_State 1 again. It continues to cycle through GEN_State 1 until at step 1090 it is determined that the Geneva timer equals zero.

When the Geneva timer is zero, the microprocessor proceeds from step 1090 to step 1092 where the number of steps in the deceleration ramp is set and the GEN_State is set to 2.

On the next pass through the program, GEN_State 2 is selected and at step 1094, since the Geneva timer remains at zero, the microprocessor proceeds to step 1096. In step 1096, the number of steps in the deceleration ramp (set at step 1092) is decremented by 1 and, unless the result is zero, the microprocessor proceeds to step 1098. At step 1098 the Geneva timer is set to the desired width of a single deceleration step, and the duty cycle of the motor is adjusted downward to a desired level. In the preferred embodiment, the duty cycle begins at 100% and is adjusted downward in intervals of 10%, so that after the first adjustment the duty cycle is 90%. In making this adjustment, the set_DC program (FIG. 10K) is used to adjust the on and off times appropriately.

With the Geneva timer set at the desired step time, it is decremented by 0.1 second intervals until it reaches zero. Until the Geneva timer again reaches zero, the microprocessor exits the program from step 1094, and thus motor 711 continues to operate at the adjusted duty cycle. When the Geneva timer has reached zero, the microprocessor again enters step 1096 where the step count is decremented, and step 1098 where the Geneva timer is again set to the step time and the duty cycle is adjusted. The duty cycle then remains the same until the Geneva timer again reaches zero.

When the step count has been decremented to zero at step 1096, the microprocessor enters step 1100. At step 1100, the Geneva timer is set to a time equal to Time 3 and the GEN_State is set to 3. On the next pass through the ramp_geneva program, GEN_State 3 is selected, and until the Geneva timer has reached zero, the microprocessor continues to exit the program from step 1082. When Time 3 has elapsed, the microprocessor passes from step 1082 to 1084, where the duty cycle is again set at 100%.

As noted above, the process performed -by the ramp_geneva program (illustrated in FIG. 11) occurs during each interval between index points, and it is triggered by the operation of the middle position switch. If the next magazine 202 is the target magazine, the braking process will start at step 1036 (FIG. 10F) before Time 3 has elapsed. This is illustrated in FIG. 11. Thus, as the target magazine is approached, the resetting of the duty cycle to 100% (step 1084 in FIG. 10J) is superseded by the application of the braking process, and the carousel comes to a halt with the target magazine positioned at the delivery point over delivery door 204.

There are numerous alternative ways of setting the duty cycle of the Geneva drive motor. The method used in the preferred embodiment is the DC_Intr_SVC program illustrated in FIG. 10L. The DC_Intr_SVC program is an interrupt which occurs at intervals of 1 msec. Initially the program sets the next interrupt in step 1102. The microprocessor then determines whether it is time to switch the motor on or off (step 1104). If not, the microprocessor exits the program. If it is time to switch the motor on or off, the microprocessor proceeds to step 1108. Here it is determined whether the "on" part of a duty cycle has just been completed. If so, the microprocessor asks whether the duty cycle is 100% (step 1110), an affirmative answer to which indicates that the motor should remain on. If the answer to step 1110 is no, the microprocessor turns the carousel motor off and prepares to count a specified number of interrupts until the motor should be turned on again (step 1112).

If the answer to step 1108 is no, meaning that the motor is to be turned off, the microprocessor proceeds to step 1114 where it turns the motor off and prepares to count a number of interrupts equivalent to the on time of the motor.

Figure 12A:
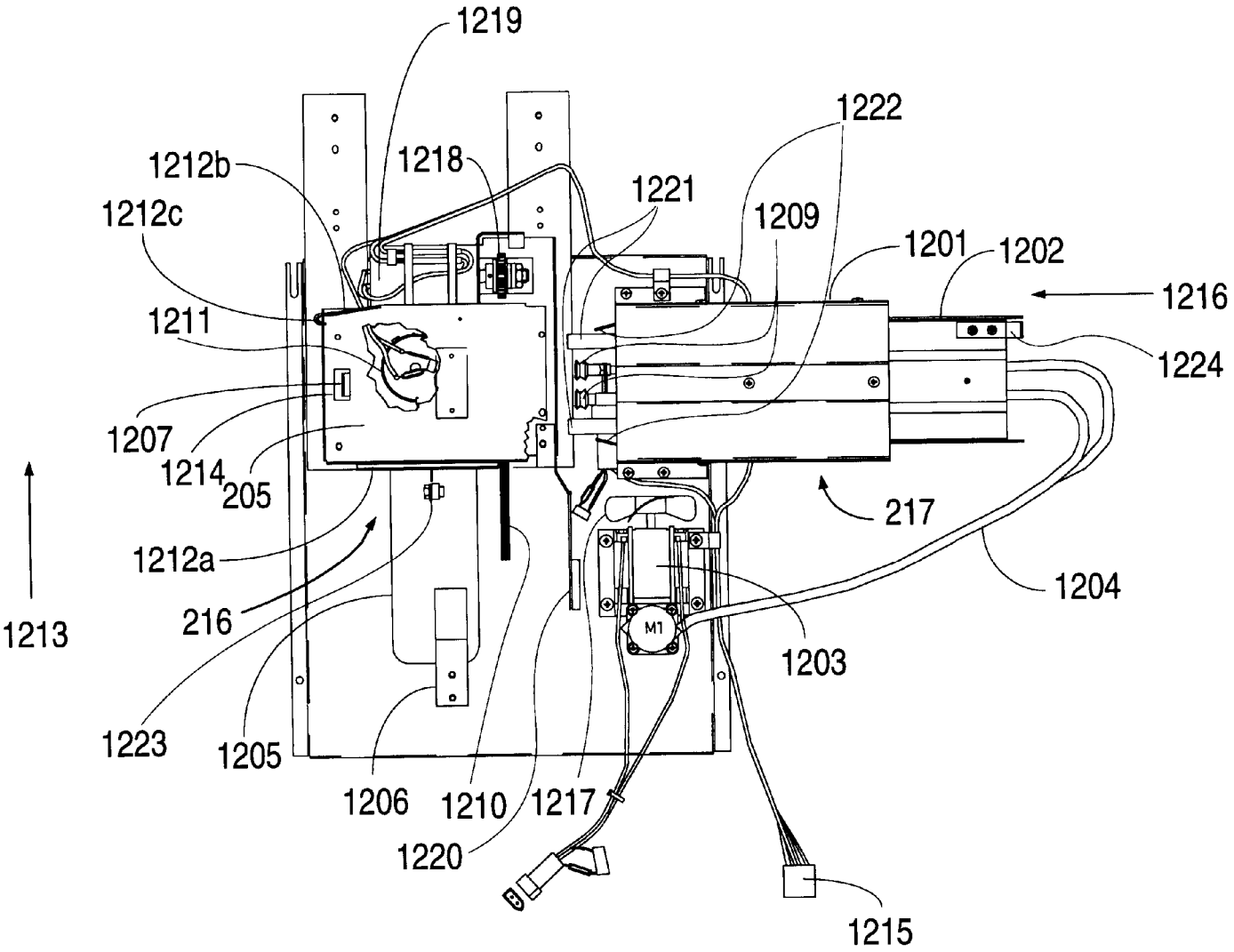
FIG. 12A is a plan view of a delivery tray and transfer mechanisms of the vending machine of FIG. 1.

FIG. 12A is a plan view of delivery tray 205 and transfer mechanism 216 and sleeve/de-sleeve mechanism 217. Delivery tray 205 includes rails 1212*a* and 1212*b* formed on opposite sides of delivery tray 205 and extending above delivery tray 205 in a direction perpendicular to the plane of FIG. 12A. Rails 1212*a* and 1212*b* help keep the packaged food product from slipping off of delivery tray 205. Rail 1212*a* is attached by a spring hinge 1233 (FIGS. 12E and 12G) in the upright position shown in FIG. 12A, so that the packaged food product can be released from delivery tray 205, as explained in more detail below.

Figure 12B:
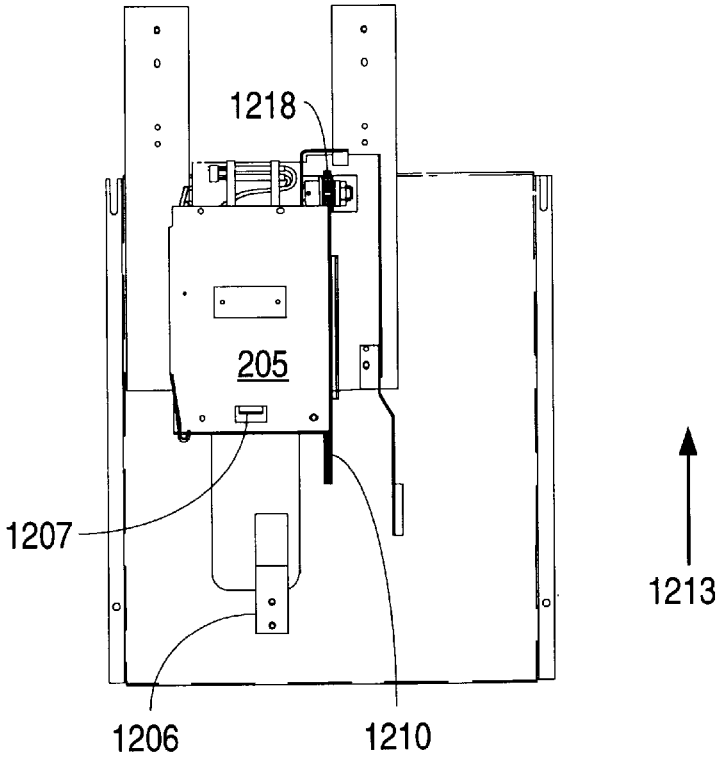
FIGS. 12B and 12C are a plan view and simplified side view, respectively, of the delivery tray and associated transfer mechanism of FIG. 12A when the delivery tray is in a first position for accepting a packaged food product from an inventory magazine.
Figure 12C:
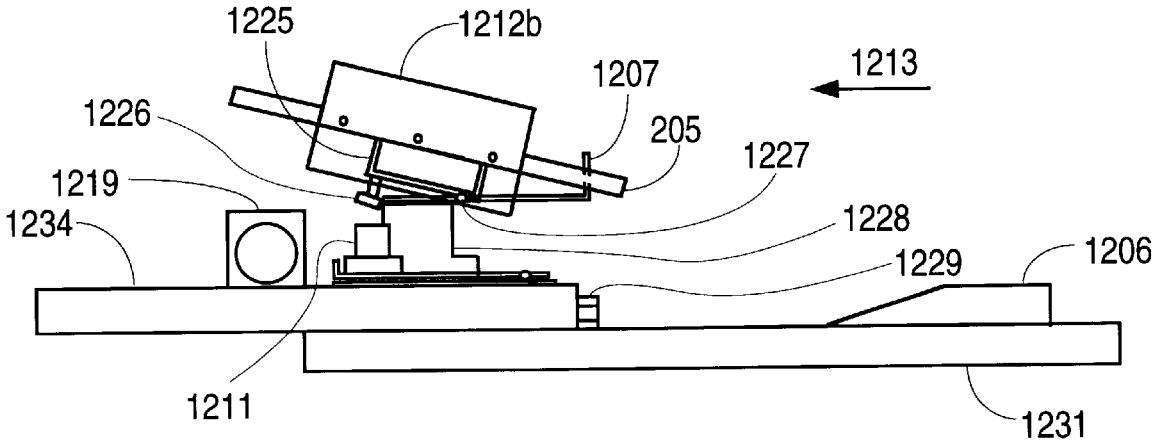

FIGS. 12B and 12C are a plan view and simplified side view, respectively, of delivery tray 205 and associated transfer mechanism 216 when delivery tray 205 is in a first position for accepting a packaged food product from an inventory magazine 202. In the first position, delivery tray 205 is tilted so that the edge of delivery tray 205 nearest delivery chute 103 (FIG. 1) is lower than the opposite edge of delivery tray 205. In one embodiment, delivery tray 205 is tilted so that delivery tray 205 makes an angle of 210 with a horizontal plane. Larger angles are desirable if compatible with vertical height constraints on tilting delivery tray 205. Delivery tray 205 is tilted in this manner to accommodate the orientation of the packaged food product as the packaged food product drops from refrigeration compartment 213 on to delivery tray 205. Food delivery door 204 opens in the direction of arrow 1213, i.e., away from delivery chute 103. As food delivery door 204 opens, the end of the packaged food product nearest delivery chute 103 begins to fall through the opening created by the opening food delivery door 204, thereby resulting in tilting of the packaged food product. When food delivery door 204 fully opens, the packaged food product falls on to delivery tray 205 in approximately the same orientation as that of delivery tray 205 when in the first position.

Delivery tray 205 is formed with a rectangular hole 1214 under which a stop 1207 is positioned. When delivery tray 205 is tilted down in the first position, stop 1207 extends through hole 1214. Consequently, stop 1207 prevents the packaged food product from sliding off of the tilted delivery tray 205.

Delivery tray 205 is attached to a bracket 1225 which is, in turn, attached by a hinge 1227 to a support block 1228. A shaft 1250 on which tray 205 is mounted extends vertically through support block 1228. A tilt roller 1226 extends from bracket 1225. As explained in more detail below, interaction of tilt roller 1226 with bracket 1225 causes delivery tray 205 to move from the tilted position shown in FIG. 12C to a level position shown in FIG. 12E when delivery tray 205 is rotated.

After the packaged food product is on delivery tray 205, delivery tray translation motor 1219 moves delivery tray 205 a short distance away from delivery chute 103, then back to the position at which the packaged food product dropped on to delivery tray 205. This is done to ensure the packaged food product drops entirely out of food delivery door 204 on to delivery tray 205.

Figure 12D:
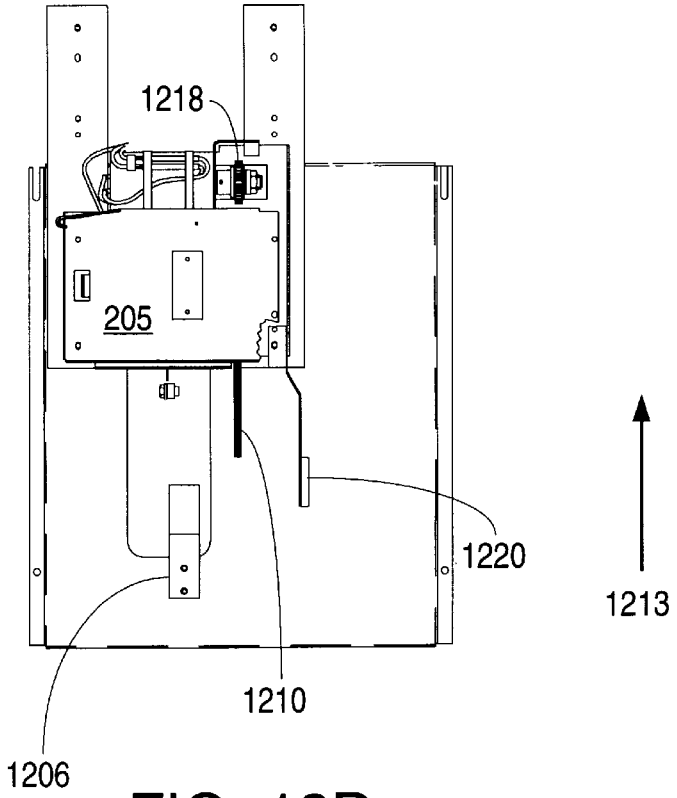
FIGS. 12D and 12E are a plan view and simplified side view, respectively, of the delivery tray and associated transfer mechanism of FIG. 12A when the delivery tray is in a second position for transferring a packaged food product into and out of the oven of FIG. 3.
Figure 12E:
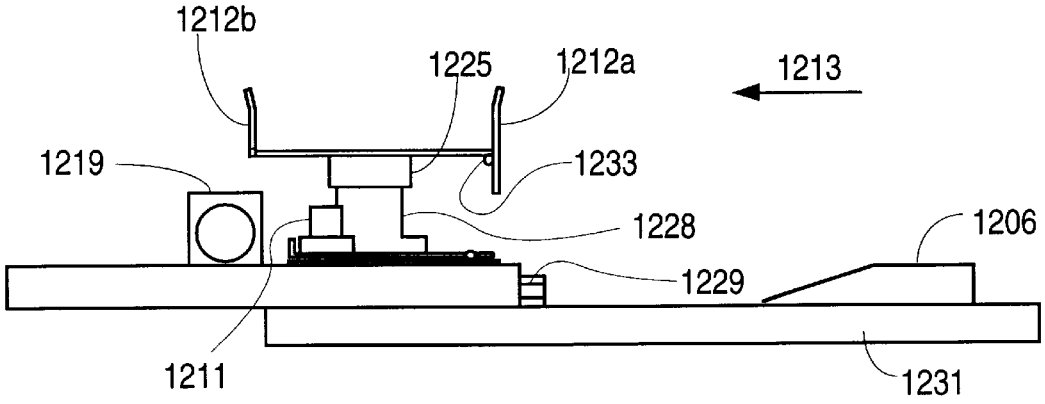

FIGS. 12D and 12E are a plan view and simplified side view, respectively, of delivery tray 205 and associated transfer mechanism 216 when delivery tray 205 is in a second position for transferring a packaged food product into and out of oven 210 (FIG. 2). Control board 208 activates a delivery tray rotation motor 1211 that drives a set of gears 1237*a* and 1237*b* (visible in FIG. 12G) to rotate delivery tray 205 to the second position. Gear 1237*a* is attached to the shaft on which delivery tray 205 is mounted; gear 1237*b* is driven by delivery tray rotation motor 1211. As delivery tray 205 rotates, delivery tray 205 is tilted back so that delivery tray 205 becomes approximately level. Control board 208 de-activates the delivery tray rotation motor 1211 after a pre-set time interval. The time interval is selected to be sufficiently long to ensure that delivery tray 205 continues rotating until delivery tray 205 hits a mechanical stop that, combined with a slip clutch on delivery tray rotation motor 1211, stops delivery tray 205 in the second position for loading the packaged food product from delivery tray 205 into oven 210. In this embodiment, the second position is oriented approximately 90° from the first position.

Figure 12F:
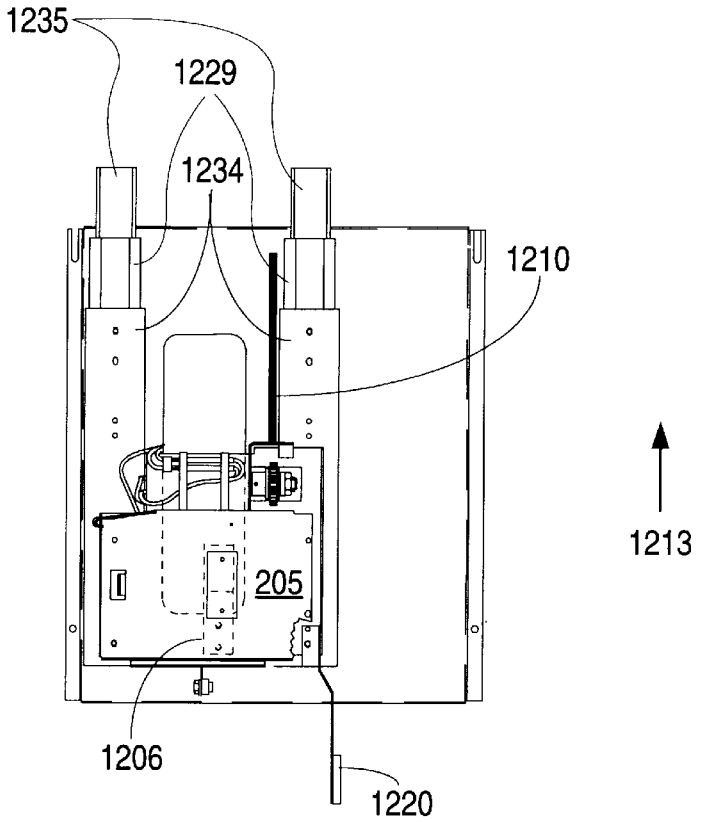
FIGS. 12F and 12G are a plan view and simplified side view, respectively, of the delivery tray and associated transfer mechanism of FIG. 12A when the delivery tray is in a third position for discharging a packaged food product from the delivery tray into a delivery chute.
Figure 12G:
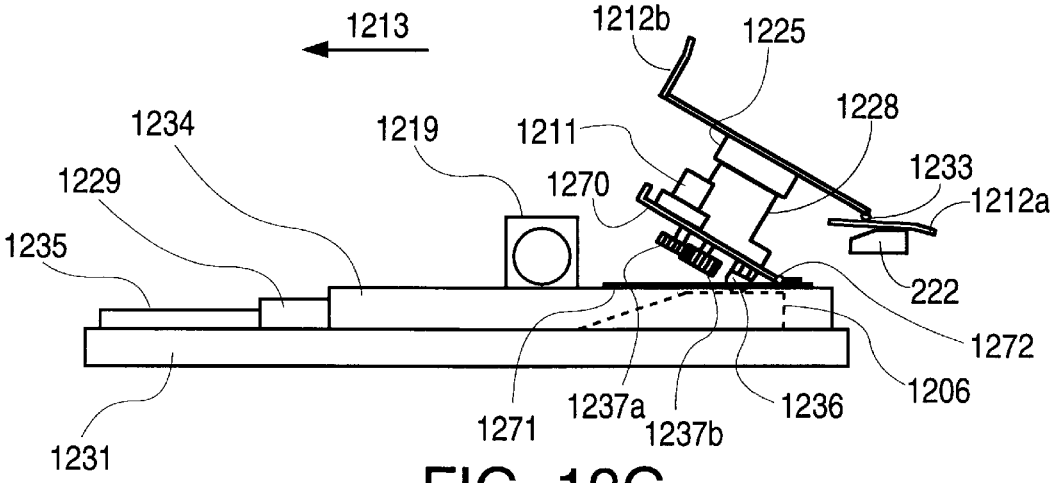
Figure 12H:
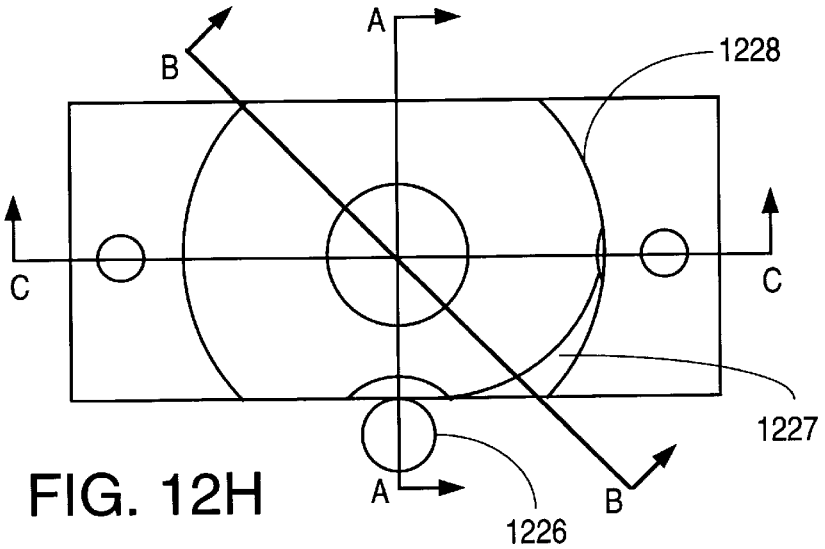
FIG. 12H is a simplified top cross-sectional view of the shaft upon which the delivery tray is mounted and which rotates the delivery tray, illustrating interaction between a tilt knob and the shaft when the delivery tray is in the second position of FIGS. 12D and 12E.
Figure 12I:
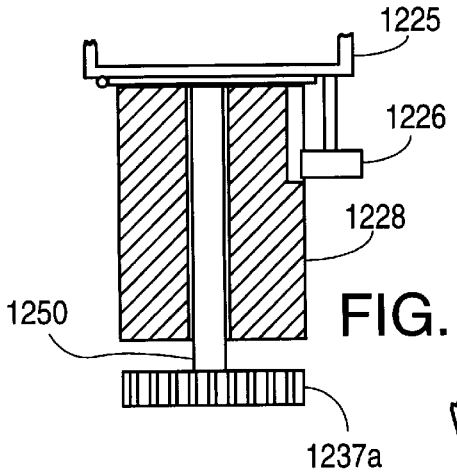
FIG. 12I is a side cross-sectional view of the shaft of FIG. 12H when the delivery tray is in the second position of FIGS. 12D and 12E.
Figure 12J:
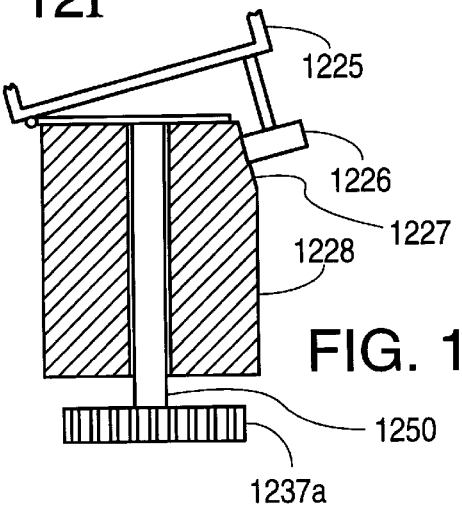
FIG. 12J is a side cross-sectional view of the shaft of FIG. 12H when the delivery tray is in a position intermediate between the first and second positions.
Figure 12K:
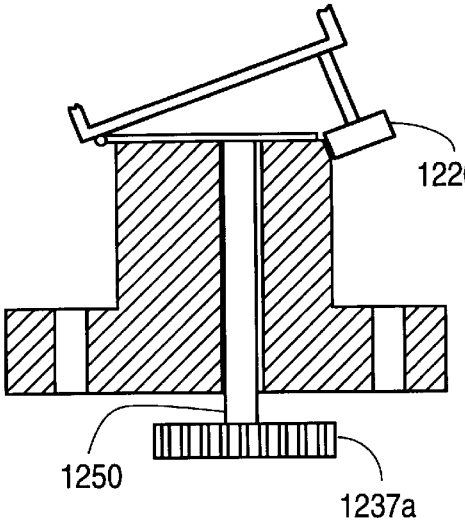
FIG. 12K is a side cross-sectional view of the shaft of FIG. 12H when the delivery tray is in the first position of FIGS. 12B and 12C.

FIGS. 12H through 12K illustrate the mechanism for tilting delivery tray 205 as a result of rotation of delivery tray 205. FIG. 12H is a simplified top view of support block 1228 upon which delivery tray 205 is mounted, illustrating interaction between tilt roller 1226 and support block 1228 when delivery tray 205 is in the second (level) position of FIGS. 12D and 12E. FIG. 12I is a side cross-sectional view, taken along section line A—A of FIG. 12H, when delivery tray 205 is in the second (level) position of FIGS. 12D and 12E. As shaft 1250 begins to rotate, tilt roller 1226 begins to move along a cam surface 1227 of support block 1228, tilting so that delivery tray 205 also tilts. FIG. 12J is a side cross-sectional view, taken along section line B—B of FIG. 12H, when delivery tray 205 is in a position intermediate between the first and second positions. Finally, when shaft 1250 rotates so that delivery tray 205 is in the first (tilted) position, contact between tilt roller 1226 and cam surface 1227 causes delivery tray 205 to reach a maximum tilt. FIG. 12K is a side cross-sectional view, taken along section line C—C of FIG. 12H when delivery tray 205 is in the first position of FIGS. 12B and 12C. When delivery tray 205 is rotated back to the second (level) position (FIGS. 12D and 12E), interaction between tilt knob 1226 and cam surface 1227*a* of shaft 1227 causes delivery tray to level out once more.

When delivery tray 205 is in the second (level) position, control board 208 activates oven door motor 312 (FIG. 3) that opens oven door 301. An oven door monitor switch, the operation of which is described in more detail below, indicates whether oven door 301 is fully open. If the oven door monitor switch is not activated within a specified time after control board 208 begins opening oven door 301, then operation of vending machine 100 ceases. Otherwise, when the oven door monitor switch indicates that oven door 301 is fully open, control board 208 de-activates the oven door motor 312.

Control board 208 then activates transfer mechanism motor 315 to drive sleeve/de-sleeve mechanism 217 that pushes the food tray out of the package sleeve, through oven door 301 and into oven 210. As seen in FIG. 12A, the sleeve/de-sleeve mechanism 217 includes a stationary guide rail 1201, a ram 1202, suction cups 1209 and a vacuum pump 1203.

Figure 12L:
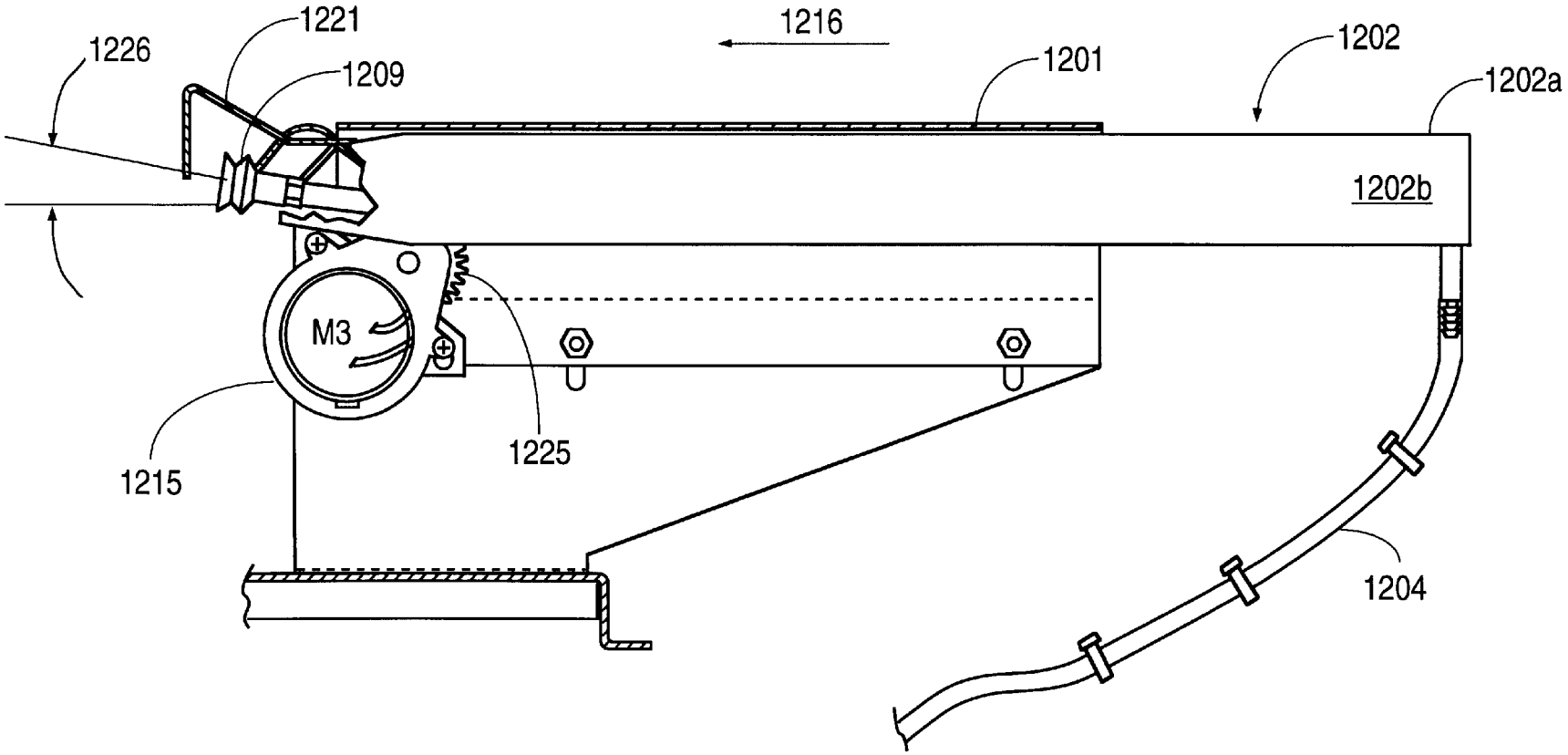
FIG. 12L is a side cross-sectional view of the sleeve/de-sleeve mechanism of the vending machine of FIG. 1.

FIG. 12L is a side cross-sectional view of sleeve/de-sleeve mechanism 217 of vending machine 100. Viewed in a direction parallel to arrow 1216, ram 1202 has an inverted U-shaped cross-section. A rack (not shown) is attached to wall 1202*a* of ram 1202 behind wall 1202*b* of ram 1202. A package sleeve/de-sleeve motor 1215 drives pinion 1225 which moves the rack, thereby moving ram 1216 in the direction of arrow 1216 through stationary guide rail 1201, i.e., toward oven 210. Suction cups 1209 contact the food tray within the package sleeve and push the food tray out of delivery tray 205 and into oven 210. Suction cups 1209 are oriented at an angle 1226 with respect to a horizontal plane so that suction cups 1209 make flush contact with side 902*a* of food tray 902 (FIG. 9A). A hook 1212*c* formed at an end of rail 1212*b* catches an edge of the package sleeve and holds the package sleeve in position on delivery tray 205. During this de-sleeving operation, vacuum pump 1203 is not activated.

Control board 208 de-activates sleeve/de-sleeve motor 1215 after a pre-set time interval. The time interval is specified so that sleeve/de-sleeve motor 1215 will be activated for a sufficient length of time to ensure that the packaged food product is fully inserted into oven 210. A mechanical stop 1224 (FIG. 12A), combined with a slip clutch on sleeve/de-sleeve motor 1215, stops the packaged food product at a specified position within oven 210.

Control board 208 re-activates package sleeve/de-sleeve motor 1215 to withdraw ram 1202 from oven 210. Control board 208 de-activates package sleeve/de-sleeve motor 1215 after a pre-set time interval that is specified to ensure that ram 1202 is withdrawn to allow oven door 301 to close.

Control board 208 then re-activates oven door motor 312 to begin closing oven door 301. The oven door monitor switch indicates whether oven door 301 is fully closed. If the oven door monitor switch is not activated within a specified time after control board 208 begins closing oven door 301, then operation of vending machine 100 ceases. Otherwise, when the oven door monitor switch indicates that oven door 301 is fully closed, control board 208 de-activates the oven door motor 312.

Figure 13A:
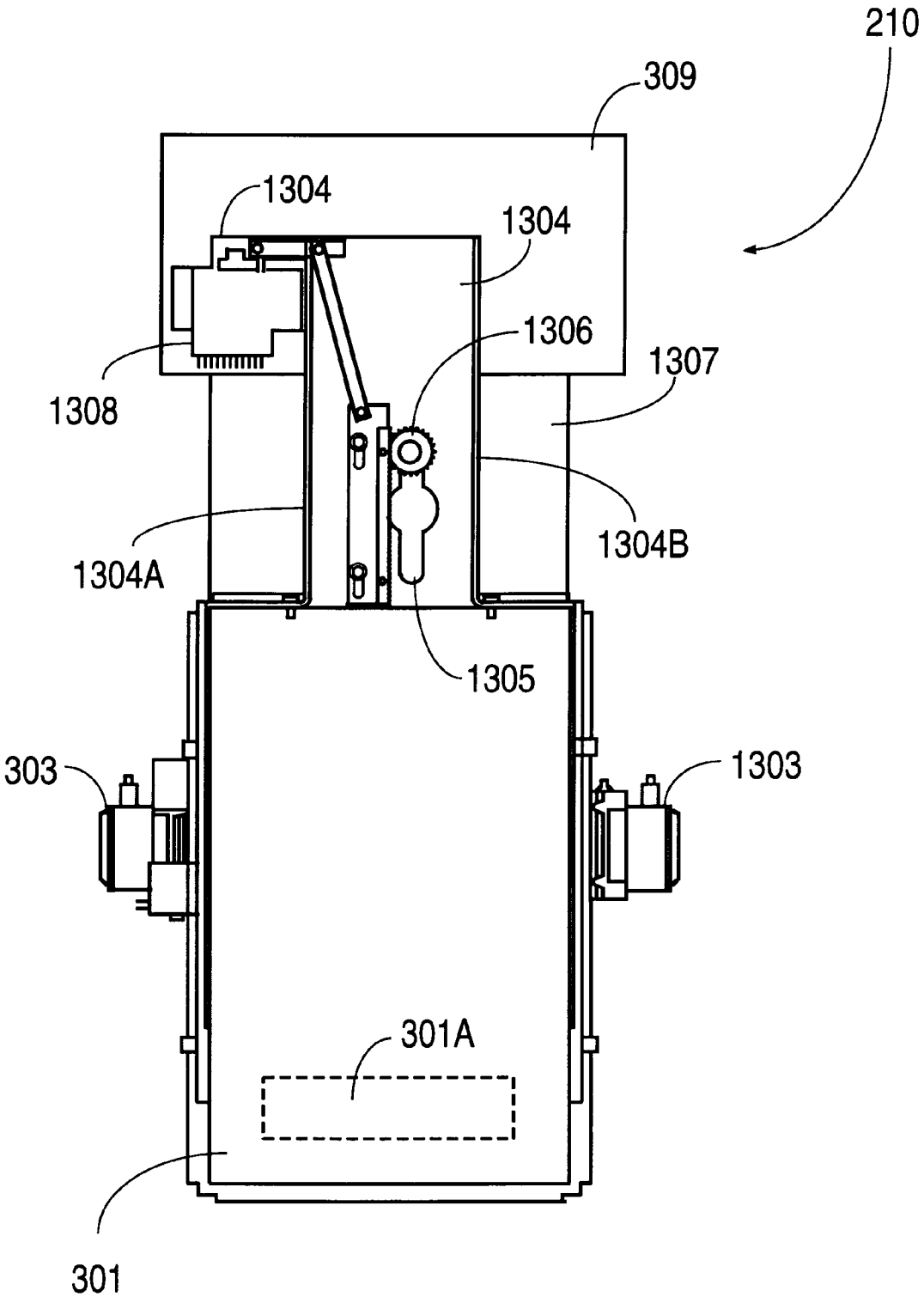
FIG. 13A is a front view of the oven of FIG. 3.

FIG. 13A is a front view of oven 210. Magnetrons 303 and 1303 are mounted to opposite sides of oven 210. Oven door 301 is shown, with the position of oven aperture 301A indicated in dashed lines.

A plate 1304 is bolted to the top edge of oven door 301. Plate 1304 has edge flanges 1304A and 1304B to give it structural rigidity and has a slot 1305 formed in it through which a gear 1306 extends. Gear 1306 is driven by oven door motor 312 (not visible in FIG. 13A) which is mounted within a housing 1307. An interlock switch 1308 is mounted to the front of oven power supply box 309.

Figure 13B:
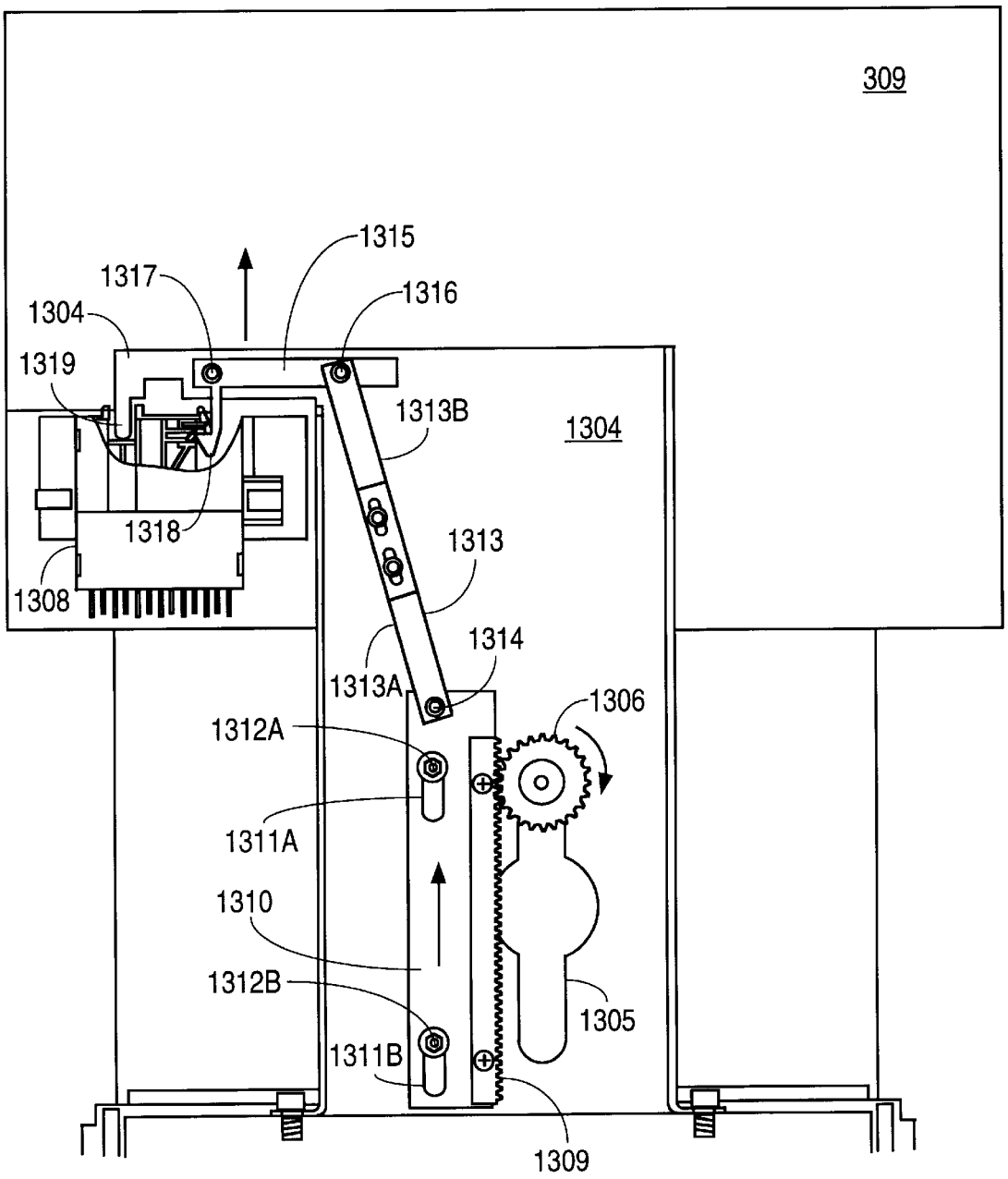
FIG. 13B is a detailed view of a portion of FIG. 13A, illustrating the mechanism for opening the oven door of the oven of FIG. 3.

FIG. 13B shows details of the mechanisms associated with plate 1304. A rack 1309 is bolted to a rack plate 1310 and meshes with gear 1306. Slots 1311A and 1311B are formed in rack plate 1310. Bolts 1312A and 1312B are threaded into plate 1304. Bolts 1312A and 1312B extend through slots 1311A and 1311B, respectively, and thereby hold rack plate 1310 against plate 1304, allowing rack plate 1310 to move in a vertical direction only. Thus, if gear 1306 rotates clockwise (as shown by the arrow), rack plate 1310 is lifted until bolts 1312A and 1312B engage the lower limits of slots 1311A and 1311B, respectively, at which point plate 1304 begins to lift.

A link 1313 is pivotally attached to rack plate 1310 at a pin 1314 and to a link 1315 at a pin 1316. Link 1315 is rotatably attached to plate 1304 at a pin 1317. A hook 1318 is formed at an end of link 1315. A finger 1319 is formed integrally with plate 1304. Link 1313 includes sections 1313A and 1313B which are joined by a slot arrangement which allows the overall length of link 1313 to be adjusted.

In this embodiment, interlock switch 1308 is a model P/N 600-00081 manufactured by Tricon Industries, Incorporated, of Downers Grove, Ill. Hook 1318 and finger 1319 engage primary, secondary and monitor switching mechanisms within interlock switch 1308. The primary and secondary switching mechanisms are connected serially in the power supply circuit for magnetrons 303 and 1303 (FIG. 13A) so that the magnetrons cannot be powered unless the oven door is in a closed position.

The operation of this mechanism will now be described. When oven 301 is to be opened, gear 1306 rotates clockwise, thereby lifting rack plate 1310. Until bolts 1312A and 1312B engage the lower edges of slots 1311A and 1311B (a travel of about 1 inch), rack plate 1310 lifts link 1313 and causes link 1315 to rotate counter-clockwise about pin 1317. Since hook 1318 is formed integrally with link 1315, hook 1318 likewise rotates counter-clockwise, and the primary and secondary switching mechanisms within interlock switch 1308 are opened. Note that this action occurs before plate 1304 has begun to rise. When bolts 1312A and 1312B engage the lower limits of slots 1311A and 1311B, plate 1304 begins to be lifted. Since finger 1319 is formed integrally with plate 1304, finger 1319 is withdrawn from interlock switch 1308, thereby closing the monitor switching mechanism within interlock switch 1308. In this embodiment, the monitor switching mechanism closes after finger 1319 has been withdrawn 0.075 inches. The monitor switch within the interlock switch 1308 is closed, causing a short across the power line to each of magnetrons 303 and 1303.

Figure 13C:
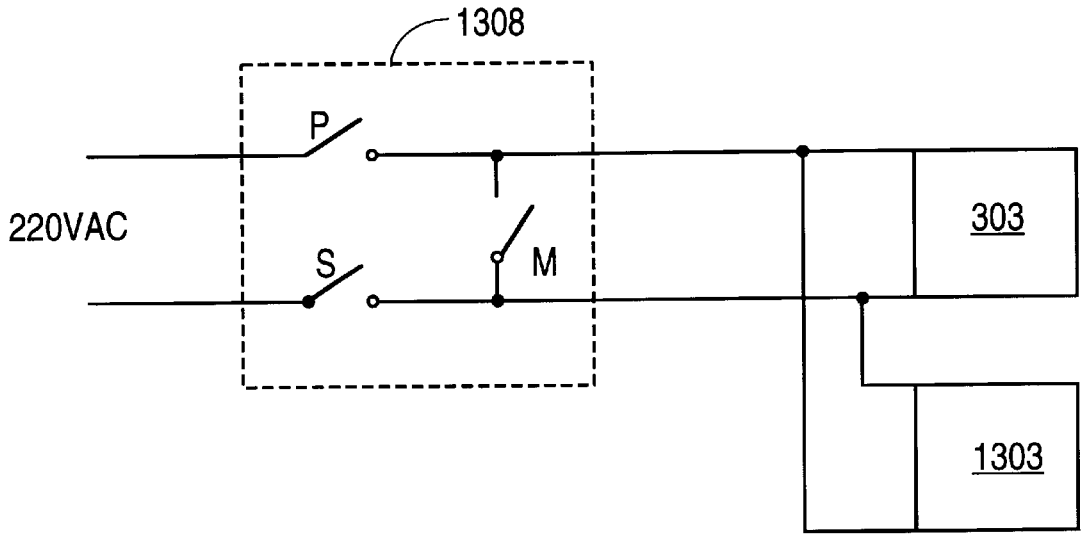
FIG. 13C is a simplified circuit diagram of the circuitry relating to the interlock switch of the oven of FIG. 3.

FIG. 13C illustrates a simplified circuit diagram of the circuitry relating to interlock switch 1308, with P representing the primary switching mechanism, S representing the secondary switching mechanism and M representing the monitor switch. The details and specifications of interlock switch 1308 are set forth in the specification for Part Nos. 600-00081, 600-00082 and 600-00083, available from Tricon Industries, Inc., 2325 Wisconsin Avenue, Downers Grove, Ill. and are incorporated herein by reference.

The above-described process is reversed when oven door 301 is closed. Importantly, oven door 301 is fully closed before either the primary or secondary interlock switches are closed, thus ensuring the oven 210 cannot operate while oven door 301 is open.

To begin the cooking process, control board 208 activates oven 210 according to a cooking cycle entered by the user at control board 208. After the food product is cooked, control board 208 de-activates oven 210 and opens oven door 301 in the same manner as described above. Control board 208 turns on vacuum pump 1203 (see FIG. 12A). Vacuum pump 1203 supplies suction through pump lines 1204 to suction cups 1209. In one embodiment, the vacuum pressure is 4 psi. Control board 208 activates package sleeve/de-sleeve motor 1215 so that ram 1202 is moved through oven aperture 301*a* into oven 210, as described above. As above, package sleeve/de-sleeve motor 1215 is de-activated by control board 208 after a pre-set time, the position of ram 1202 being established by the mechanical stop together with sleeve/de-sleeve motor slip clutch. Suction cups 1209 contact the packaged food product, flush with the side 902*a* of food tray 902 due to the angle 1226 at which suction cups 1209 are oriented, the vacuum drawn through suction cups 1209 engaging food tray 902 to suction cups 1209.

Control board 208 then re-activates package sleeve/de-sleeve motor 1215 to withdraw ram 1202 from oven 210, as described above. As ram 1202 is withdrawn, the packaged food product is pulled into the package sleeve, which remains on delivery tray 205 during cooking of the food product. Reinsertion of the packaged food product into the sleeve, which, since the sleeve remains outside oven 210 during cooking, is relatively cool to the touch, enables a user to pick up the packaged food product after discharge from vending machine 100 without being burned. Control board 208 de-activates the sleeve/de-sleeve motor 1215 after a pre-set time interval that is specified to ensure that ram 1202 is withdrawn to its initial position on guide rail 1201. Stops 1221 stop the food product tray when it has been pulled all the way back into the package sleeve. Vacuum pump 1203 is then turned off, so that suction is no longer applied through suction cups 1209.

After the packaged food product is withdrawn from oven 210, control board 208 activates the oven door motor 312 to close oven door 301, as described more fully above.

FIGS. 12F and 12G are a plan view and simplified side view, respectively, of delivery tray 205 and associated transfer mechanism 216 when delivery tray 205 is in a third position for discharging a packaged food product from delivery tray 205 into delivery chute 103. Control board 208 activates delivery tray translation motor 1219 for a pre-set period of time to move delivery tray 205 toward delivery chute 103 in the direction of arrow 1232. Delivery tray 205 is attached to a rail 1234 which telescopes with movable rail 1229 and fixed rail 1235 to allow delivery tray 205 to move toward delivery chute 103. As delivery tray 205 moves toward delivery chute 103, delivery tray 205 moves over a ramp 1206. Support structure 1228 is mounted on a plate 1270 which is connected to a base plate 1271 by a hinge 1272. A knob 1236 formed on the bottom of the support structure for delivery tray 205 contacts ramp 1206 causing delivery tray 205 to tilt over. Further, the bottom portion of rail 1212*a* strikes stop 222 attached to front service door 101, causing rail 1212*a* to fall down and allow the packaged food product to leave delivery tray 205 and enter delivery chute 103.

Generally, swinging door 219 (FIG. 2) is locked. When a packaged food product is discharged-from delivery chute 103, a roller 1220 pushes swinging door 219 open. Delivery tray translation motor 1219 and solenoid 223, which normally latches swinging door 219 shut, are connected electrically in parallel. When motor 1219 is powered, solenoid 223 is energized, freeing swinging door 219 to be pushed open by roller 1220.

After a specified time delay, e.g., 3 seconds, control board 208 activates delivery tray translation motor 1219 to retract delivery tray 205. Delivery tray translation motor 1219 is de-activated after a pre-set time interval that is sufficiently long to ensure that delivery tray 205 is withdrawn to a position for accepting another packaged food product from one of inventory magazines 202. A mechanical stop, together with the slip clutch of delivery tray translation motor 1219, position delivery tray 205 at the desired position.

Empty magazine indicator 606 (FIGS. 6A through 6E) continuously detects whether a packaged food product is present in each inventory magazine 202, as discussed in more detail above. If no packaged food product is present, then control board 208 causes a display bar to be displayed in the appropriate price display 110, rather than the price for that food product, and control board 208 does not process any request for cooking of that food product.

Control board 208 activates delivery tray translation motor 1219 to rotate delivery tray 205 back to the first position, i.e., in position for accepting a new packaged food product. Delivery tray translation motor 1219 is activated for a specified period of time that is sufficiently long to ensure that delivery tray 205 is rotated back into the first position. A mechanical stop, together with the slip clutch of the delivery tray rotation motor 1219, positions delivery tray 205 at the first position.

In one embodiment, vending machine 100 includes various failure control devices that ensure consistency in the quality of food dispensed by vending machine 100. In case of a component failure in vending machine 100, one or more of the failure control devices send a signal to control board 208 that prevents vending of food products and displays an error message.

Control board 208 (FIG. 14) includes an operator display 1401 that displays messages (including error messages) to an operator, an operator keypad 1402 and function keys 1403A–1403E for entry of operator commands. A microcontroller 1404 on control board 208 includes in one embodiment a Phillips 80C552 microprocessor available from Signetics Corporation, that performs various functions by executing the software listed in Microfiche Appendix A.

Microcontroller 1404 is coupled to an erasable, programmable read-only memory (EPROM) 1406 and a random access memory (RAM) 1405 that are both powered by a battery 1407. In one embodiment, battery 1407 is a flat lithium battery BR2325 available from Panasonic, that is connected in the conventional manner to ensure that the various battery powered devices, such as RAM 1405, EPROM 1406 and real time clock 1409 continue to function even in the event of loss of power to other components of control board 208 that are powered by power supply 211.

Real time clock 1409 supplies a real time clock signal to microcontroller 1404 that determines the duration of power loss of vending machine 100, as described more completely below Real time clock 1409 is in one embodiment MC146818 available from Motorola, Inc., Austin, Tex. 78735. Generally understood components of embedded microcontroller systems are not individually labelled in FIG. 14 and are not described in detail, to avoid unnecessarily burdening the present description. Any references to various devices, such as displays, buttons, numeric keypads, relays, microcontrollers, memories and power supplies are merely illustrative and are not necessary to practice the present invention.

Figure 15:
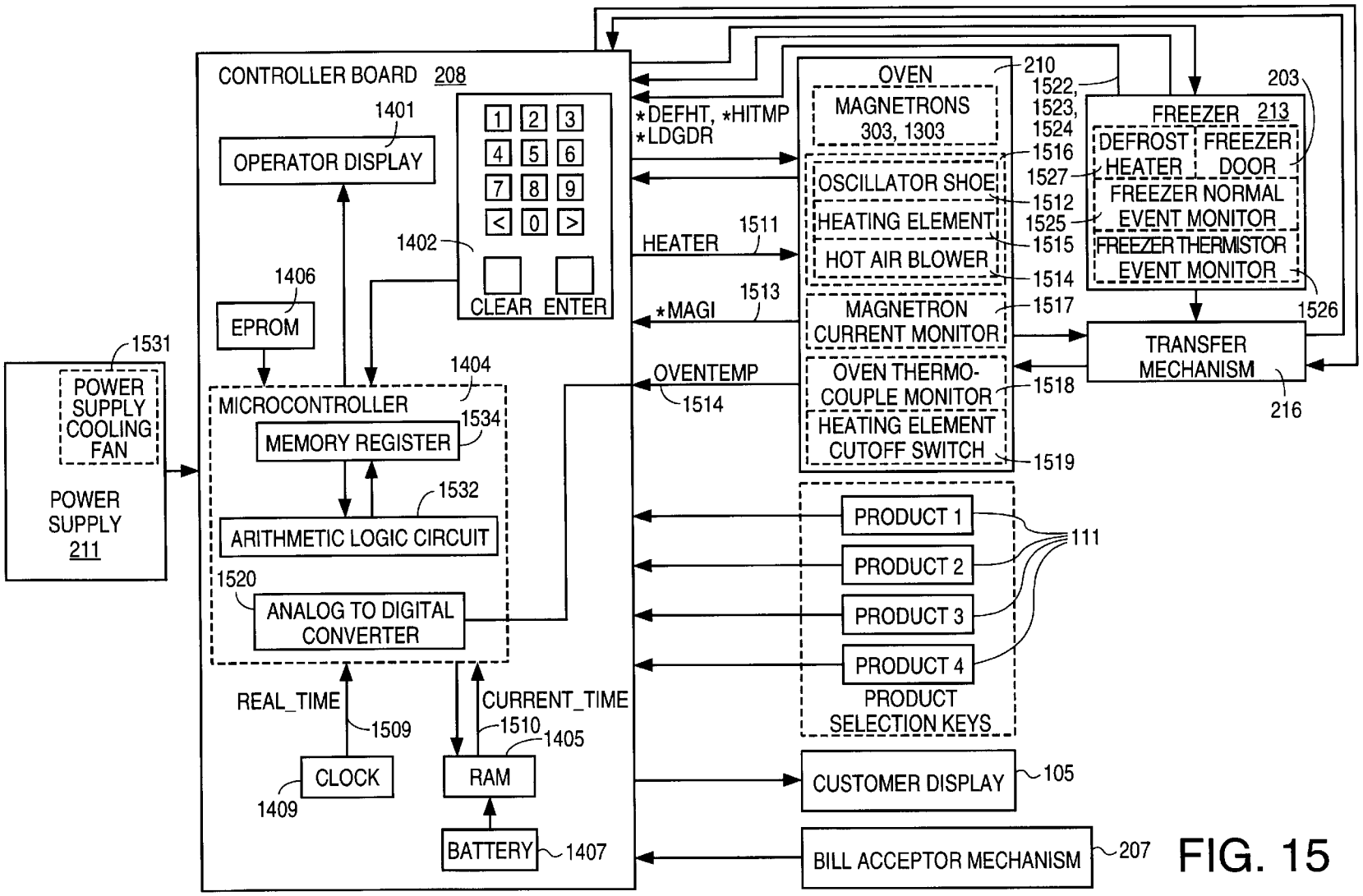
FIG. 15 is a block diagram illustrating the overall system level architecture of an embedded real time microcontroller system that controls operation of the vending machine of FIG. 1.

FIG. 15 illustrates in block diagram, an overall system architecture including various failure control devices used in one embodiment of vending machine 100. Oven 210 includes magnetrons 303 and 1303, and a hot air impingement apparatus 1516 that act as heat sources for a food product that is cooked by vending machine 100 prior to dispensing. In this specific embodiment, hot air impingement apparatus 1516 includes a heating element 1515, a hot air blower 1514 and a shoe 1512, for example, as disclosed in U.S. patent application, Ser. No. 08/317,005 referenced above now U.S. Pat. No. 5,503,051. Other heat sources can also be used, such as those described in U.S. Pat. No. 4,492,839 to Smith. Oven 210 also includes various oven control devices, such as a magnetron current monitor 1517, an oven thermocouple monitor 1518 and a heating element cut-off switch 1519.

Microcontroller 1404 monitors the temperature in oven 210 through an analog to digital converter 1520 that periodically samples an analog signal OVENTEMP. Signal OVENTEMP is an oven temperature signal that is driven by oven thermocouple monitor 1518 to indicate the temperature in oven 210. If the oven temperature is below a lower limit (e.g. 330° F.), microcontroller 1404 displays on customer display 105 an error message indicating "WARMING UP", until the oven temperature exceeds a predetermined setpoint temperature. If the oven temperature is above a higher limit (e.g. 500° F.), microcontroller 1404 displays an error message "WARMING UP" on customer display 105, until the oven temperature falls below the higher limit.

Magnetron current monitor 1517 monitors the operation of magnetrons 303 and 1303 and supplies a magnetron current sense signal *MAGI to control board 208 on a magnetron failure line 1513. Signal *MAGI is an active low signal indicating proper operation of magnetrons 303 and 1303. If one of magnetrons 303 and 1303 fails to draw current, magnetron current monitor 1517 drives signal *MAGI high that in turn causes microcontroller 1404 to suspend dispensing of food product and display an error message on customer display 105 (FIG. 1).

A freezer failure control device of refrigeration compartment 213 (also called "freezer 213") includes a freezer thermistor monitor 1526 and a freezer event monitor 1525. Freezer thermistor monitor 1526 drives freezer over-temperature signal *HITMP (an active low signal) high on freezer over-temperature line 1523 if the temperature of freezer 213 exceeds a predetermined temperature, e.g. 20° F.

Freezer event monitor 1525 drives a first freezer event logic signal *DEFHT (an active low signal) low on a first freezer event line 1522 coupled to microcontroller 1404 (FIG. 14), to indicate that freezer 213 was halted by turning on a defrost heater 1527, i.e. a first normal event Freezer event monitor 1525 also drives a second freezer event logic signal *LDGDR (an active low signal) low on a second freezer event line 1524 to indicate that freezer 213 was halted by the opening of a refrigeration compartment door 203 (also called "freezer door 203"), i.e. a second normal event.

In response to an active signal *DEFHT (e.g. low), microcontroller 1404 ignores an active freezer over-temperature signal *HITMP on line 1523 for a predetermined cool off period, such as 60 minutes or 75 minutes, in conformance with NAMA Construction Standard, Section 700, available from National Automatic Merchandising Association, 20 North Wacker Drive, Suite 3500, Chicago, Ill. 60606-3102. If freezer over-temperature signal *HITMP remains active for a predetermined duration, e.g. 15 minutes in this embodiment after the cool off period, microcontroller 1404 determines that a freezer failure (also called meltdown fault) has occurred, suspends vending food products and displays an error message on customer display 105.

A power failure control device of vending machine 100 includes a battery powered real time clock 1409 that remains operative during a power loss condition of control board 208. When control board 208 is powered up, for example, following a power loss condition, microcontroller 1404 compares a real time signal from real time clock 1409 with a current time signal from a current time storage location in RAM 1405 in which microcontroller 1404 repeatedly stores the real time signal during normal operation of vending machine 100.

If control board 208 loses power for a period of time longer than a predetermined period (e.g. 15 minutes) and if signal *HITMP is low, microcontroller 1404 suspends vending food and displays an error message on customer display 105.

In one embodiment, vending machine 100 also includes a power supply cooling fan 1531 that cools various electronics, including two magnetron transformers T1 and T2 (FIG. 18) and a board containing relay RLY5, to eliminate shutdowns caused by overheating of the electronics.

Figure 16:
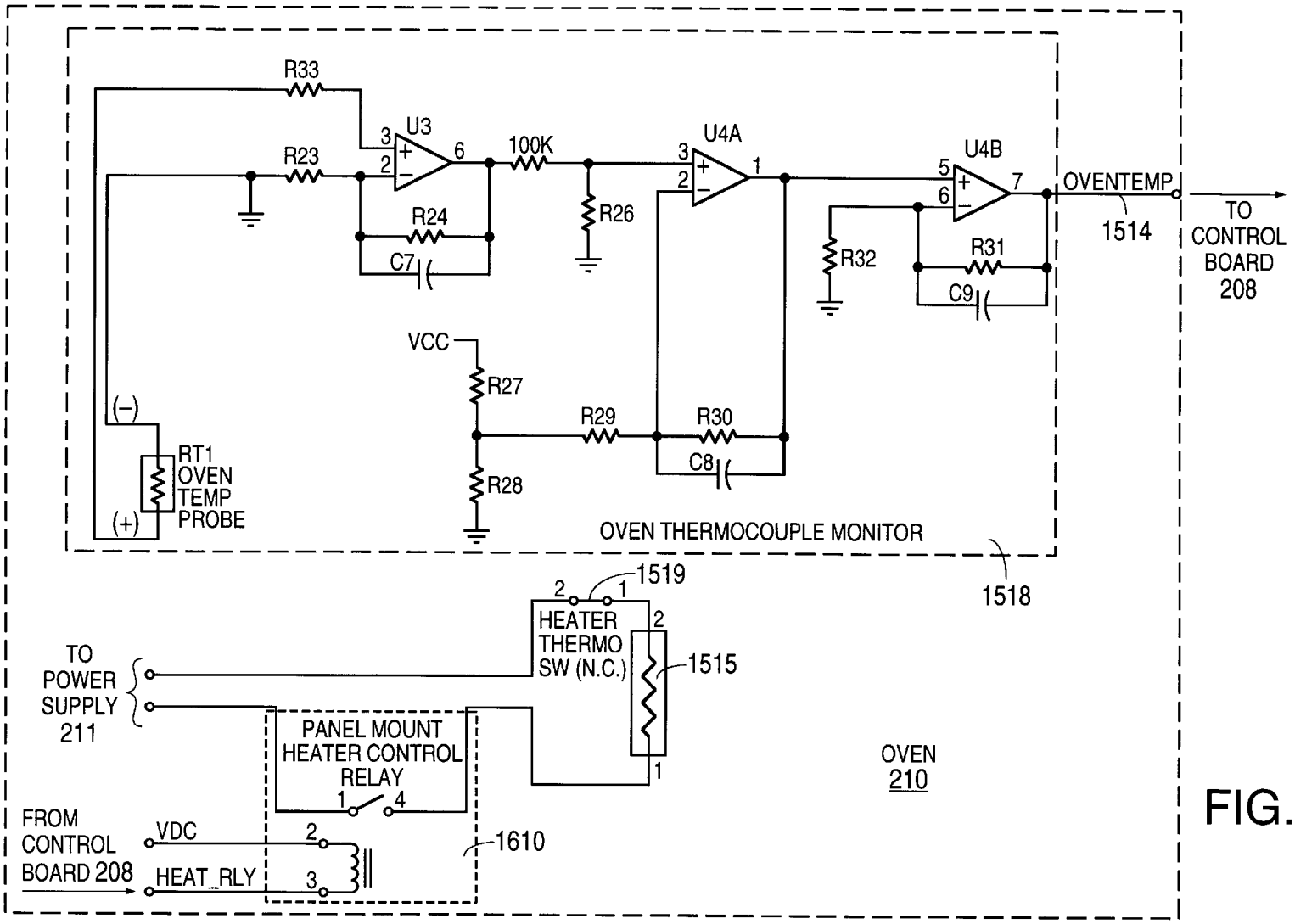
FIG. 16 is a circuit diagram illustrating an oven thermocouple monitor in one embodiment of the oven illustrated in FIG. 15.

FIG. 16 illustrates one embodiment of an oven thermocouple monitor 1518 that uses an oven temperature probe RT1 to sense the temperature in oven 210 and drive the oven temperature signal OVENTEMP. Oven temperature probe RT1 includes a thermocouple junction that generates a voltage between the signals at terminals 2 and 3 of an operational amplifier U3. Amplifier U3 multiplies the voltage difference of the signals between terminals 2 and 3, by a gain factor of 300 and supplies this amplified signal at output terminal 6 that is coupled to input terminal 3 of operational amplifier U4A.

Operational amplifier U4A performs a level shifting function on the voltage of the signal at input terminal by the voltage of the signal at input terminal 2, and supplies a signal of this voltage at output terminal 1. The voltage of the signal at input terminal 2 is obtained by multiplying voltage VCC by the ratio R28/(R27+R28).

Operational amplifier U4B receives the signal from operational amplifier U4A, provides a gain of two and supplies an amplified signal (called analog signal OVENTEMP) at output terminal 7 that is connected by oven temperature line 1514 to control board 208.

In one specific embodiment, signal OVENTEMP has a voltage between 0 and 5 volts that corresponds to a temperature range between 330 and 500° F.

An analog to digital converter 1520 inside microcontroller 1404 on control board 208 periodically samples signal OVENTEMP and supplies a digital signal to arithmetic logic circuit 1532.

In one example, illustrated in FIG. 16, the component ratings are listed in Table 1 below.

TABLE 1

(see FIG. 16)

| Component | Rating |
|---|---|
| R33 | 3.24K |
| R23 | 3.24K |
| U3 | LT1006 |
| R24 | 976K |
| C7 | 0.0056 u |
| R25 | 100K |
| R26 | 100K |
| U4A | LM324 |
| U4B | LM324 |
| R32 | 26.1 |
| R31 | 52.3K |
| C9 | 0.1 u |
| R30 | 100K |
| C8 | 0.056 u |
| R29 | 100K |
| R27 | 52.3K |
| R28 | 7.87K |
| VDC | 24 |

Figure 17A:
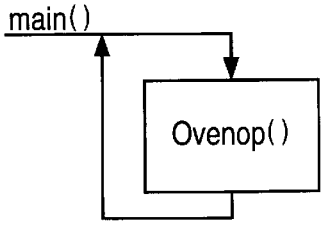
FIGS. 17A–17K illustrate flow charts for the operation of a microcontroller with the oven thermocouple monitor of FIG. 16.
Figure 17B:
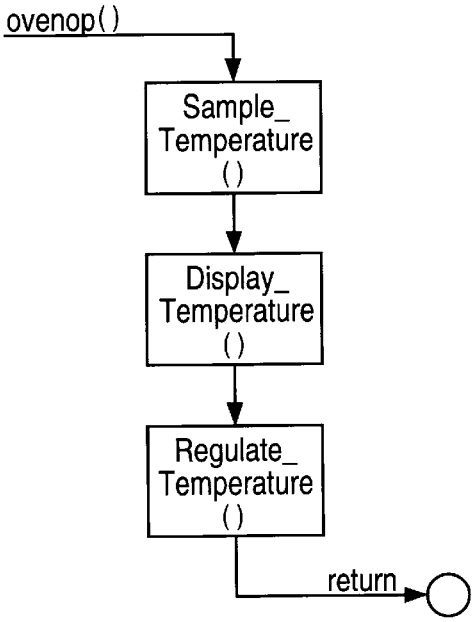

Microcontroller 1404 periodically executes a function ovenop( ) (FIG. 17A) to perform various functions related to the temperature of oven 210. Function ovenop( ) in turn calls functions sample_temperature, display_temperature( ) and regulate_temperature( ) (FIG. 17B). Implicit in the following description in reference to steps performed by a function is the assumption that microcontroller 1404 executes corresponding code in Appendix A in one embodiment. As noted in the above referenced application Ser. Nos. 08/231,195 now U.S. Pat. No. 5,503,300 and 08/299,927 now U.S. Pat. No. 5,688,423, microcontroller 1404 repeatedly loops through several functions in the top level function main( ).

Figure 17C:
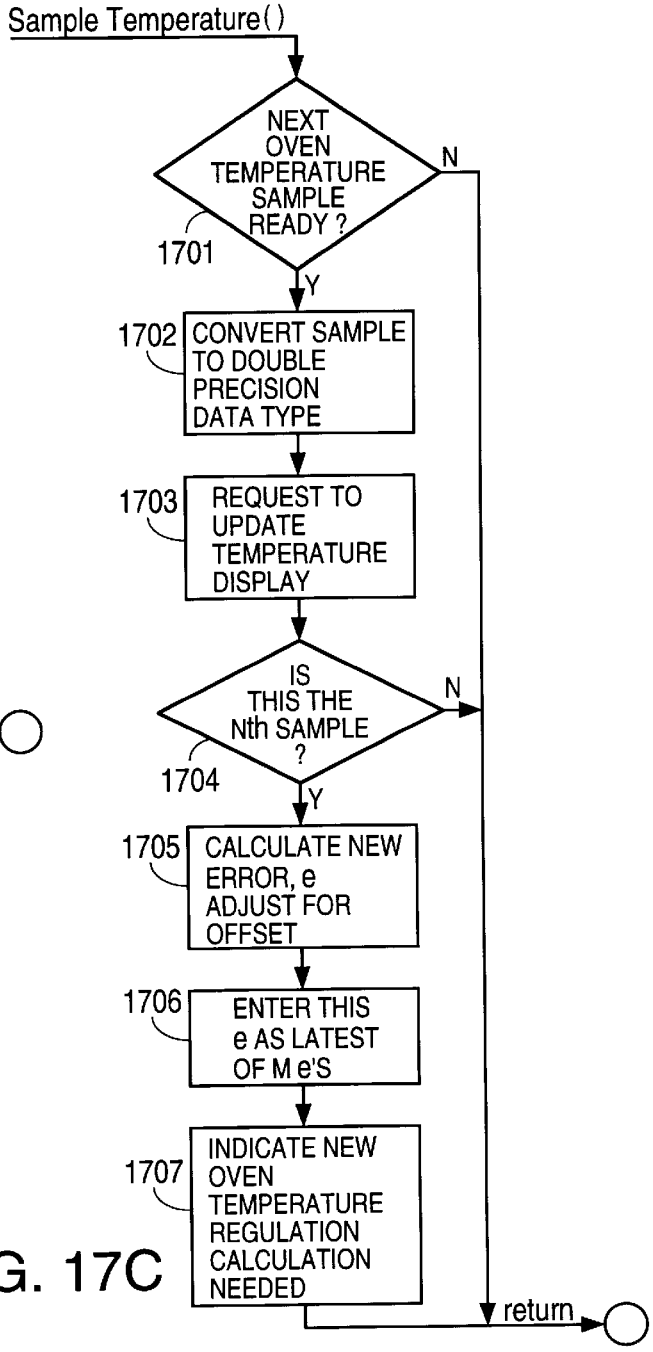

Function sample_temperature( ) (FIG. 17C) waits for a flag set by analog-to-digital converter 420 that indicates conversion of the next oven temperature sample. Analog-to-digital converter 420 periodically sets the flag, for example every 0.8 seconds. Function sample_temperature( ) converts the sampled oven temperature into double precision data type and sets a flag to request update of the temperature display on operator display 1401.

Function sample_temperature( ) performs the above described steps only every nth sample, with n=3 in this specific embodiment, so that the rest of the functions receive an oven temperature input only every 2.4 seconds, because oven 210 has a large thermal inertia. Function sample_temperature( ) computes the difference between the oven's current temperature and a predetermined set point temperature, which difference is referred to as "error signal" e. In this specific embodiment function sample_temperature( ) stores the four most recent error signals e in memory locations of RAM 305. Then function sample_temperature( ) sets a flag to indicate availability of the new error signal e and then returns to the function ovenop( ).

Function display_temperature( ) (FIG. 17D) checks if function sample_temperature( ) has computed a new oven temperature in step 1711. If so, display_temperature( ) checks in step 1712 whether the new temperature is the same as the temperature most recently displayed. Step 1712 eliminates the flicker that may be caused by frequent updates to operator display 301 (FIG. 14), by only writing when necessary. Then in step 1713 (FIG. 17D), function display_temperature( ) converts the double precision oven temperature into a binary equivalent.

Figures 1, 17D:
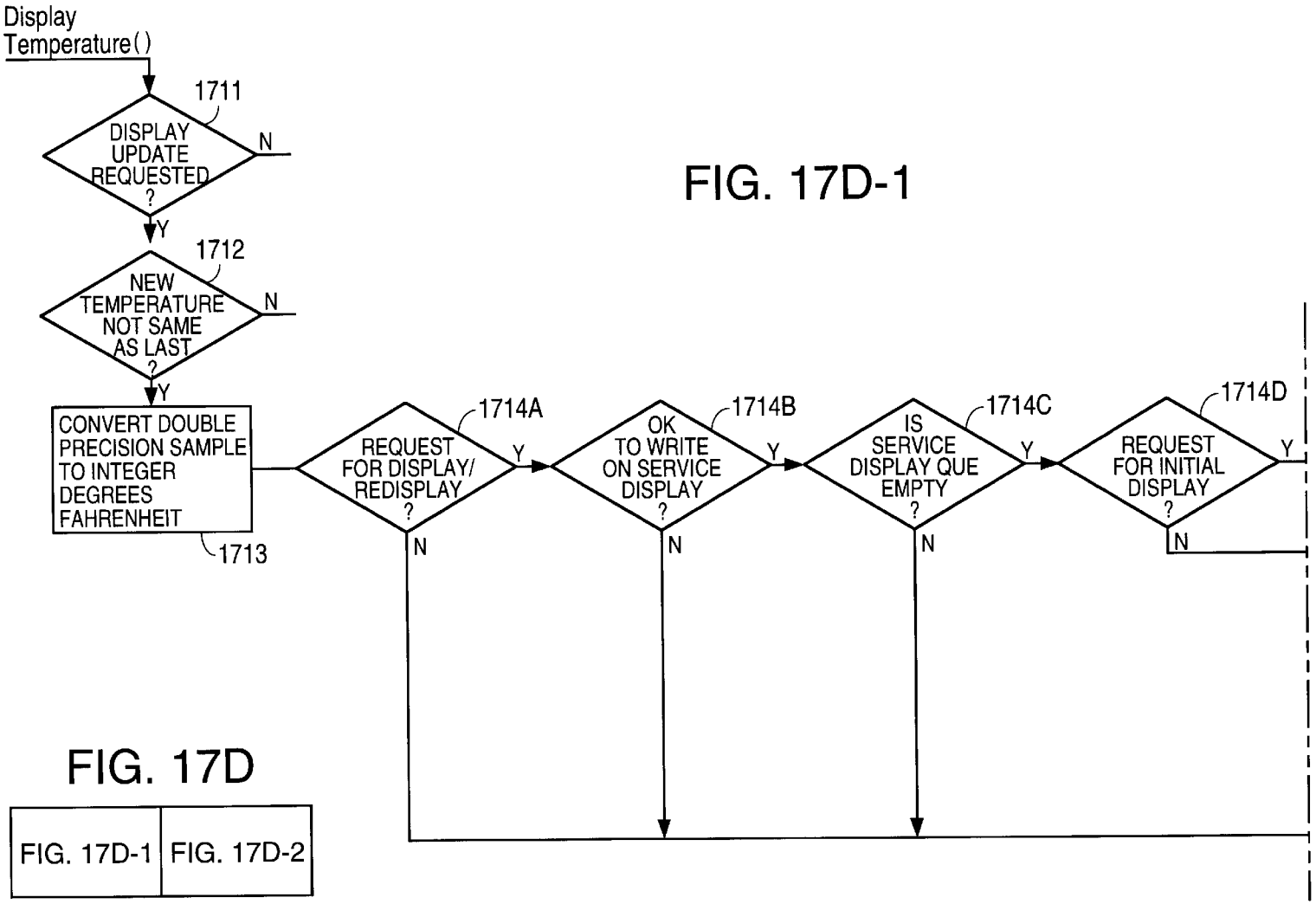
Figures 2, 17D:
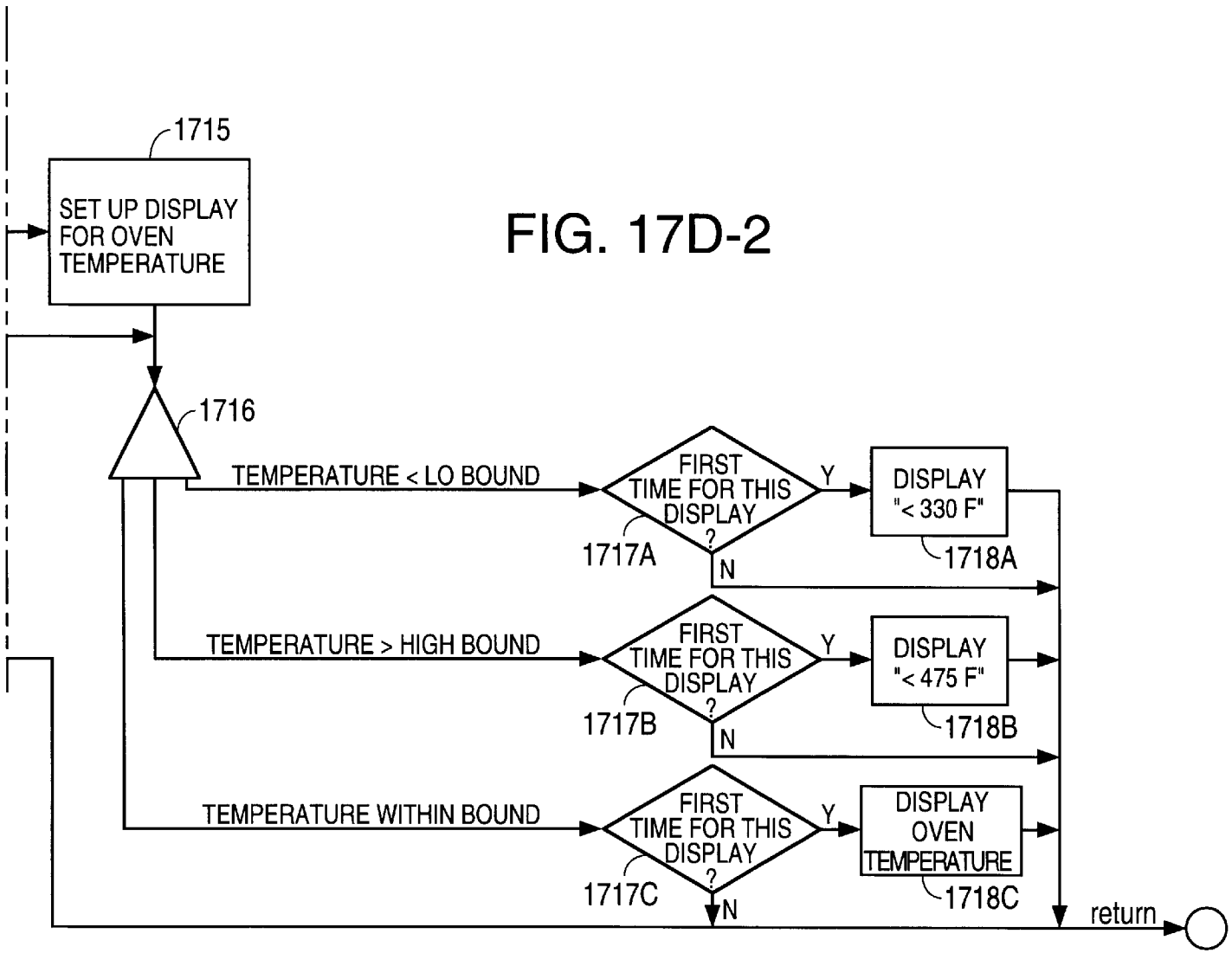

Then function display_temperature( ) performs a number of checks in steps 1714A–1714D, for example, to satisfy requests from other functions to display or redisplay the oven temperature. Function display_temperature( ) checks the availability of operator display 301 (FIG. 4) in step 1714B (FIG. 17D). In step 1714C, function display_temperature( ) checks to see if a queue associated with operator display 301 (sometimes referred to as "service display") is empty, to ensure that the oven temperature character string is not jammed into the middle of a partially displayed character string of another function. In step 1715, function display_temperature( ) sets up operator display 301 by blanking the display prior to writing the oven temperature.

In step 1716, function display_temperature( ) checks to see if the oven temperature is between limits, such as an upper limit and a lower limit, and thereafter displays the appropriate character strings as illustrated in steps 1718A–1718C. Function display_temperature( ) uses limits LO_BOUND and HIGH_BOUND that are, respectively, 350° F. and 475° F. in one specific embodiment. Thereafter, function display_temperature( ) returns to the function ovenop( ) (FIG. 17B).

Function OVENOP calls function regulate_temperature( ) (FIG. 17E) that performs the various steps needed to regulate the temperature of oven 210 within a regulation band centered around a predetermined set point temperature. Function regulate_temperature( ) uses a non-adaptive proportional integral derivative control method to develop a hot air impingement control signal HEATER.

Oven 210 passes signal HEATER on line 1511 from control board 208 as signal HEAT_RLY (FIG. 16) to heater control relay 1610 that controls power supply to heating element 1515 (FIG. 16). In addition to function regulate_temperature( ), a heating element cut-off switch 1519 (FIG. 16) in oven 210 cuts off the power supply to a heating element 1515 if heating element 1515 remains above a predetermined temperature for a predetermined amount of time. For heating element 1515 to operate, relay 1610 and switch 1519 should both be on.

Figures 1, 17E:
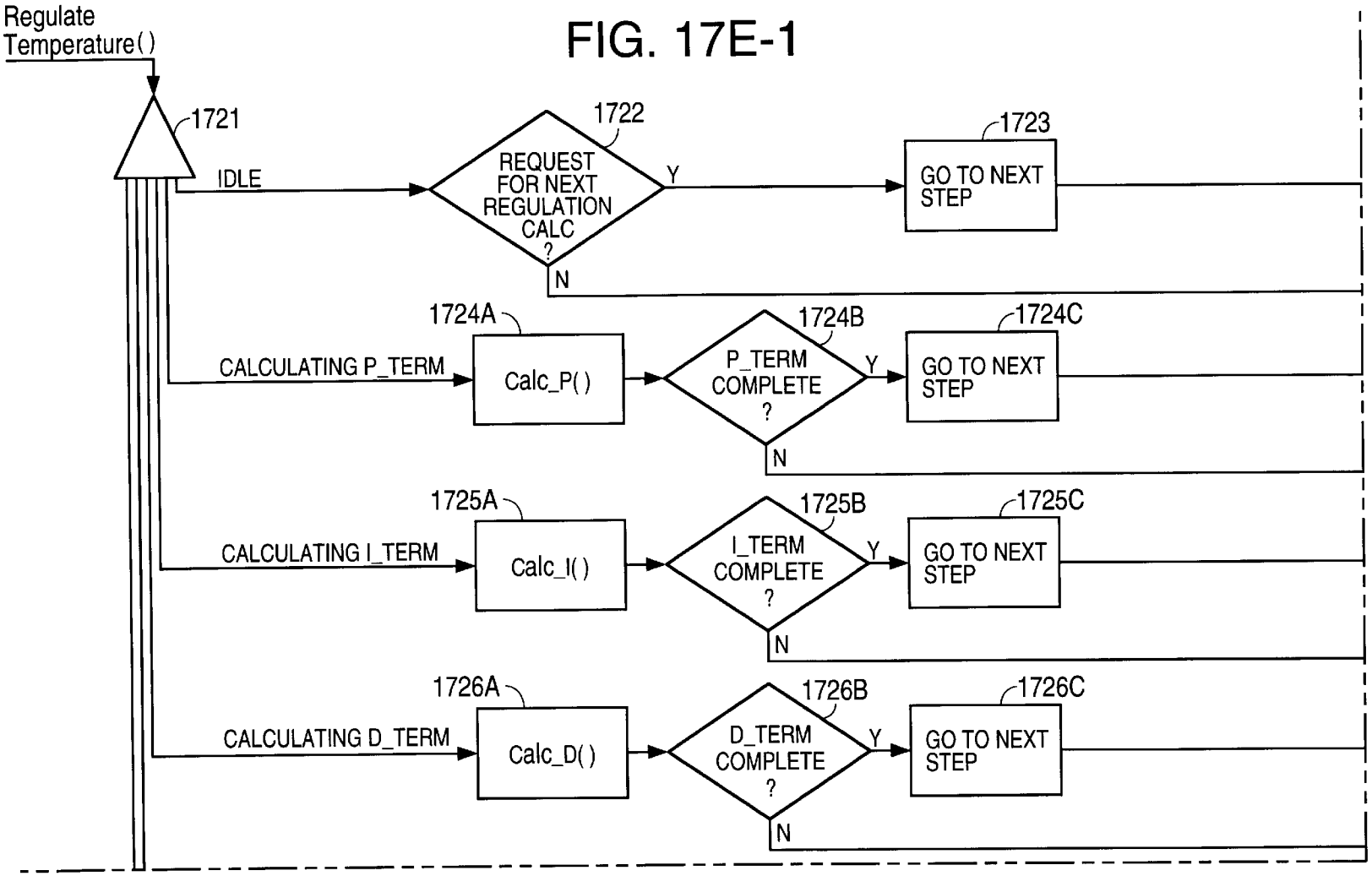
Figures 2, 17E:
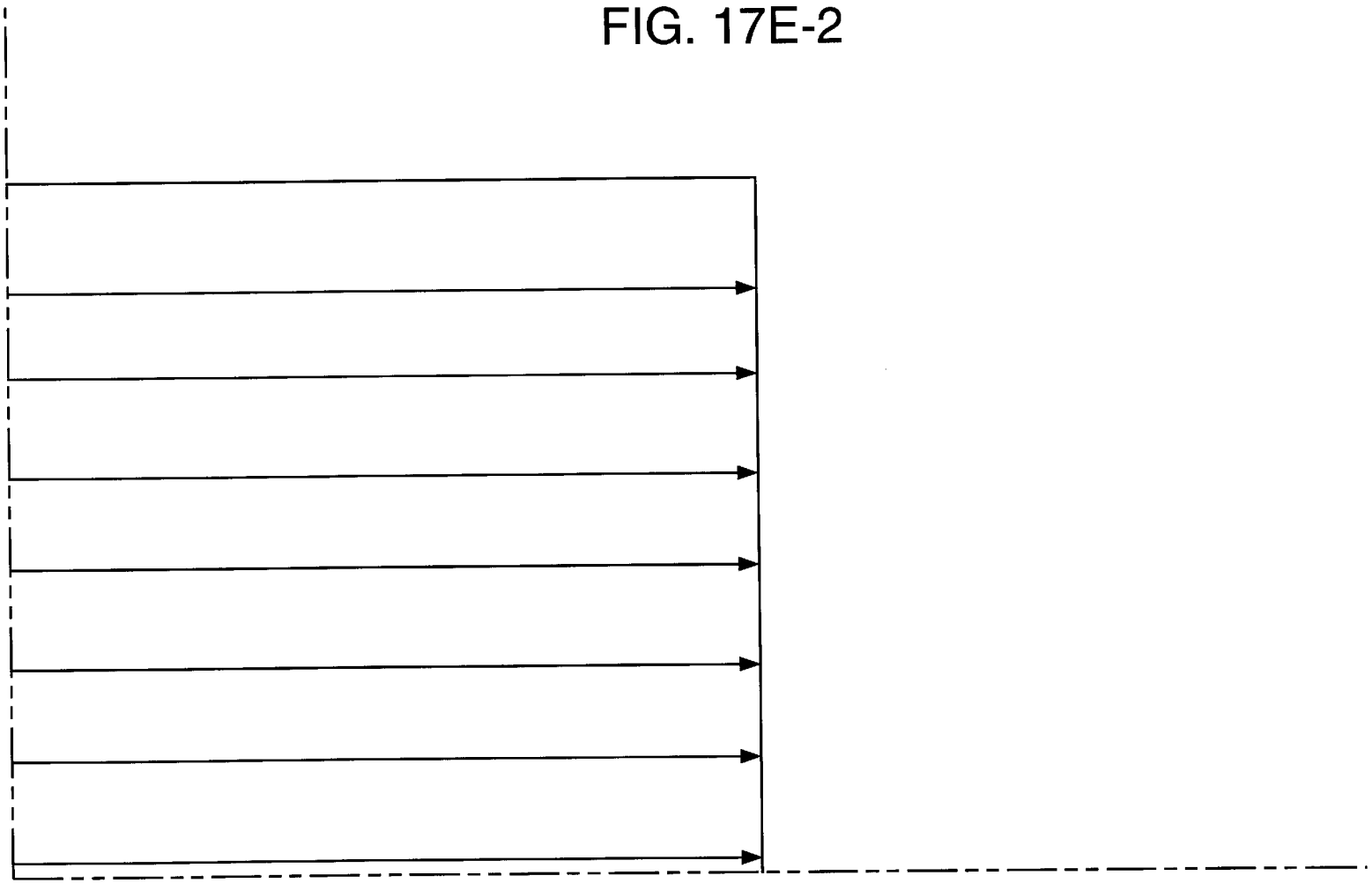
Figures 3, 17E:
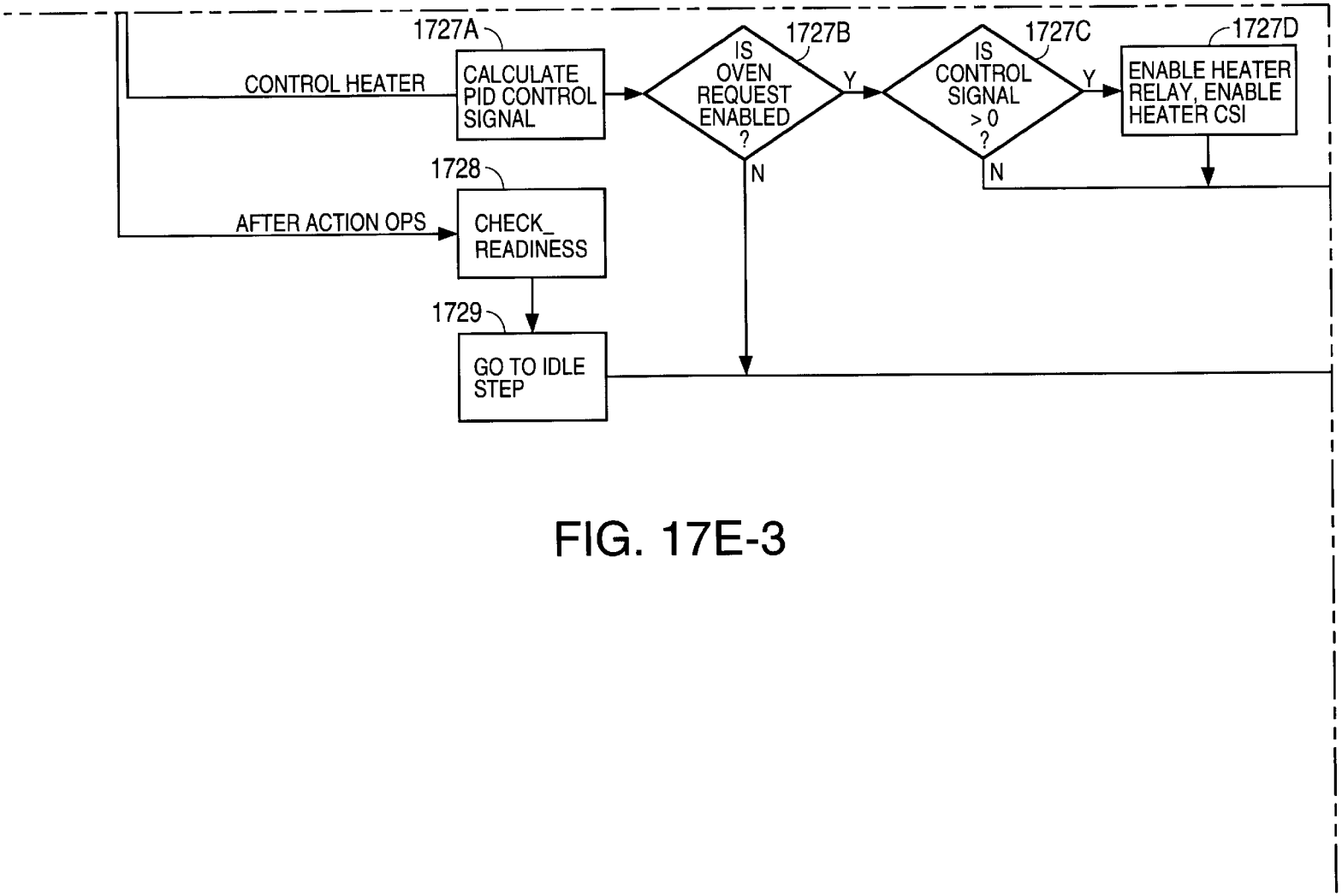
Figures 4, 17E:
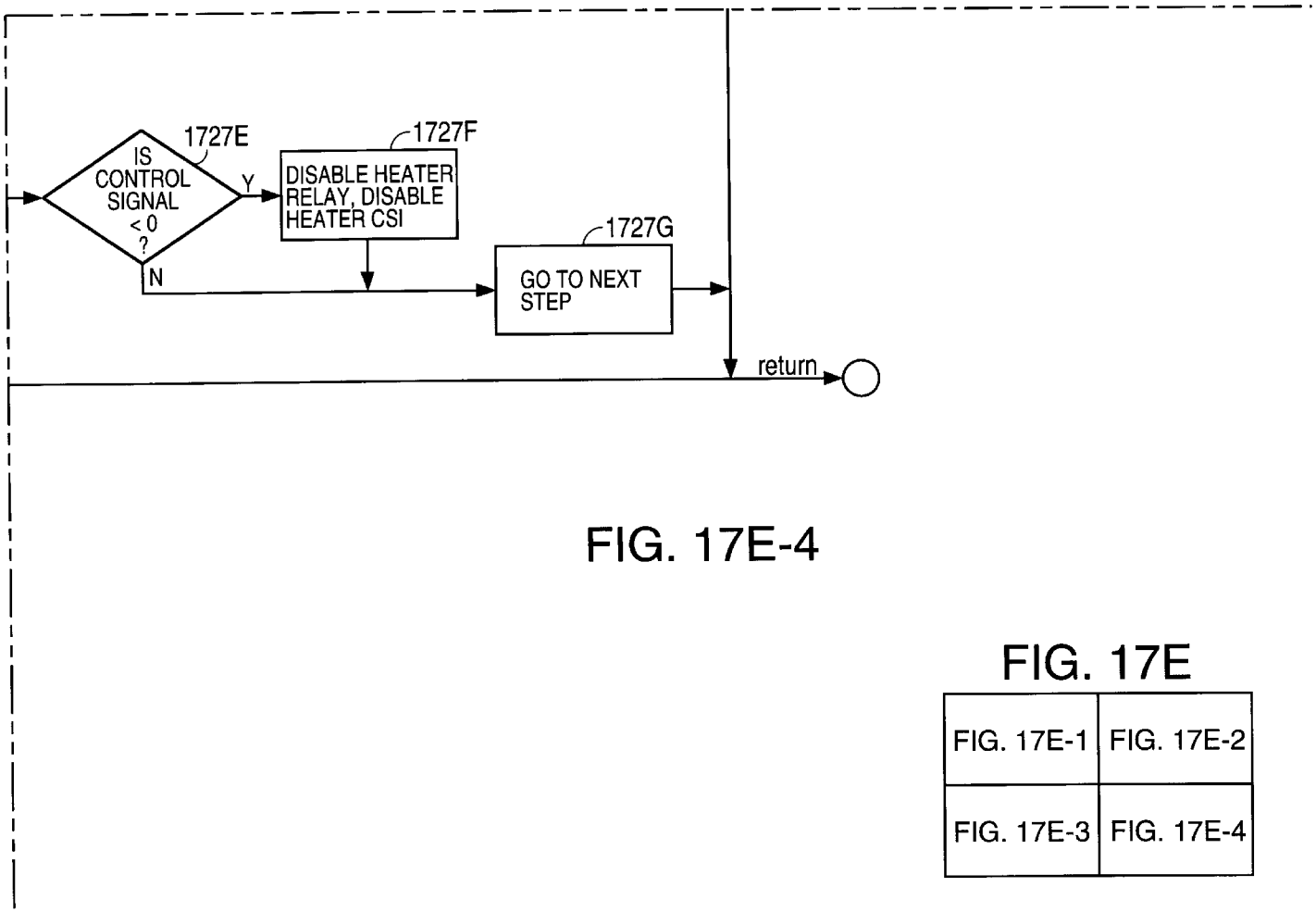
Figure 17F:
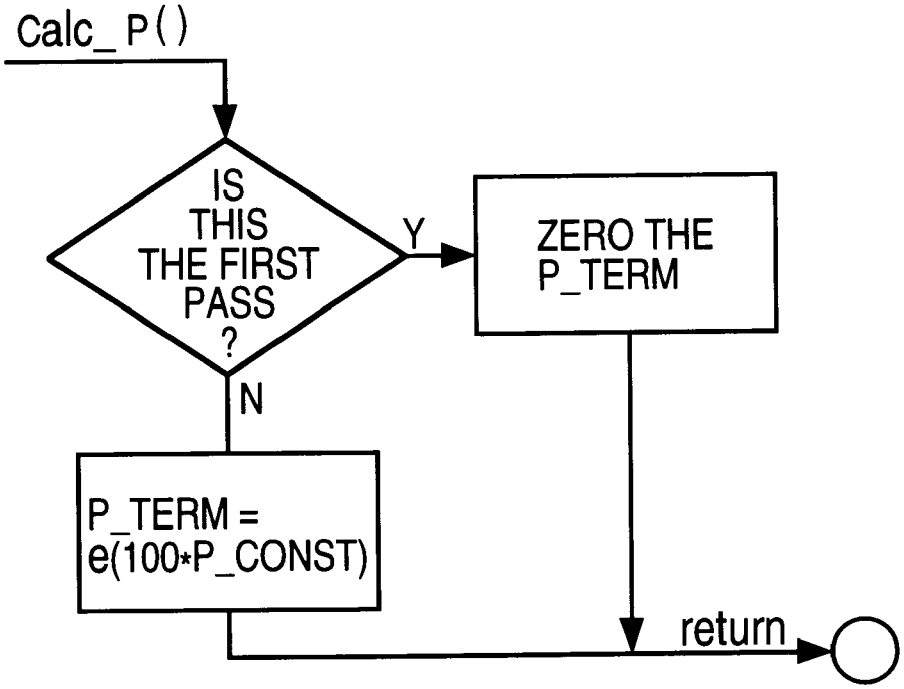
Figure 17G:
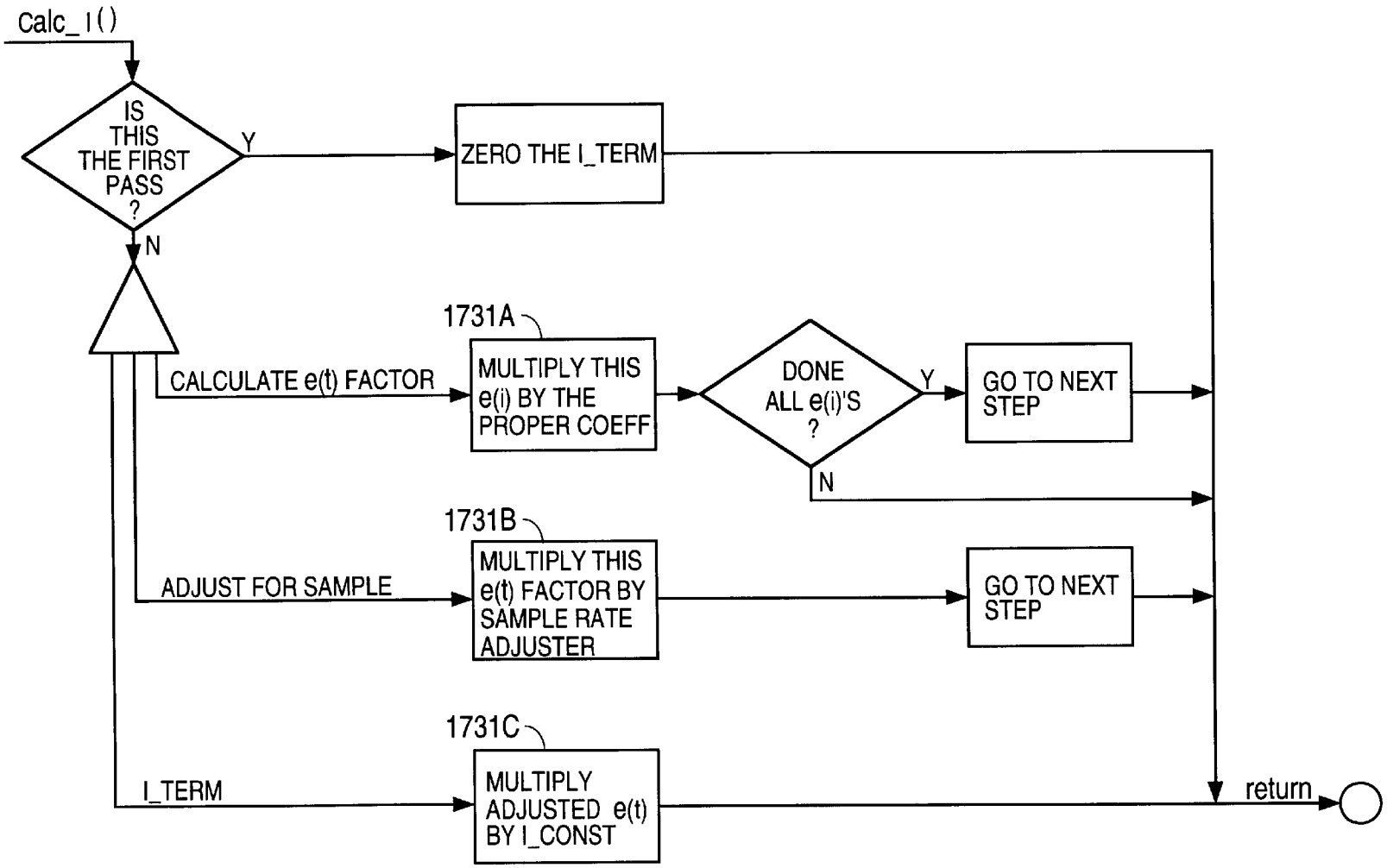

Function regulate_temperature( ) checks in step 1721 (FIG. 17E) to determine the step to be performed, such as one of steps 1722, 1724A, 1725A, 1726A, 1727A, and 1728 and thereafter proceeds to the respective step. In step 1722, function regulate_temperature( ) waits for a flag that indicates availability of a new error signal e, in which case function regulate_temperature( ) proceeds to the next step in step 1723. In step 1724A, function regulate_temperature( ) calls a function CALC_P( ) that computes the product of the latest error signal and the variable P_TERM (FIG. 17F). In step 1724B, function regulate_temperature( ) checks whether the P_TERM computation was completed and thereafter goes on to the next step in step 1724C. In step 1725A, function regulate_temperature( ) invokes function calc_I( ) (FIG. 17G) that computes the Newton-Cotes integral of the error signal as follows:

$$\mathrm{int}(e)_0^3=(3^* H)/8^*(e_0+3e_1+3e_2+3e_3)$$

where $e_0$ is the latest error signal, $e_3$ is the oldest error signal and H is the sampling rate (2.4 seconds in this embodiment). Function calc_I( ) implements the above formula in two steps 1731A–1731B. In step 1731A, function calc_I( ) calculates the $e_t$ terms of the righthand $e_t$ factor of the above formula, one per pass, requiring a total of four passes. In step 1731B, function calc_I( ) multiplies the $e_t$ factor by the sample rate adjustor.

In step 1731C, function calc_I( ) multiplies the adjusted $e_t$ by the value of the variable I_CONSTANT, to determine how oven 210 has responded in the past to heating element 415.

Figures 1, 17H:
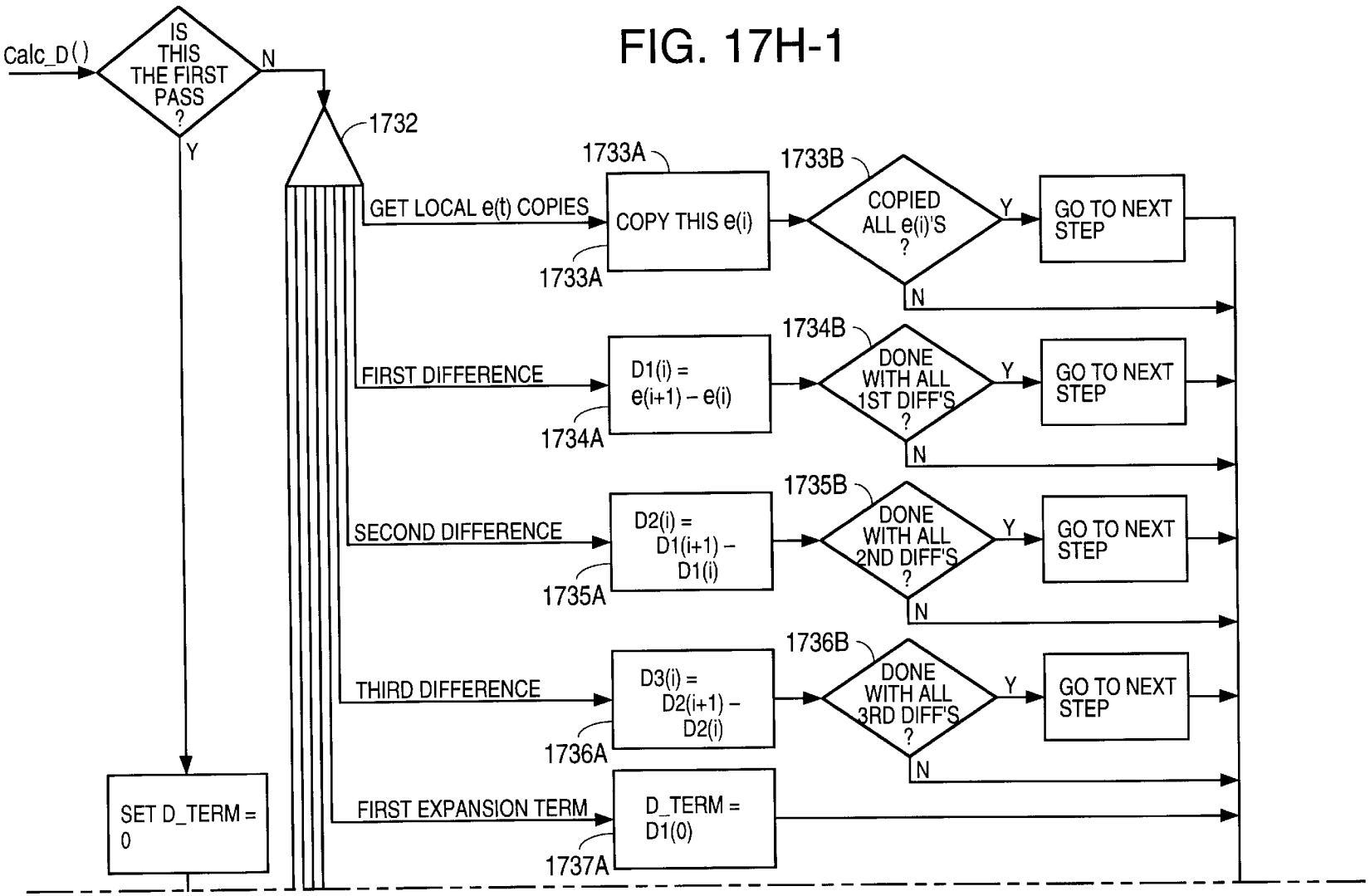
Figures 2, 17H:
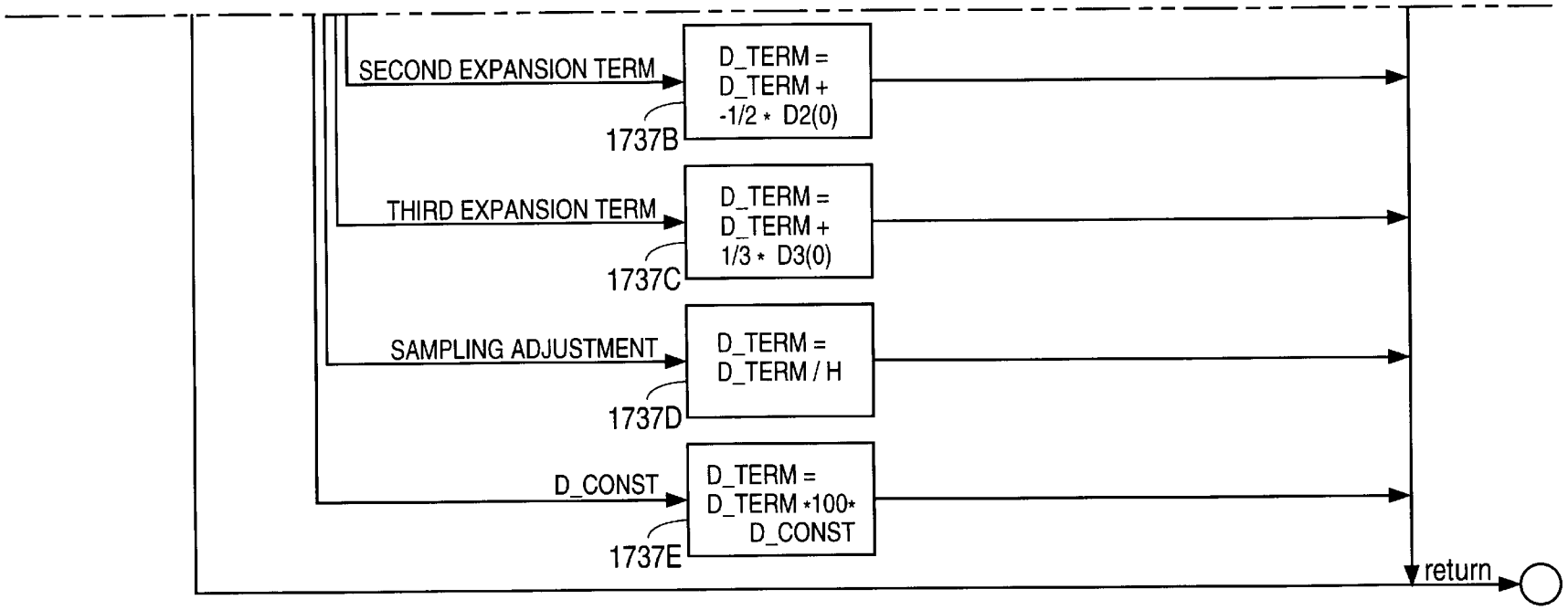

Referring back to FIG. 17E, function regulate_temperature( ) calculates the variable D_TERM by calling the function calc_D( ) in step 1726A. Function calc_D( ) computes an interpolation polynomial of the first derivative of the error signal according to the following formula:

$$e'(e_0)=1/H*(\Delta e_0-\tfrac{1}{2}*\Delta^2 e_0+\tfrac{1}{3}*\Delta^3 e_0-\tfrac{1}{4}\Delta^4 e_0)$$

where H is again the sampling rate, $e_0$ is the latest error signal and $\Delta^n e_0$ is the nth difference of $e_0$. As illustrated in FIG. 17H, function calc_D( ) implements the above formula in a multipass case switch in step 1732. In step 1733A, function calc_D( ) gets a local copy of the $e_t$ values, in four passes. In step 1733B, function calc_D( ) checks to see if all of the $e_t$ values have been copied, and then proceeds to the next step In step 1734A, function calc_D( ) calculates the first differences in 3 passes using the formula:

$$\Delta^2 e_0=(e_1-e_0)-(e_3-e_2)$$

Then in step 1734B, function calc_D( ) checks to see if all of the first differences have been computed and then proceeds to the next step. Similarly, function calc_D( ) computes the second differences in step 1735A, checks completion of the computation in step 1735B, goes to the next step and computes third differences in step 1736A, and checks completion of the third difference in step 1736B and then proceeds to the next step.

In subsequent steps 1737–1741, function calc_D( ) computes the first, second and third expansion terms, does a sample adjustment and multiplies by the variable D_CONSTANT respectively. Then function calc_D( ) returns to function regulate_temperature( ) which checks for completion of the D terms computation in step 1726B and then goes to the next step in step 1726C (FIG. 17E).

In step 1727A, function regulate_temperature( ) calculates the control_signal CS using the following formula:

$$\text{control_signal } CS=(100.0/FB)*(P_\text{term}+I_\text{term}+D_\text{term})$$

The 100/PB factor is a band of temperature factor.

Then function regulate temperature( ) confirms that oven 210 is to be controlled in step 1727B, checks that the control signal has a magnitude greater than 0 in step 1727C and then drives signal HEATER high on hot air impingement control line 1511 (FIG. 15). As described above the signal HEATER on line 1511 controls power supply to heating element 1515.

Figure 17I:
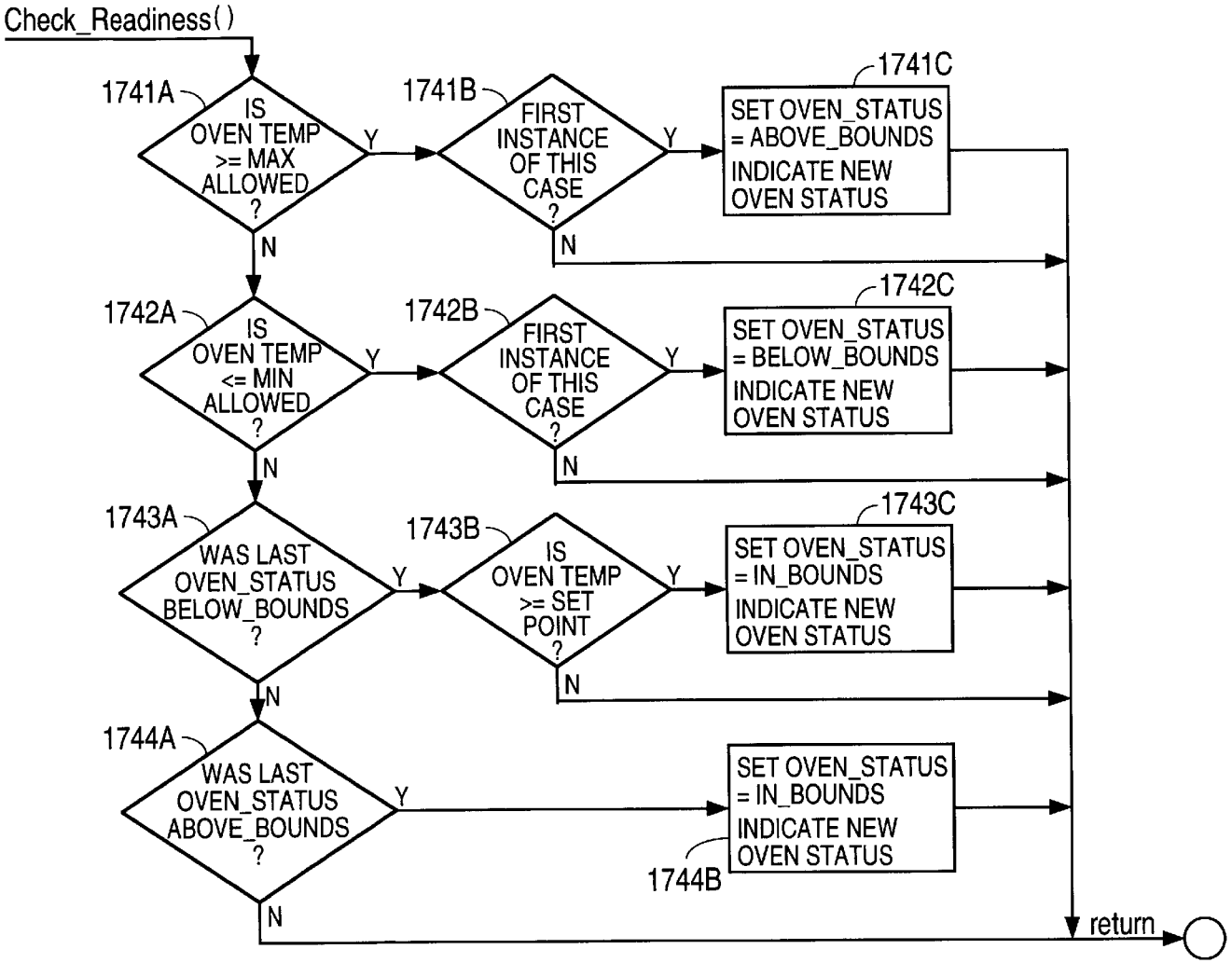

Function regulate_temperature( ) disables heating element 1515 in step 1727F if the control signal CS has a magnitude less than 0 in step 1727E and the proceeds to the next step in step 1727G. In step 1728, function regulate_temperature( ) determines if the current oven temperature is within the band of regulation centered around the set point temperature by invoking function Check_Readiness( ) (FIG. 17I).

Function Check_Readiness( ) checks if the oven temperature signal OVENTEMP indicates a temperature greater than an upper operational boundary (set at 50° F. above the set point temperature in this embodiment, with a ceiling value for the upper operational boundary of 500° F.). If so, function Check Readiness( ) checks if this is the first instance of this condition in step 1741B and then sets a flag OVEN_STATUS to the value ABOVE_BOUNDS in step 1741C to indicate the new oven status. Similarly, function Check_Readiness( ) checks if the current oven temperature is below a lower operational boundary (of 30° below the set point temperature in this embodiment), in step 1741A. In such a case, function Check_Readiness( ) checks if this was the first occurrence of this condition in step 1742B and then sets the flag OVEN_STATUS to the value BELOW_BOUNDS in step 1741C to indicate the new oven status.

In step 1743A, function Check_Readiness( ) checks if the variable OVEN_STATUS has the value BELOW_BOUNDS. If so, function Check_Readiness( ) checks if the current oven temperature is greater than or equal to the set point temperature in step 1743B and then if so, sets the variable OVEN_STATUS to the value IN_BOUNDS in step 1743C to indicate the new oven status. Similarly, function Check_Readiness( ) checks if the value of variable OVEN_STATUS is equal to the value ABOVE_BOUNDS in step 1744A, and if so sets the value of variable OVEN_STATUS to IN_BOUNDS in step 1744B to indicate the new status.

Referring back to FIG. 17E, function regulate_temperature( ) returns to the next idle step 1722 in step 1729, after invoking the function Check_Readiness( ) in step 1728. In one specific embodiment, function regulate_temperature( ) maintains the temperature of oven 210 within a regulation band of 3° F. around a default temperature of 420° F., when oven 210 is idling.

Figures 1, 17J:
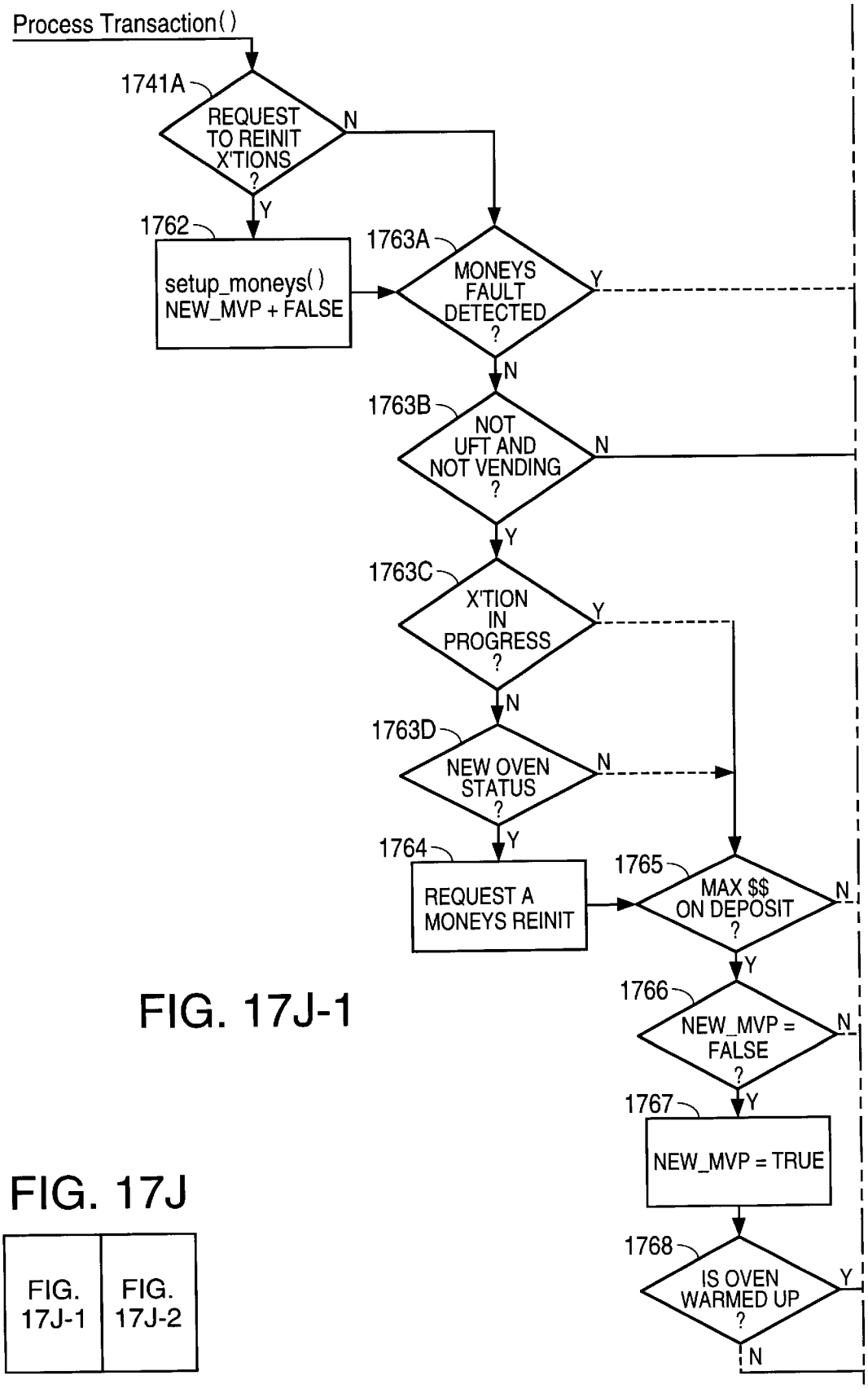
Figures 2, 17J:
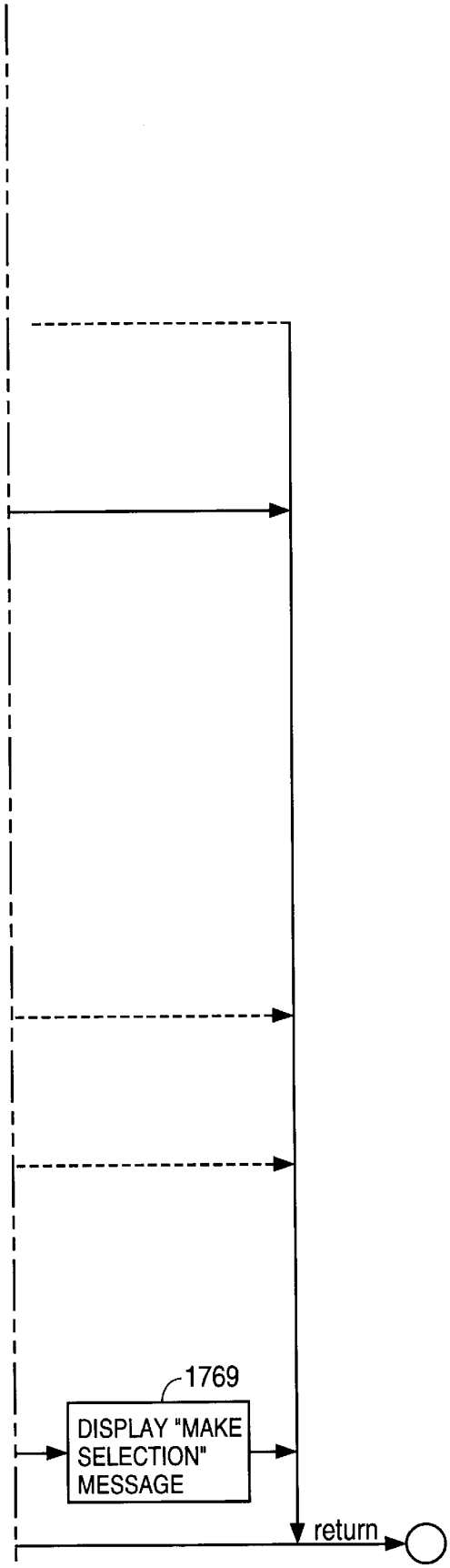

Customer initiated transactions of vending machine 100 during a failure condition indicated by the value of variable OVEN_STATUS other than IN_BOUNDS are controlled in a function monies( ) that in turn calls function Process_Transaction( ) (FIG. 17J). Function Process_Transaction( ) checks in step 1761 for a request to reinitiate transactions. If so, function Process_Transaction( ) invokes function setup_monies( ) in step 1762 and also sets the flag NEW_MVP to false.

Figure 17K:
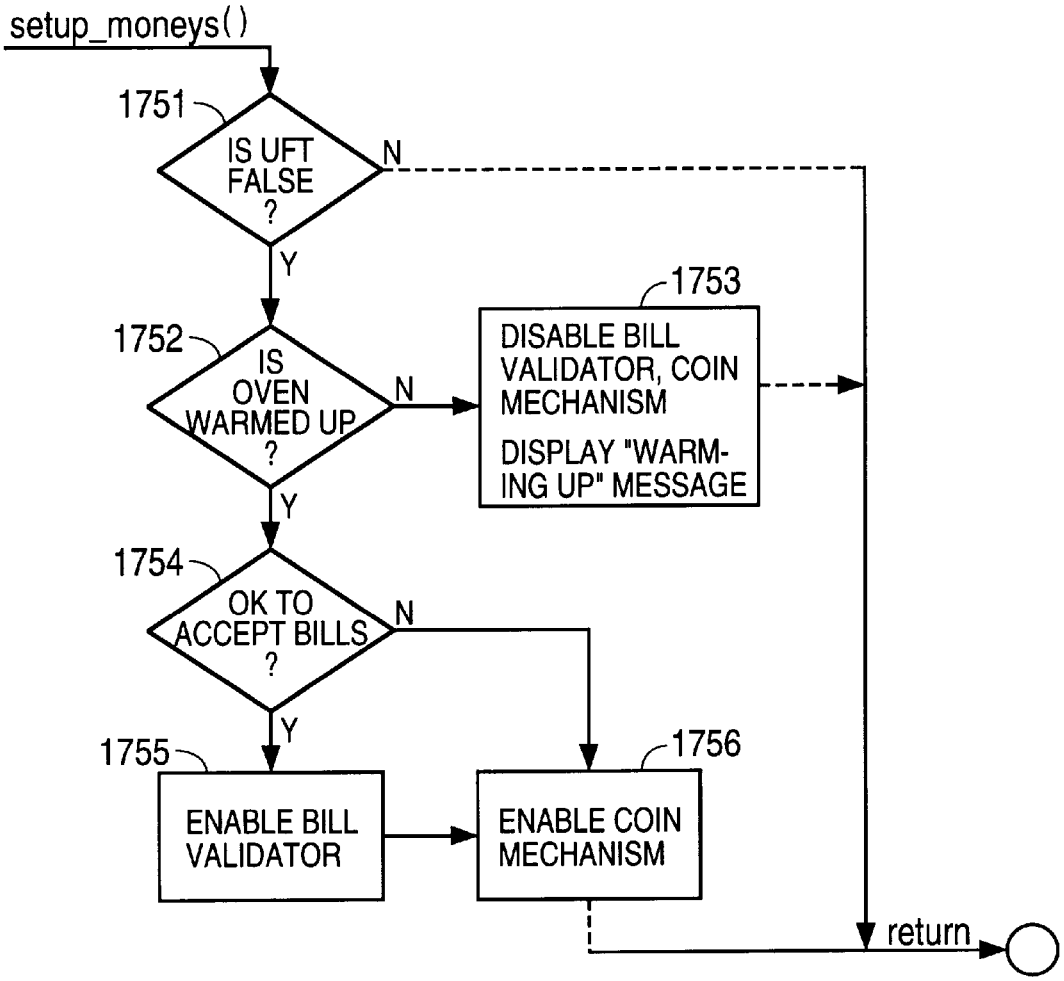

Function setup_monies( ) (FIG. 17K) checks if flag UFT is false in step 1751. Flag UFT when true indicates that vending machine 100 is unavailable for transaction, for example, due to the occurrence of a fault condition. If so, function setup_monies( ) checks to see if the oven is warmed up in step 1752, by comparing the value of the variable Oven_Status with IN_BOUNDS. If the variable Oven_Status has a value anything other than IN_BOUNDS, function setup_monies( ) disables operations of bill acceptor mechanism 207 (FIG. 15) and coin mechanism 106B in step 1753 and displays the failure message "WARMING UP". If the oven is warmed up, function setup_monies( ) checks to see if bills can be accepted in step 1754, and if so, goes to step 1755 that enables acceptance of bills by bill acceptor 207. Then function setup_monies( ) goes to step 1756 and enables the coin mechanism 106B.

Referring back to FIG. 17J, the function Process_Transaction( ) performs a number of checks in steps 1763A–1763D, such as money related fault conditions, ongoing vending process, or unavailable for transaction status Then function Process_Transaction( ) performs a number of steps 1764–1767 to avoid free vending of food products, and then again checks if oven is warmed up in step 1768 in a manner similar to that described above in reference to step 1752. If so, function Process_Transaction( ) displays the message "MAKE_SELECTION" in step 1769 and then returns to function monies( ).

The setpoint temperature, as well as the high and low operational boundaries can be set by an operator through the keypad 1402, for example, by entering command code 48. Moreover, an operator can use command code 49 to program a setpoint offset to indicate that oven 210 is running above or below a setpoint temperature Setpoint offset is used by step 1705 in function sample_temperature( ) as described above in reference to FIG. 17C.

In addition to oven thermocouple monitor 1518 described above, oven 210 includes, in one embodiment, another oven control device namely magnetron current monitor 1517 (FIG. 18) that monitors the state of magnetrons 303 and 1303. To operate magnetrons 303 and 1303, control board 208 drives a magnetron enable signal NAGS. Signal MAGS when active causes magnetron relay RLY5 to close a power supply switch 1801 and thereby apply power to magnetrons 303 and 1303.

Magnetrons 303 and 1303 have return circuits connected respectively to diodes D1 and D2. Diodes D1 and D2 in turn are connected through resistors R1 and R2 to ground, thereby to sense the current drawn by magnetrons 303 and 1303. The voltage across resistors R1 and R2 is clamped by Zener diodes CR1 and CR2. Diodes D6 and D7 rectify the time varying signal to provide a direct current (DC) value at terminals 3 and 10, respectively of amplifiers U1A and U1C.

Amplifiers U1A and U1C are voltage followers with diodes D8 and D9 at the outputs preventing capacitors C1 and C2 from discharging through the amplifiers during half the cycle of low voltage. Resistors R3, R4, R5 and R6 and capacitors C1, C2 provide AC to DC filtering, while amplifiers U1B and U1D provide a gain of 4. The signals at terminals 7 and 14 of amplifiers U1B and U1D are compared by comparators U2A and U2B with a signal having a reference voltage, 4/7 VCC (approximately 10 volts in this embodiment). Terminals 1 and 2 of comparators U2A and U2B carry VCC signals if the DC voltage contributed by the current through the respective magnetron is greater than the reference voltage of 10 volts. Resistors R16 and R17 provide positive feedback and induce hysteresis to provide a stable signal at terminals 1 and 2 respectively. The output signals at terminals 1 and 2 are ORed together and supplied at a terminal 10 of a magnetron current comparator U2C.

Comparator U2C drives a magnetron current sense signal *MAGI high only if the signal at each of terminals 1 and 2 is high. In this embodiment, another comparator U2D drives a light emitting diode LED1 in response to high signals at terminals 1 and 2.

Figures 1, 18:
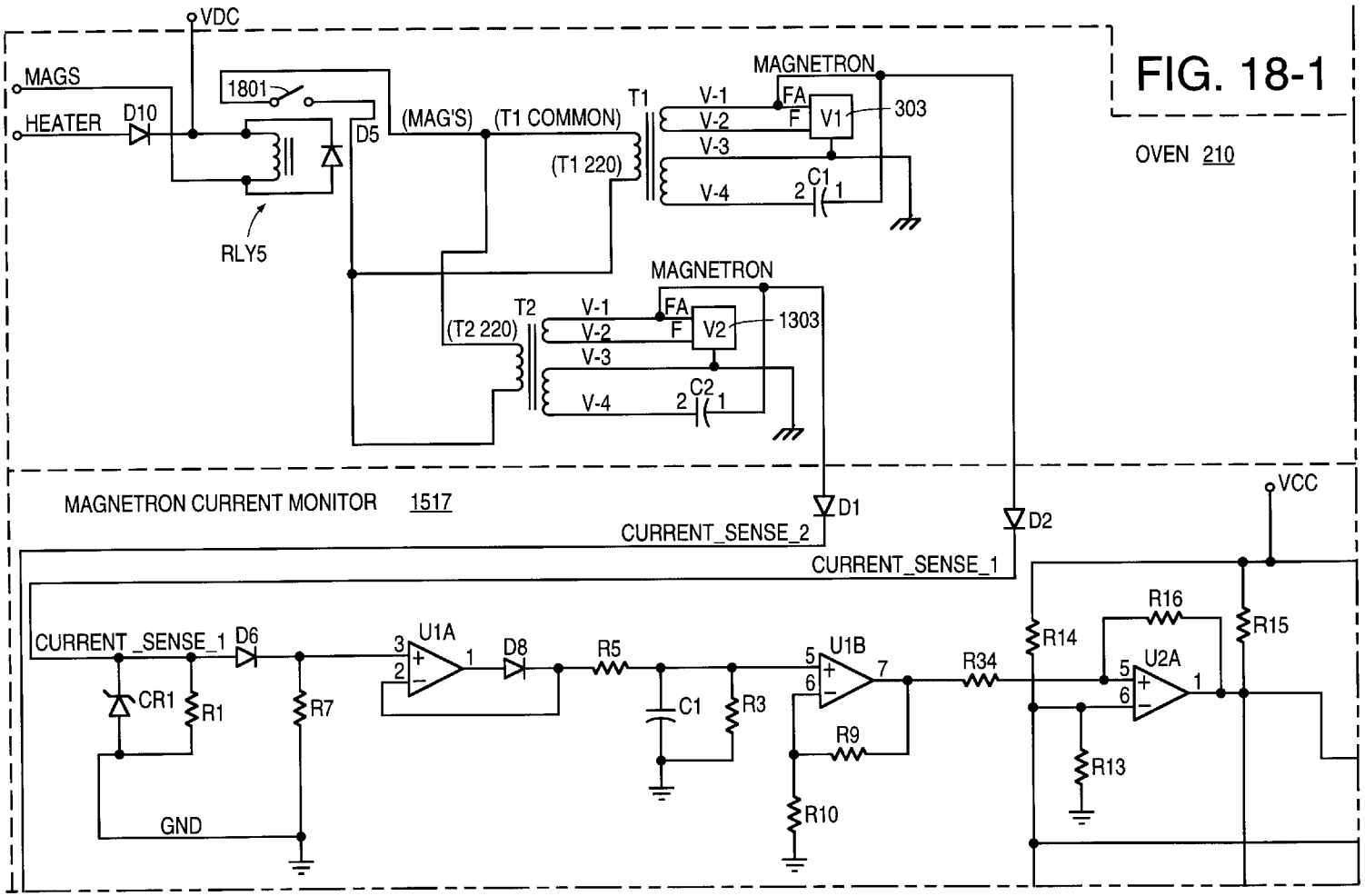
FIG. 18 (including FIGS. 18—1, 18—2, 18—3 and 18—4) is an illustrative circuit diagram of a magnetron current sensor in one embodiment of the oven illustrated in FIG. 15.
Figures 2, 18:
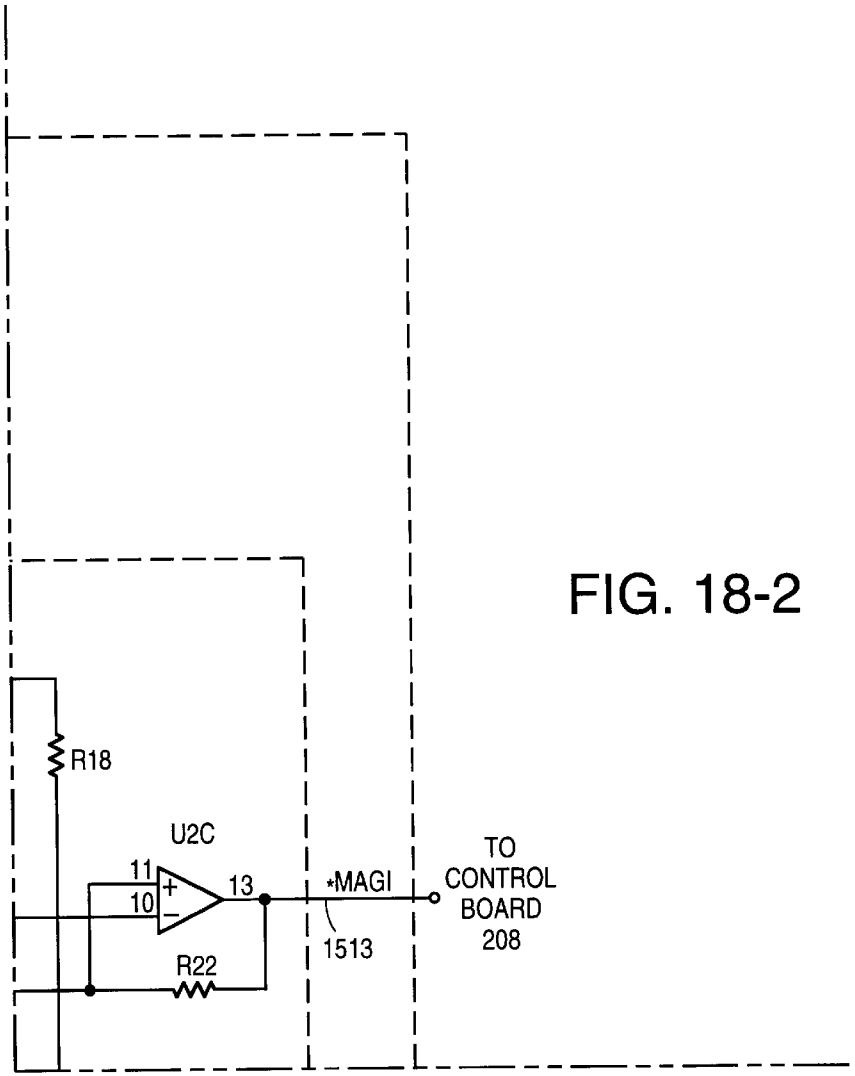
Figures 3, 18:
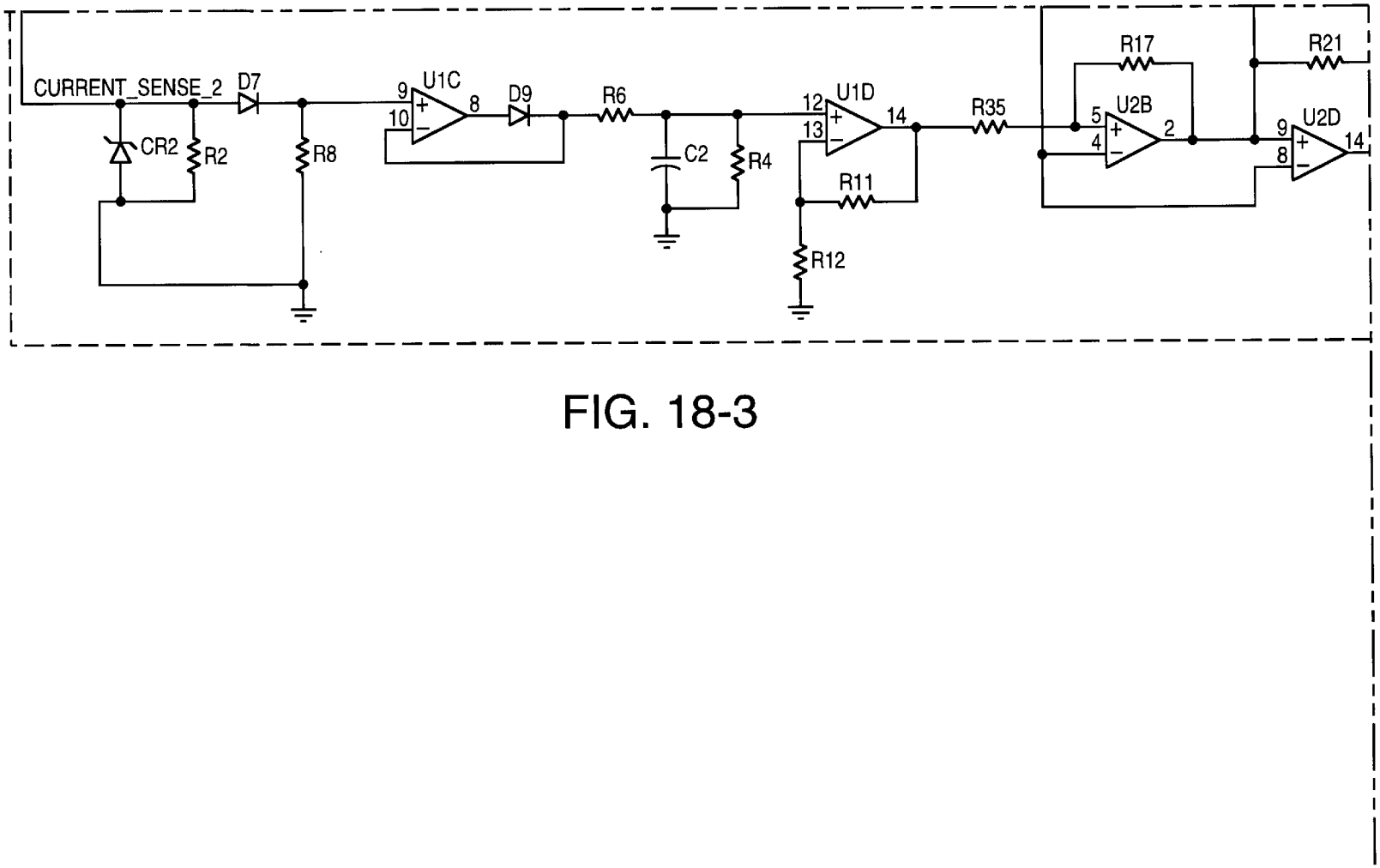
Figures 4, 18:
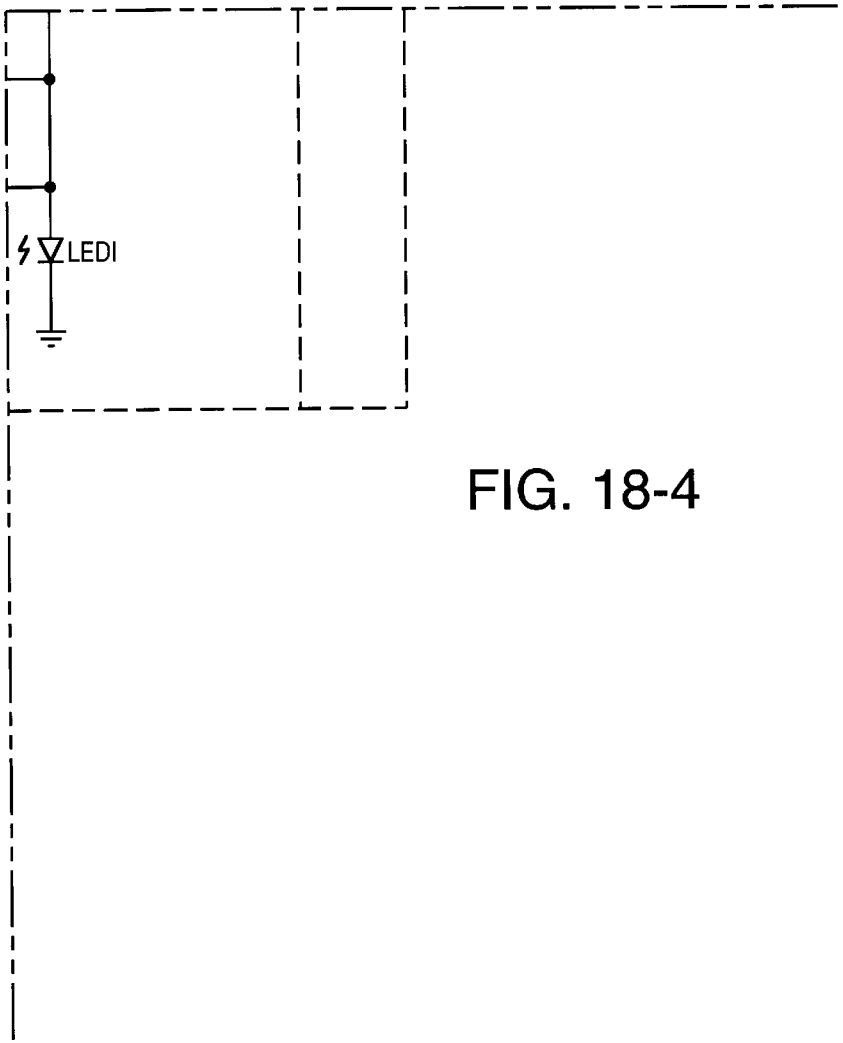
Figure 19:
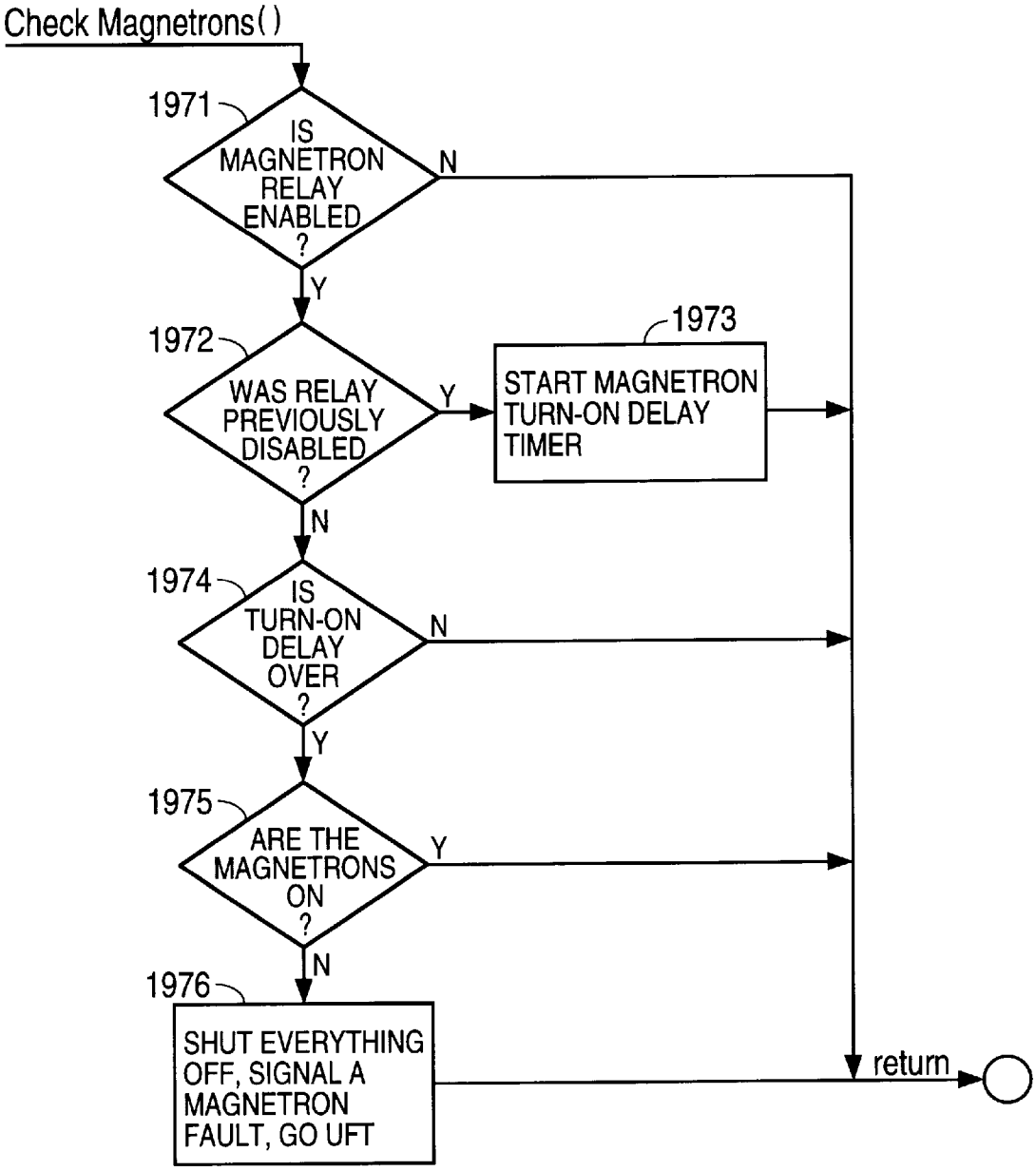
FIG. 19 is an illustrative flow chart for the operation of a microcontroller with the magnetron current sensor of FIG. 18.

Microcontroller 1404 on control board 208 receives and monitors signal *MAGI when executing function Check_Magnetrons( ) (FIG. 19). In step 1971, function Check_Magnetrons( ) checks if magnetron relay RLY5 is enabled, for example by a high signal MAGS If so, function Check_Magnetrons( ) determines if magnetron relay RLY5 (FIG. 18) was previously disabled in step 1972. If so, function Check_Magnetrons( ) starts a magnetron turn-on delay timer in step 1973. Otherwise, in step 1974, function Check_Magnetrons( ) checks if the turn-on delay is over (in one specific embodiment, the turn-on delay is 5 seconds). If so, function Check_Magnetrons( ) checks to see if the magnetrons have been turned on in step 1975, as indicated by the active low signal *MAGI. If the signal *MAGI is inactive, e.g. high, function Check Magnetrons( ) decides that a fault condition has occurred, and suspends vending operations in step 1976.

In an example, illustrated in FIG. 18, the component ratings are listed in Table 2 below.

TABLE 2

(see FIG. 18)

| Component | Rating |
|---|---|
| VDC | 24 |
| D10 | 1N4004 |
| D5 | 1N4004 |
| T1 | 220 |
| T2 | 220 |
| V-1 | 3.8 |
| V-2 | 3.8 |
| MAGNETRON | 2M107A |
| V-3 | 2.1K |
| V-4 | 2.1K |
| Cl | 0.86 MFD |
| C2 | 0.86 MFD |
| VCC | 18 VDC |
| D6 | 1N4004 |
| R1 | 5(10 W) |
| R7 | 100K |
| UlA | LM324 |
| D8 | 1N4004 |
| R5 | 4.7K |
| C1 | 0.22 u |
| R3 | 200K |
| U1B | LM324 |
| R9 | 100K |
| R10 | 30.1K |
| R34 | 100K |
| R14 | 75.0K |
| R13 | 100K |
| R16 | 1M |
| U2A | LM339 |
| R15 | 10K |
| R18 | 1.2K |
| U2C | LM339 |
| R22 | 1M |
| R2 | 5(10 W) |
| D7 | 1N4004 |
| R8 | 100K |
| U1C | LM324 |
| D9 | 1N4004 |
| R6 | 4.7K |
| C2 | 0.22 u |
| R4 | 200K |
| R12 | 30.1K |
| U1D | LM324 |
| R11 | 100K |
| R35 | 100K |
| R17 | 1M |
| U2B | LM339 |
| R21 | 1M |
| U2D | LM339 |

A freezer thermistor monitor 1526 in freezer 213 (FIG. 20) includes a thermistor 2031 that senses the temperature inside freezer 213. Thermistor 2031 drives signals THRM1 and THRM2.

Thermistor 2031 (FIG. 20) is connected in a bridge configuration, forming the fourth leg of a bridge 2010 that includes resistors R5, R6 and R7. An operational amplifier U1A divides a reference voltage of 18 volts to the 3 volts DC provided to bridge 2010. One leg of bridge 2010 is connected to pin 5 of differential input amplifier U1B and the other leg of bridge 2010 is connected to the other pin 6 of amplifier U1B. The voltage at terminal 7 of amplifier U1B is the voltage at terminal 2051 (e.g. at one terminal of thermister 2031) minus the voltage at terminal 2052 (e.g. between resistors R7 and R6). Amplifier U1C receives the output from terminal 7 of amplifier U1B and amplifies the received signal by a gain of 6. The A comparator U2B compares the output at terminal 8 of amplifier U1C with a reference voltage and drives a signal *HITEMP. The signal at input terminal 5 of comparator U2B is representative of a predetermined over-temperature limit of freezer 213. A similar comparator U2A drives an LED signal active to indicate an over-temperature condition in freezer 213.

Figure 20A:
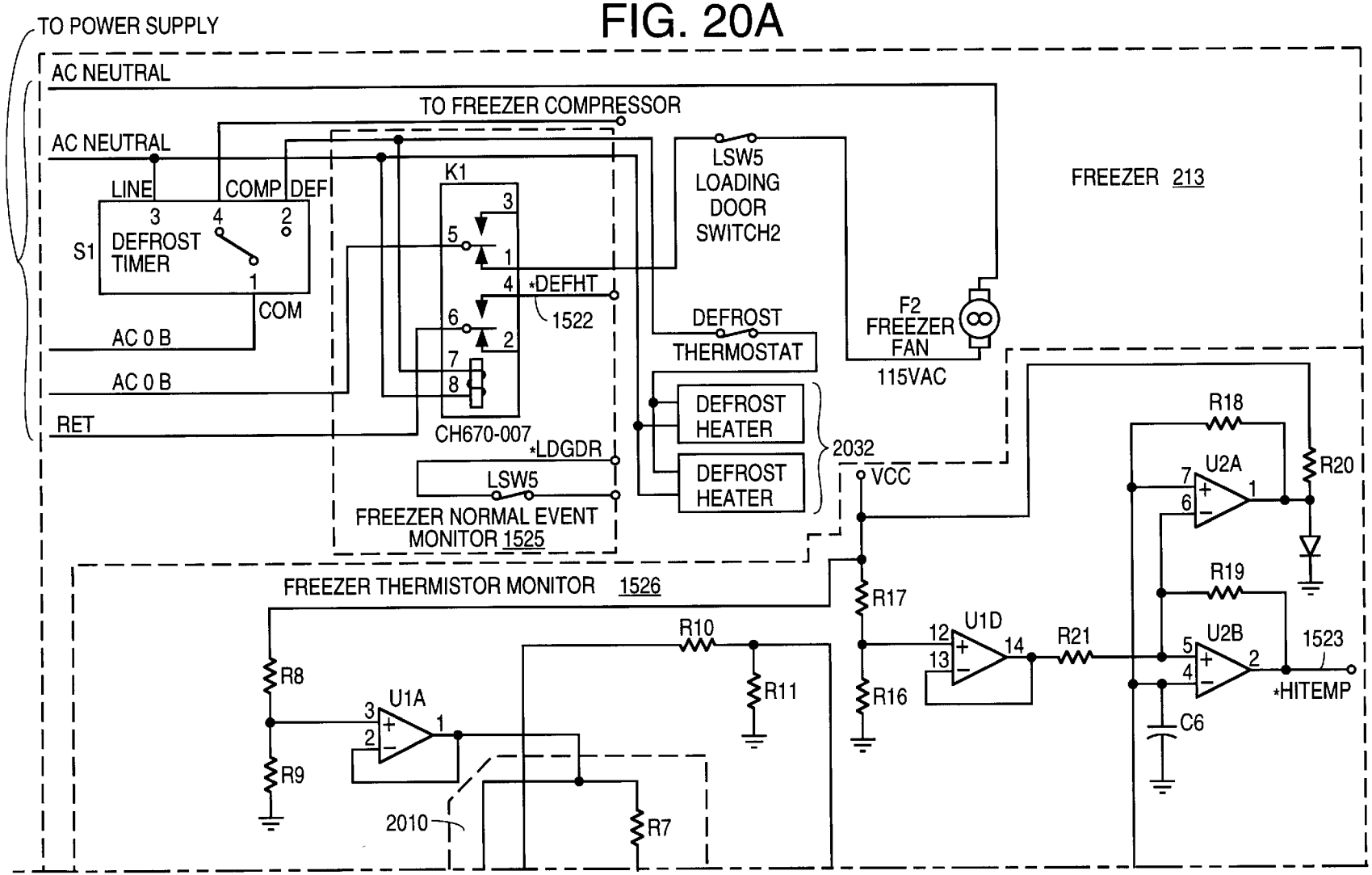
FIG. 20 (including FIGS. 20A and 20B) is an illustrative circuit diagram of a freezer thermistor monitor in one embodiment of the freezer illustrated in FIG. 15.
Figures 20, 20B:
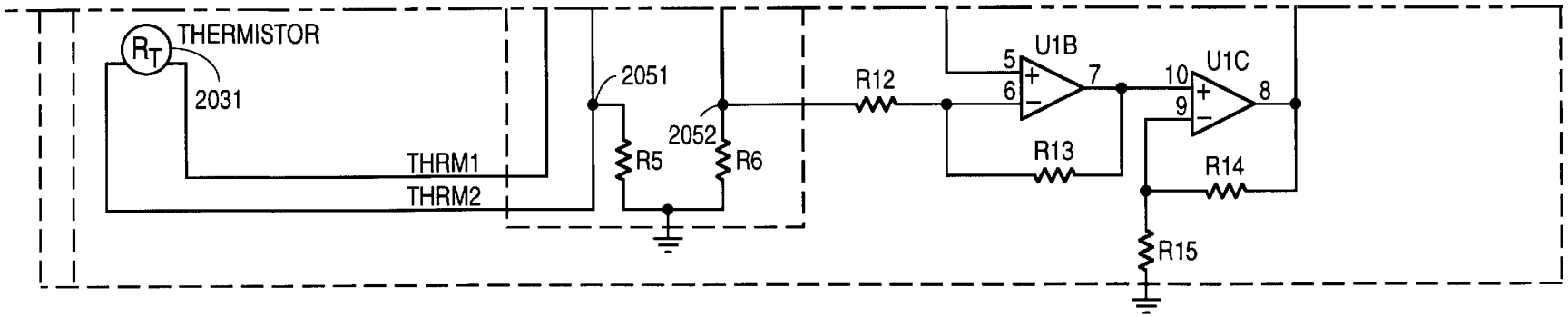

Freezer event monitor 1525 includes a defrost relay K1 that drives a defrost signal *DEFHT on line 1522 low when defrost timer S1 goes into the defrost mode and supplies power to defrost heaters 2032 (FIG. 20).

Defrost timer S1 is a conventional defroster with a rotary timer driven by a small motor that automatically supplies power to the defrost heater once every 24 hours for a short period of time, such as 5 minutes. When defrost timer S1 commands its relay into the defrost mode, the voltage applied to defrost heaters 532 is also applied to terminals 7 and 8 of relay K1. Therefore pin 6 of relay K1 that is connected to the 5 volt return circuit is connected by relay K1 to pin 4 that drives the signal *DEFHT. Therefore when defrost timer S1 goes into the defrost mode, signal *DEFHT goes to ground.

In the defrost mode of defrost timer S1, relay K1 also open circuits pin 1 that is connected via refrigeration compartment door switch LSW5 to freezer fan F2. Switch LSW5 is normally closed and is opened by the opening of refrigeration compartment door 203, for example, for loading packaged food products into vending machine 100.

In addition to switch LSW5, freezer event monitor 1525 also includes another refrigeration compartment door limit switch LSW2 that is also opened by opening of refrigeration compartment door 203, so that freezer event monitor 1525 drives signal *LDGDR active low on freezer event line 1524.

Microprocessor 1404 checks the status of freezer 213 periodically, at least once for every pass through main( ) that calls function status( ) that in turn calls function Check_Meltdown( ). Function Check Meltdown( ) implements the various requirements for NAMA certification referenced above.

In one example, illustrated in FIG. 20, the component ratings are listed in Table 3 below.

TABLE 3

(see FIG. 20)

| Component | Rating |
|---|---|
| AC NEUTRAL | 220 V |
| DEFROST TIMER | CH750-004 |
| AC 0 B | 220 V |
| K1 | CH670-007 |
| VCC | 18 VDC |
| R18 | 1M |
| U2A | LM339 |
| R20 | 1.2K |
| R8 | 150K |
| R9 | 30.1K |
| U1A | LM324 |
| R10 | 100K |
| R7 | 178K |
| R11 | 30.1K |
| R17 | 158K |
| R16 | 23.7K |
| U1D | LM339 |
| R21 | 150K |
| R19 | 1M |
| U2B | LM339 |
| C6 | 1 u |
| DC | 3 V |
| R5 | 10.0 |
| R6 | 10.0K |
| R12 | 100K |
| U1B | LM324 |
| R13 | 100K |
| U1C | LM324 |

TABLE 3-continued (see FIG. 20)

| Component | Rating |
|---|---|
| R14 | 100K |
| R15 | 20.0K |

Figure 21A:
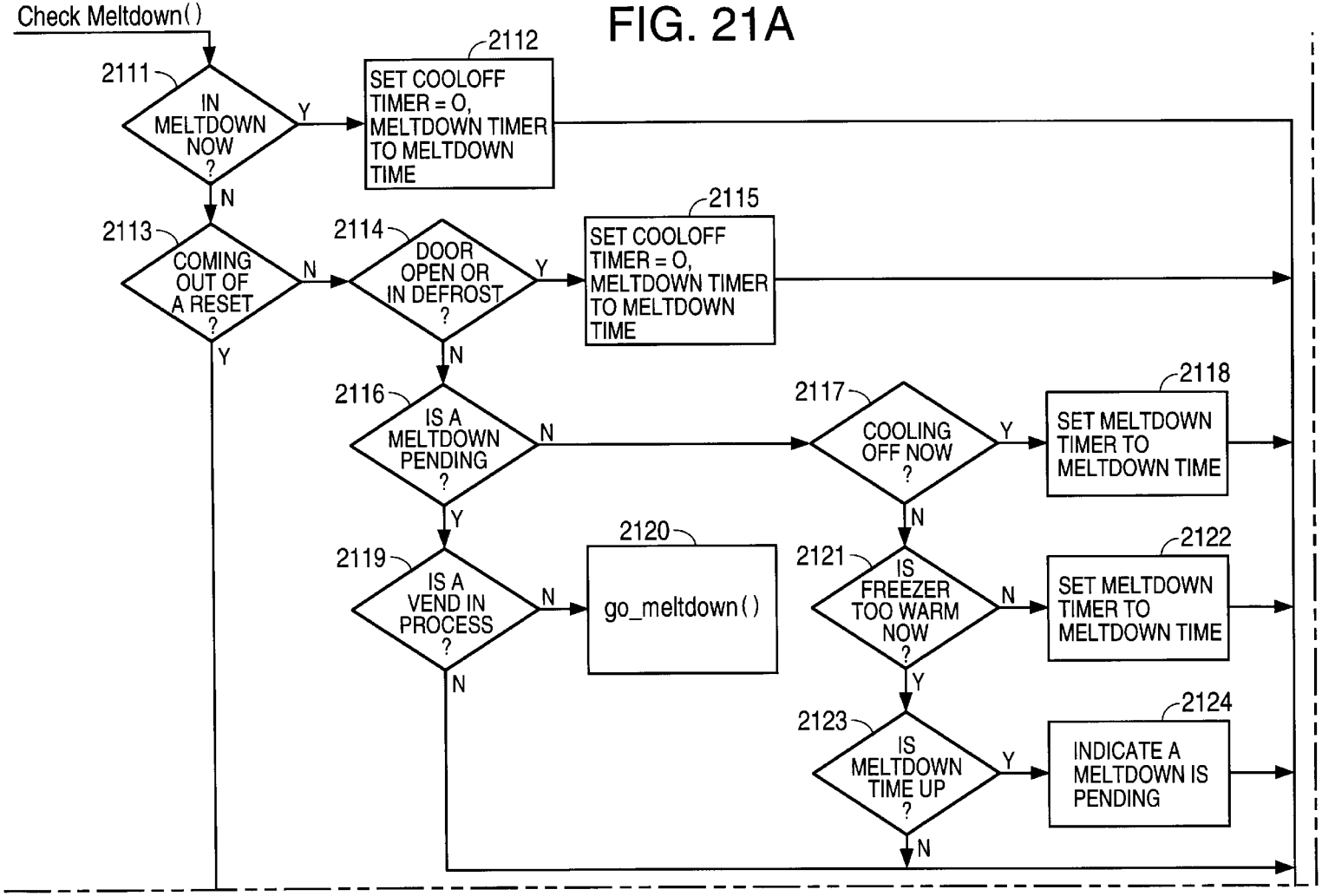
FIG. 21 (including FIGS. 21A, 21B and 21C) is an illustrative flow chart for the operation of a microcontroller with the freezer thermistor monitor of FIG. 20.
Figure 21B:
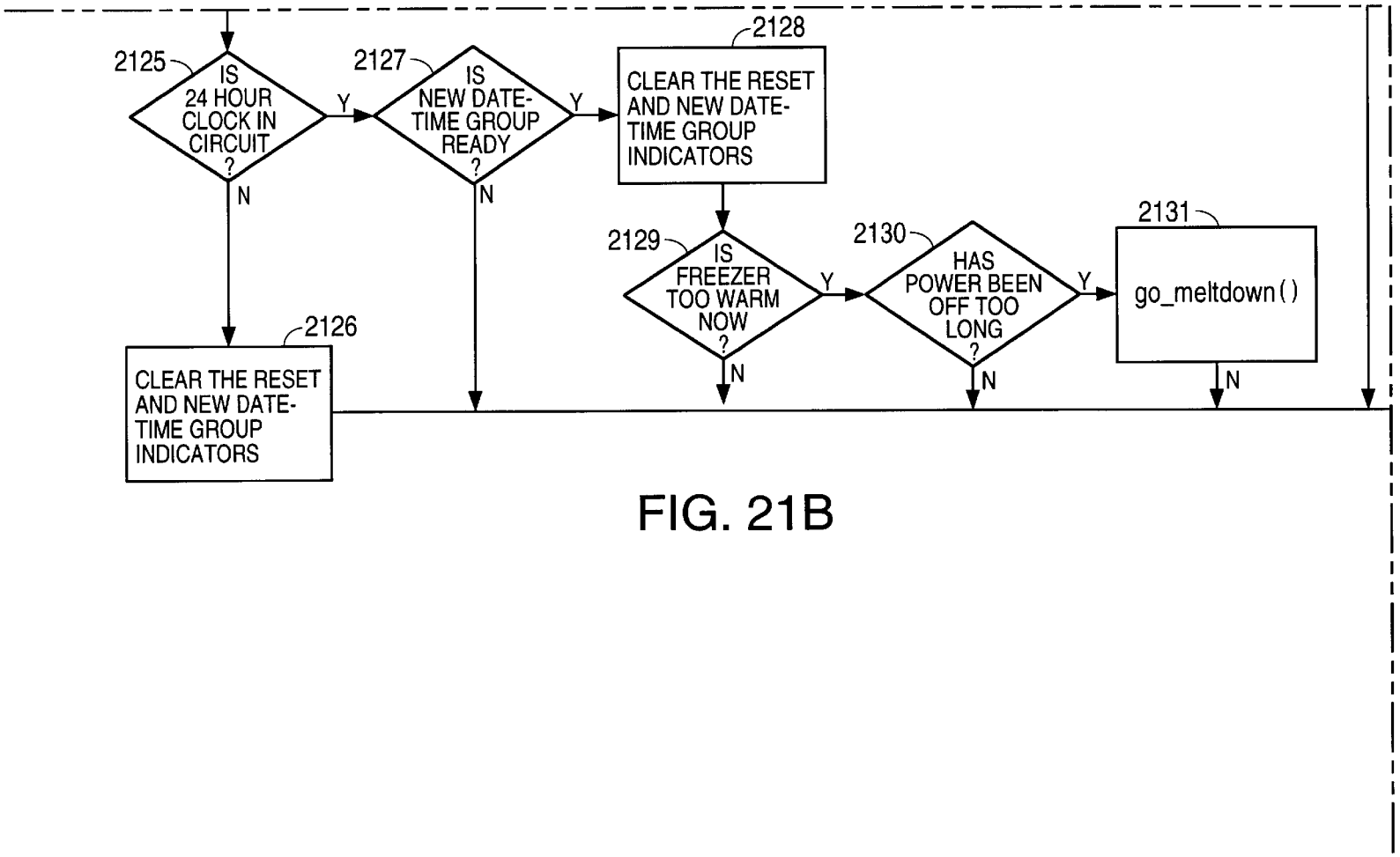
Figure 21:
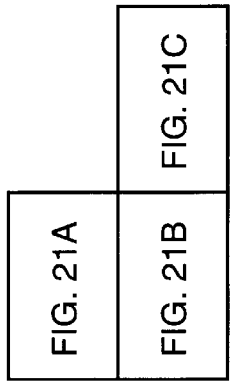
Figure 21C:
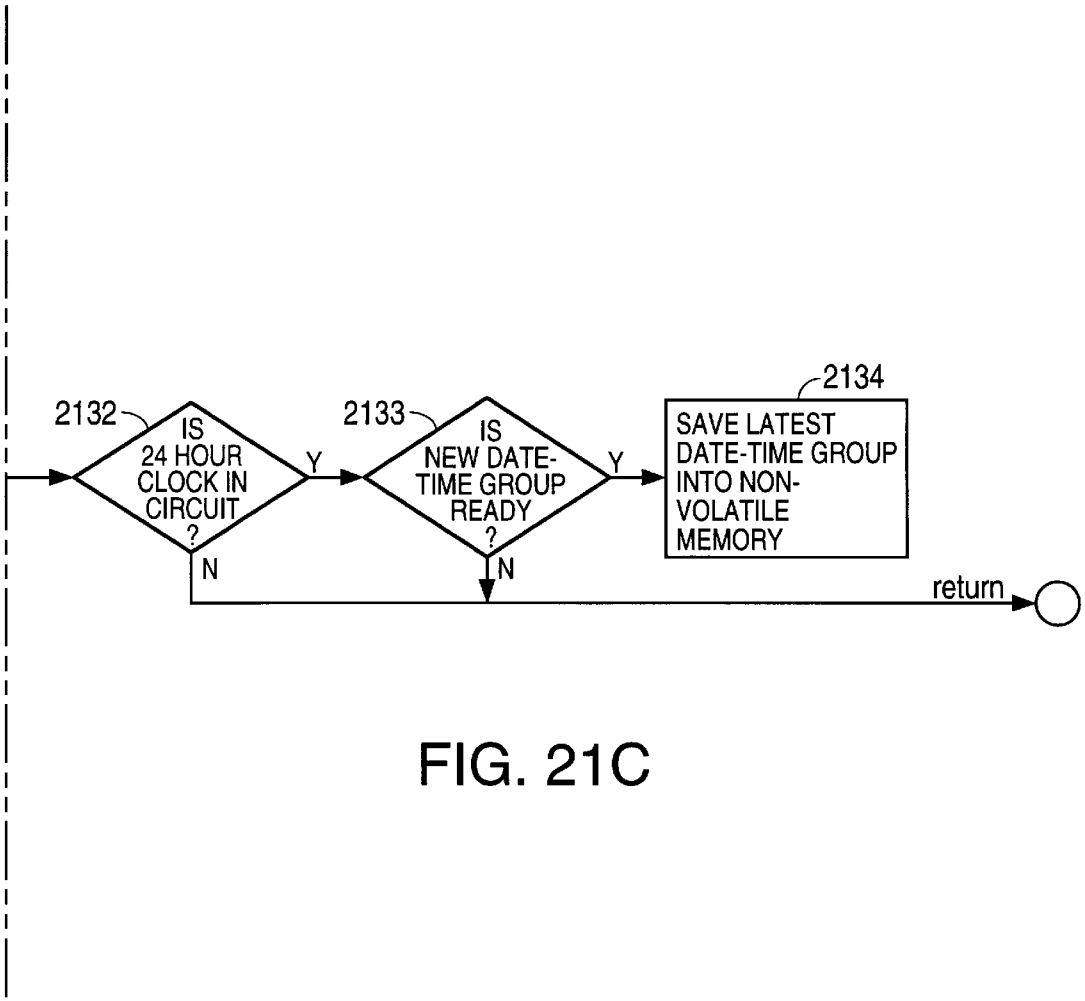

Function Check_Meltdown( ) initially checks whether vending machine 100 is currently carrying a meltdown fault condition in step 2111 (FIG. 21). If so, function Check_Meltdown( ) initializes variables, for example setting variable cool off timer to zero, and variable meltdown timer to the meltdown time and then goes to step 2132 described below.

Function Check_Meltdown( ) also checks the status of signal *HITMP during normal operation of vending machine 100, and executes the function go-meltdown( ) after a predetermined duration following the closing of the freezer door as indicated by signal *LDGDR or a defrost cycle as indicated by signal *DEFHT in the steps 2114–2124.

Specifically, in step 2114, function Check_Meltdown( ) checks to see if either one of signals *DEFHT and *LDGDR are active. If so, function Check_Meltdown( ) initializes variables in step 2115 (similar to that in step 2112 described above). Otherwise, function Check_Meltdown( ) checks to see if a meltdown pending flag is set in step 2116. If so, function Check_Meltdown( ) checks to see if a vending operation is currently in progress in step 2119. If a vending operation is not in progress, function Check_Meltdown( ) executes function go_meltdown( ) in step 2120. If a meltdown pending flag is not set in step 2116, function Check_Meltdown( ) checks to see in step 2117 if a cool off period is currently in progress. If so, function Check_Meltdown( ) initializes variables, for example by setting the meltdown timer to the meltdown time in step 2118. If the cooling off period has been completed, function Check_Meltdown( ) checks in step 2121 for the status of signal *HITMP to confirm that the freezer is too warm If so, function Check_Meltdown( ) checks to see if a meltdown time has passed in step 2123. If so, function Check_Meltdown( ) indicates in step 2124 that meltdown is pending. If the freezer is not too warm, as indicated by a high signal *HITMP, function Check_Meltdown( ) sets variables, for example by setting the meltdown timer to the meltdown time in step 2122.

Figure 14:
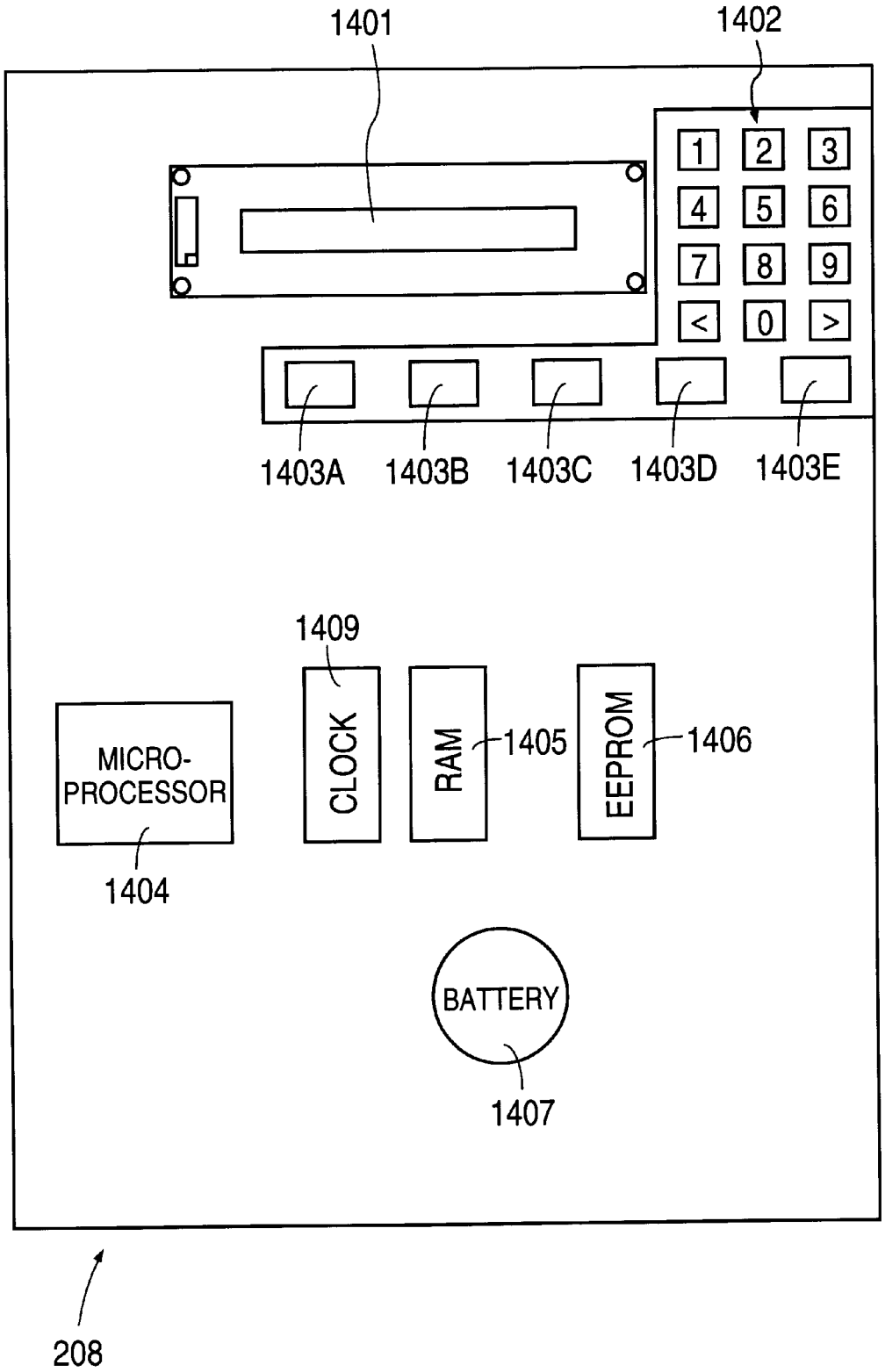
FIG. 14 shows an illustrative layout of the controller board of the vending machine illustrated in FIG. 2.

In step 2132, microprocessor 1404 checks for the existence of real time clock 1409 (FIG. 14). Then in step 2133, function Check-Meltdown( ) checks if the date and time have been determined by the clock management functions from signal REAL_TIME (FIG. 15) on line 1509 connected to real time clock 1409, and then saves the date and time as a signal CURRENT_TIME in a storage location in RAM 305 in step 2134.

Function Check_Meltdown( ) also checks for freezer being warmed up due to a power loss by comparing signals REAL_TIME and CURRENT_TIME. Specifically, in step 2113, function Check_Meltdown( ) checks whether vending machine 100 has recently been powered and if so, again checks for existence of real time clock 309 in step 2125. Then, function Check_Meltdown( ) waits for the current time and date to be determined by clock management functions in step 2127, clears various indicators such as the reset indicator and the new date time group indicator in step 2128. Then in step 2129, function Check-Meltdown( ) checks for the status of signal *HITMP to confirm that freezer 213 is not too warm.

If freezer 213 has become too warm as indicated by an active signal *HITMP, function Check_Meltdown( ) checks to see if the power has been turned off for more than a predetermined duration, such as 15 minutes in step 2130. If so, function Check_Meltdown( ) executes the function go_meltdown( ) in step 2131 that disables further vending operations by vending machine 100. Function go_meltdown( ) sets a flag in the first pass and only in a later pass shuts down the machine, thereby allowing a vending operation currently in progress to complete before the shutdown.

In the above description, to illustrate the present invention, references are made to various failure control devices, such as a oven failure control device, a freezer failure control device and a power failure control device. It will be obvious, however, to one of ordinary skill in the art, that these devices are merely illustrative and are not required to practice the present invention. Therefore, once a food product has been selected by a customer, no further customer input is necessary and various components of vending machine 100 automatically perform several actions to ensure quality of freshly cooked product being dispensed through delivery chute 103. These actions are performed with a number of failure control devices that monitor various components of a vending machine. A microcontroller coupled to one or more of the failure control devices disables vending of food in case of a failure in one of the components.

Various modifications and adaptions of the embodiments disclosed herein are covered by the attached claims.

We claim:

1. A method for vending food from a vending machine comprising:

sensing the condition of a component of the vending machine and driving a failure signal, the failure signal having a plurality of states for indicating status of the component; and driving a signal on a heat source input lead active after receiving a signal on a product selection line if the failure signal has a first state; and suspending vending operations and displaying an error message on a customer display if the failure signal has a second state.

2. The method of claim 1 wherein the vending machine includes a magnetron having an enable line and a status line, the method comprising:

driving an enable signal active on the enable line; and driving the failure control signal to the second state if the signal on the status line remains inactive after driving the enable signal active.

3. The method of claim 1 wherein the vending machine includes an oven having a heating element coupled to the heat source input lead, and further includes a cutoff switch coupled in series with a power supply of the oven, the method further comprising:

automatically opening the cutoff switch if the heating element remains above a predetermined temperature.

4. The method of claim 1 further comprising:

driving the failure control signal to the second state when a real time signal exceeds a current time signal from a memory element by a predetermined threshold and otherwise supplying the real time signal to the memory element.

5. The method of claim 1 wherein the vending machine includes a freezer having a status line, the method further comprising:

driving a status signal active on the status line when the temperature in the freezer exceeds a predetermined temperature.

6. The method of claim 5 wherein the freezer has a door and an event line, the method further comprising:

driving an event signal active on the event line when the door is opened; and checking, prior to driving the status signal active, the temperature in the freezer after a predetermined cool off time after the event signal becomes active.

7. A method of operating a door covering an opening in a refrigeration compartment of a vending machine, the method comprising:

converting the rotary motion of a motor into a reciprocatory sliding motion of the door to expose an opening in the refrigeration compartment; and moving a packaged food item through the opening.

8. The method of claim 7 wherein said converting includes using a belt.

9. The method of claim 7 wherein said converting includes using a link.

10. A method of operating a door covering an operating in a refrigeration compartment of a vending machine, the method comprising:

rotating a link using a motor;

converting the rotary motion of the link into a reciprocatory motion of the door to expose an opening in the refrigeration compartment; and moving a packaged food item through the opening;

wherein said converting step comprises moving a roller coupled to the link in a slot of the door.

11. A method of operating a door covering an opening in a refrigeration compartment of a vending machine, the method comprising:

converting the rotary motion of a motor into a reciprocatory planar motion of the door to expose an opening in the refrigeration compartment; and moving a packaged food item through the opening.

* * * * *